US007167666B2

(12) United States Patent
Munakata et al.

(10) Patent No.: US 7,167,666 B2
(45) Date of Patent: Jan. 23, 2007

(54) LIQUID DEVELOPMENT DEVICE, IMAGE FORMING APPARATUS, AND IMAGE FORMING SYSTEM

(75) Inventors: Manabu Munakata, Nagano-ken (JP); Nobumasa Abe, Nagano-ken (JP); Ken Ikuma, Nagano-ken (JP); Masahide Nakamura, Nagano-ken (JP); Shinichi Kamoshida, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 183 days.

(21) Appl. No.: 10/921,366

(22) Filed: Aug. 18, 2004

(65) Prior Publication Data

US 2005/0063736 A1 Mar. 24, 2005

(30) Foreign Application Priority Data

| | | |
|---|---|---|
| Aug. 20, 2003 | (JP) | 2003-296757 |
| Aug. 20, 2003 | (JP) | 2003-296758 |
| Sep. 11, 2003 | (JP) | 2003-320046 |
| Sep. 12, 2003 | (JP) | 2003-321260 |

(51) Int. Cl.
*G03G 15/10* (2006.01)

(52) U.S. Cl. ..... 399/237; 399/239

(58) Field of Classification Search ..... 399/237, 399/238, 239, 248, 256; 430/117
See application file for complete search history.

(56) References Cited

U.S. PATENT DOCUMENTS

| | | | | |
|---|---|---|---|---|
| 3,817,748 | A * | 6/1974 | Whittaker | 430/117 X |
| 3,974,554 | A * | 8/1976 | Fantuzzo | 399/239 X |
| 4,024,838 | A * | 5/1977 | Horie | 399/239 |
| 5,717,985 | A * | 2/1998 | Labombard et al. | 399/237 X |
| 6,148,166 | A * | 11/2000 | Watanabe | 399/239 |
| 6,360,066 | B1 * | 3/2002 | Kawahito et al. | 399/256 X |
| 6,640,074 | B1 * | 10/2003 | Kim | 399/238 |
| 6,868,246 | B1 * | 3/2005 | Takeuchi et al. | 399/237 |
| 2003/0044202 | A1 * | 3/2003 | Song et al. | 399/238 |
| 2003/0059234 | A1 * | 3/2003 | Sasaki et al. | 399/237 |
| 2005/0069348 | A1 * | 3/2005 | Fujita et al. | 399/237 |
| 2005/0069349 | A1 * | 3/2005 | Nakamura et al. | 399/237 |

FOREIGN PATENT DOCUMENTS

| | | |
|---|---|---|
| JP | 09-211994 | 8/1997 |
| JP | 11-095563 | 4/1999 |
| JP | 2000-089576 | 3/2000 |
| JP | 2000-162858 | 6/2000 |
| JP | 2001-109270 | 4/2001 |
| JP | 2001-282002 | 10/2001 |
| JP | 2002-174954 | 6/2002 |
| JP | 2002-202662 A * | 7/2002 |
| JP | 2002-202663 | 7/2002 |
| JP | 2002-287513 A * | 10/2002 |

* cited by examiner

*Primary Examiner*—Sophia S. Chen
(74) *Attorney, Agent, or Firm*—Hogan & Hartson LLP

(57) ABSTRACT

A liquid development device has a developer retaining roller having recesses, which are for retaining liquid developer, provided in the surface of the developer retaining roller; and a supplying roller for supplying the liquid developer to the developer retaining roller. The upper edge of the supplying roller is located above the lower edge of the developer retaining roller in the vertical direction, and the supplying roller supplies the liquid developer to the developer retaining roller downwards from above.

39 Claims, 38 Drawing Sheets

FIG. 3
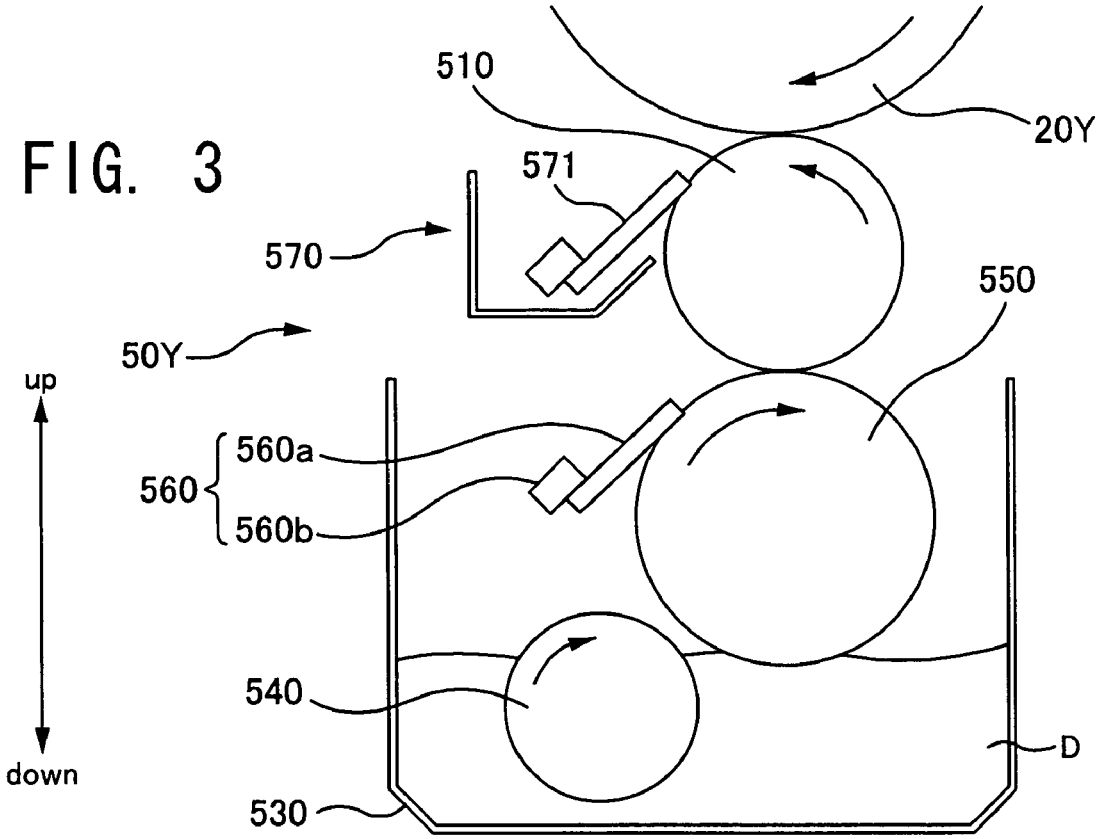
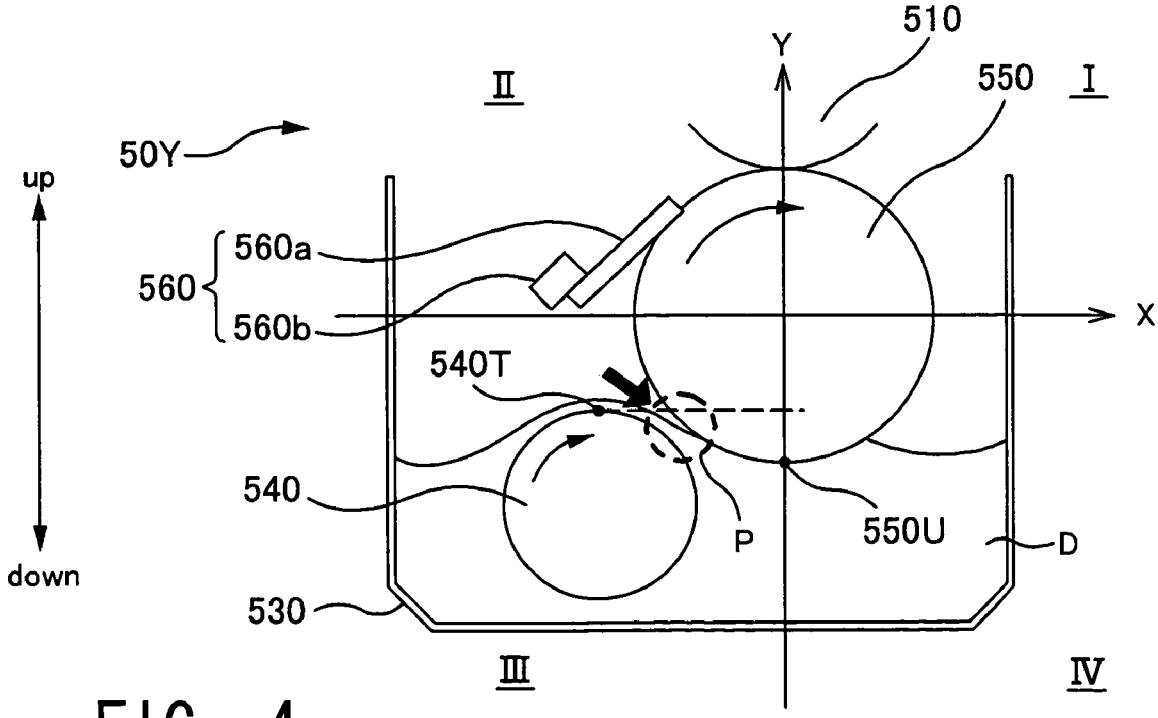
FIG. 4

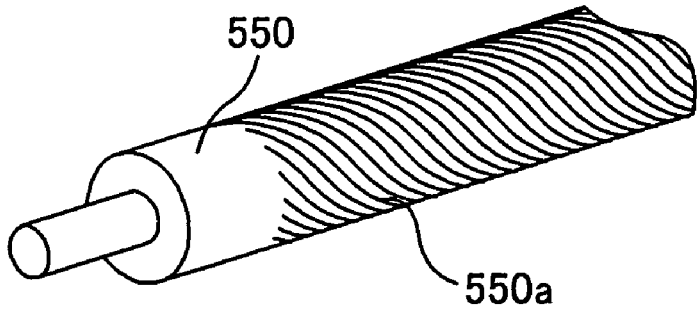
FIG. 5
FIG. 6A
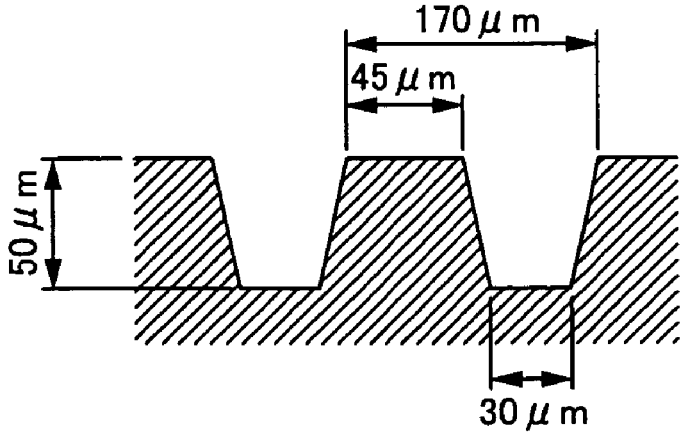
FIG. 6B
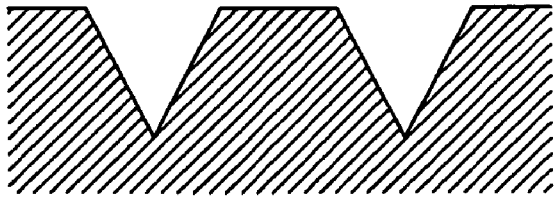
FIG. 6C
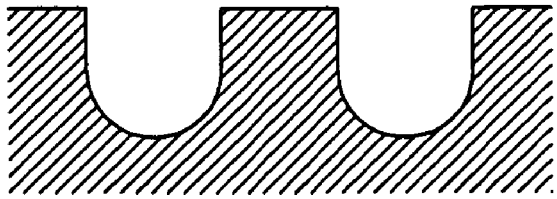

before application after application

FIG. 12
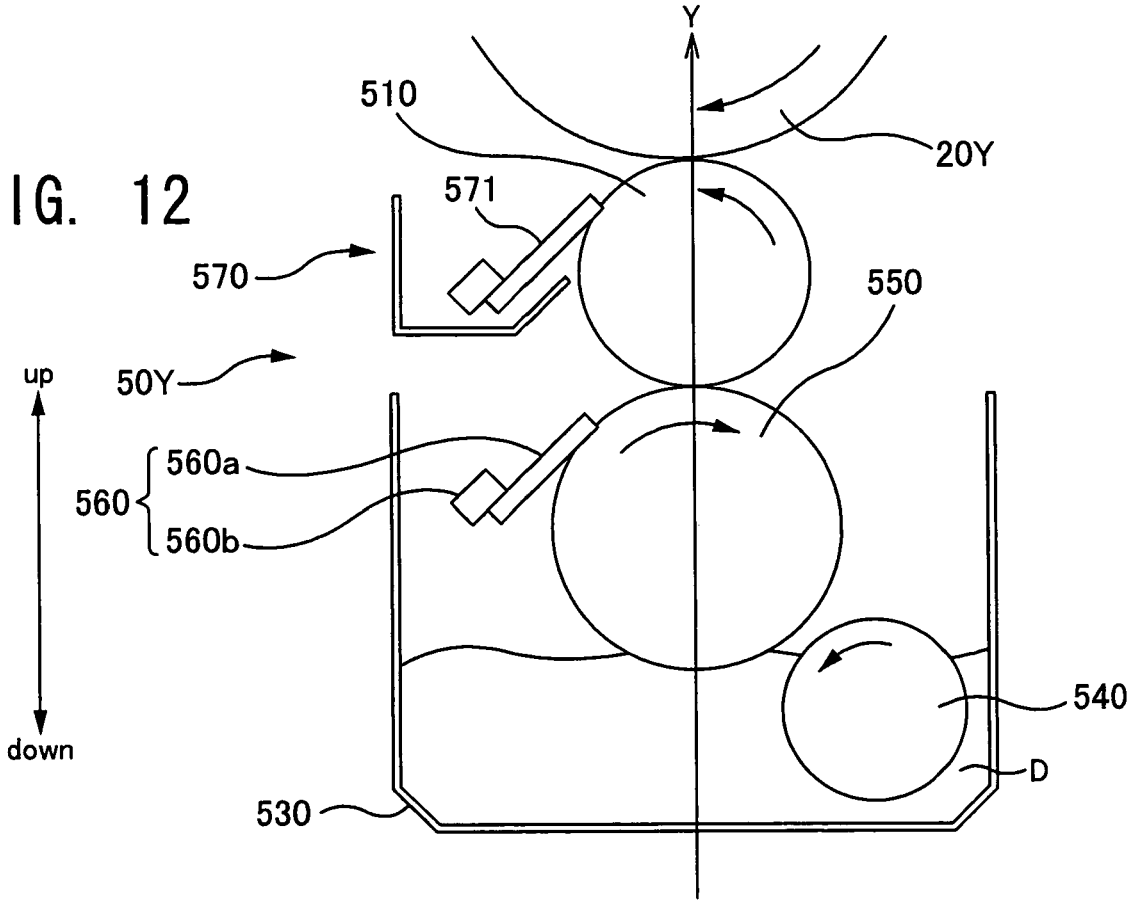
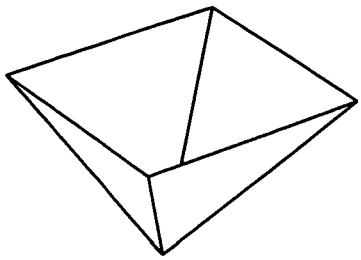
FIG. 13A
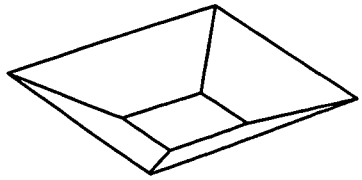
FIG. 13B

LIQUID DEVELOPMENT DEVICE, IMAGE FORMING APPARATUS, AND IMAGE FORMING SYSTEM

CROSS-REFERENCE TO RELATED APPLICATIONS

The present application claims priority upon Japanese Patent Application No. 2003-296757 filed Aug. 20, 2003, Japanese Patent Application No. 2003-296758 filed Aug. 20, 2003, Japanese Patent Application No. 2003-320046 filed Sep. 11, 2003, and Japanese Patent Application No. 2003-321260 filed Sep. 12, 2003, which are herein incorporated by reference.

BACKGROUND OF THE INVENTION

1. Field of the Invention

The present invention relates to liquid development devices, image forming apparatuses, and image forming systems.

2. Description of the Related Art

There are known image forming apparatuses that include, for example, a photoconductor that serves as an example of an image bearing body for bearing a latent image, and a liquid development device for developing the latent image bore by the photoconductor with liquid developer (which is also referred to simply as "developer" below). When such a type of image forming apparatus receives image signals etc. from external devices such as host computers, it forms a latent image on the photoconductor. Then, with the rotation of the photoconductor, the latent image formed on and bore by the photoconductor reaches a developing position where it is developed by the liquid development device, and thus a developer image is formed on the photoconductor. (See, for example, JP 2001-282002A.)

(1) In order to achieve such functions as to develop the latent image formed on the photoconductor, liquid development devices of the type described above have a developer retaining roller having recesses, which are for retaining liquid developer, provided in the surface of the roller, and a supplying roller for supplying the liquid developer to the developer retaining roller.

In these liquid development devices, the liquid developer supplied to the developer retaining roller by the supplying roller is retained in the recesses provided in the surface of the developer retaining roller.

However, in these liquid development devices, the liquid developer that is supplied to the developer retaining roller by the supplying roller may get fixed in the recesses of the developer retaining roller.

(2) Another type of liquid development device is provided with a retaining roller having recesses, which are for retaining liquid developer, provided in the surface of the roller, a supplying roller for supplying the liquid developer to the retaining roller, and an amount-restricting member for restricting the amount of the liquid developer retained in the recesses. The upper edge of the supplying roller is located above the lower edge of the retaining roller in the vertical direction.

In these conventional liquid development devices, the supplying roller arranged below the retaining roller supplies the liquid developer to the retaining roller by causing the liquid surface of the liquid developer to rise. However, when the amount of liquid developer in the liquid development device becomes small and the level of the liquid surface drops, the amount of liquid developer supplied to the retaining roller by the supplying roller may also decrease. One countermeasure that has been devised is to arrange the upper edge of the supplying roller above the lower edge of the retaining roller in the vertical direction such that the supplying roller draws up the liquid developer to supply it to the retaining roller. In this way, it is possible to supply the liquid developer more effectively when the amount of liquid developer in the liquid development device becomes small.

However, in such liquid development devices, a shortage of the liquid developer may locally occur on the retaining roller. For example, the amount of liquid developer retained in the recesses may decrease if the liquid developer retained in the recesses of the retaining roller flows out from those recesses when the retaining roller rotates.

(3) Another type of liquid development device is provided with a retaining roller for retaining liquid developer to be supplied to a developer bearing body, a carrying roller for carrying the liquid developer to the retaining roller, an amount-restricting member for restricting the amount of the liquid developer on the retaining roller, and a containing section for containing the liquid developer, in order to achieve such functions as to develop the latent image formed on the photoconductor.

In these types of liquid development devices, the amount of the liquid developer, which has been carried from the containing section to the retaining roller by the carrying roller and retained by the retaining roller, is restricted by the amount-restricting member, and then the liquid developer is supplied to the developer bearing body. The liquid developer supplied to the developer bearing body is then used for developing the latent image.

However, in such liquid development devices, the liquid developer may pass over the amount-restricting member when the carrying roller carries the liquid developer to the retaining roller.

For example, if the carrying roller is located in the lower section of the amount-restricting member, the liquid developer is raised due to its viscosity when the carrying roller carries the liquid developer to the retaining roller, and the raised liquid developer may pass over the amount-restricting member through a gap provided between. the amount-restricting member and the containing section, which is a separate member. In other cases, the liquid developer may scatter when the carrying roller carries the liquid developer, and the scattered liquid developer may pass over the amount-restricting member through the gap between the amount-restricting member and the containing section. Further, if the carrying roller carries a large amount of liquid developer, then the tendency for the liquid developer to pass over the amount-restricting member becomes even larger.

(4) Another type of liquid development device is provided with a developer bearing roller that is capable of bearing liquid developer from the side on one end of the developer bearing roller up to the side on the other end along the axial direction thereof, a containing section for containing the liquid developer, and a carrying roller for carrying the liquid developer that is to be bore by the developer bearing roller, in order to achieve such functions as to develop the latent image formed on the photoconductor.

In such liquid development devices, the liquid developer carried by the carrying roller is bore by the developer bearing roller from the side on one end of the developer bearing roller up to the side on the other end along the axial direction thereof, and the liquid developer bore by the developer bearing roller is used for developing the latent image bore by the photoconductor.

However, in such liquid development devices, deviation may occur in the liquid level of the liquid developer contained in the containing section.

For example, latent images that are bore by the image bearing body and that are subjected to development are more likely to be formed in the central section in the axial direction of image bearing body rather than at the sides on both ends thereof. In this case, the liquid development device will develop the latent image using the liquid developer bore on the central section in the axial direction of the developer bearing roller. If latent images formed in the central section of image bearing body are continuously developed, then only the liquid developer on the central section in the longitudinal direction of the containing section, which corresponds to the axial direction, will be used for development. As a result, the liquid level of the liquid developer at the central section in the longitudinal direction of the containing section becomes low, and the liquid level of the liquid developer at the sides on both ends becomes high. Therefore, deviation will occur in the liquid level of the liquid developer contained in the containing section.

SUMMARY OF THE INVENTION

The present invention has been made in view of the above and other issues. An object of the present invention is to keep the liquid developer from getting fixed in the recesses of the developer retaining roller. Another object of the present invention is to prevent a shortage of liquid developer from occurring locally on the retaining roller. Another object of the present invention is to certainly prevent the liquid developer from passing over the amount-restricting member when the carrying roller carries the liquid developer to the retaining roller. Another object of the present invention is to prevent deviation in the liquid level of the liquid developer contained in the containing section from occurring.

An aspect of the present invention is a liquid development device comprising: a developer retaining roller having recesses provided in the surface of the developer retaining roller, the recesses being provided for retaining liquid developer; and a supplying roller for supplying the liquid developer to the developer retaining roller, wherein the upper edge of the supplying roller is located above the lower edge of the developer retaining roller in the vertical direction, and wherein the supplying roller supplies the liquid developer to the developer retaining roller downwards from above.

Another aspect of the present invention is a liquid development device comprising: a retaining roller having recesses provided in the surface of the retaining roller, the recesses being provided for retaining liquid developer; a supplying roller for supplying the liquid developer to the retaining roller, the upper edge of the supplying roller being located above the lower edge of the retaining roller in the vertical direction; and an amount-restricting member for restricting the amount of the liquid developer retained in the recesses, wherein, among four quadrants formed by a first coordinate axis that passes the center of the retaining roller and that extends in the vertically upward direction and a second coordinate axis that passes the center of the retaining roller and that extends horizontally from left to right of the first coordinate axis, the supplying roller is located in either one of the third quadrant and the fourth quadrant, and the amount-restricting member is located in a quadrant vertically above the quadrant where the supplying roller is located, wherein the rotating direction of the retaining roller is in a direction in which the retaining roller moves from the quadrant where the supplying roller is located toward the quadrant where the amount-restricting member is located, and wherein the rotating direction of the supplying roller is in the same direction as the rotating direction of the retaining roller.

Another aspect of the present invention is a liquid development device comprising: a retaining roller for retaining liquid developer to be supplied to a developer bearing body; a carrying roller for carrying the liquid developer to the retaining roller; an amount-restricting member for restricting the amount of the liquid developer on the retaining roller; and a containing section for containing the liquid developer, wherein, among four quadrants formed by a first coordinate axis that passes the center of the retaining roller and that extends in the vertically upward direction and a second coordinate axis that passes the center of the retaining roller and that extends horizontally from left to right of the first coordinate axis, the amount-restricting member is located in the first quadrant when the carrying roller is located in the third quadrant, and the amount-restricting member is located in the second quadrant when the carrying roller is located in the fourth quadrant.

Another aspect of the present invention is a liquid development device comprising: a developer bearing roller that is capable of bearing liquid developer from the side on one end of the developer bearing roller up to the side on the other end along the axial direction thereof, the liquid developer bore by the developer bearing roller being used by the liquid development device to develop a latent image bore by an image bearing body; a containing section for containing the liquid developer; and a carrying roller for carrying the liquid developer that is to be bore by the developer bearing roller, wherein the carrying roller rotates to carry the liquid developer towards the central section, in the axial direction, of the carrying roller.

Features and objects of the present invention other than the above will become clear by reading the description of the present specification with reference to the accompanying drawings.

BRIEF DESCRIPTION OF THE DRAWINGS

In order to facilitate further understanding of the present invention and the advantages thereof, reference is now made to the following description taken in conjunction with the accompanying drawings wherein:

FIG. 3 is a section view showing main structural components of a developing unit according to a first embodiment;

FIG. 4 is a section view showing quadrants in which the main structural components of the developing unit are arranged;

FIG. 5 is a perspective view showing the surface of an application roller 550;

FIG. 6A is a section view showing a groove 550*a* having a trapezoidal cross section, FIG. 6B is a section view showing a groove 550*a* having a cross section in the shape of an inverted delta, and FIG. 6C is a section view showing a groove 550*a* having a semicircular cross section;

FIG. 12 is a section view showing another example of main structural components of a developing unit;

FIG. 13A is a diagram showing an example of a recess provided in the surface of the application roller 550, and FIG. 13B is a diagram showing another example of a recess provided in the surface of the application roller 550;

DETAILED DESCRIPTION OF THE INVENTION

Figure 1:
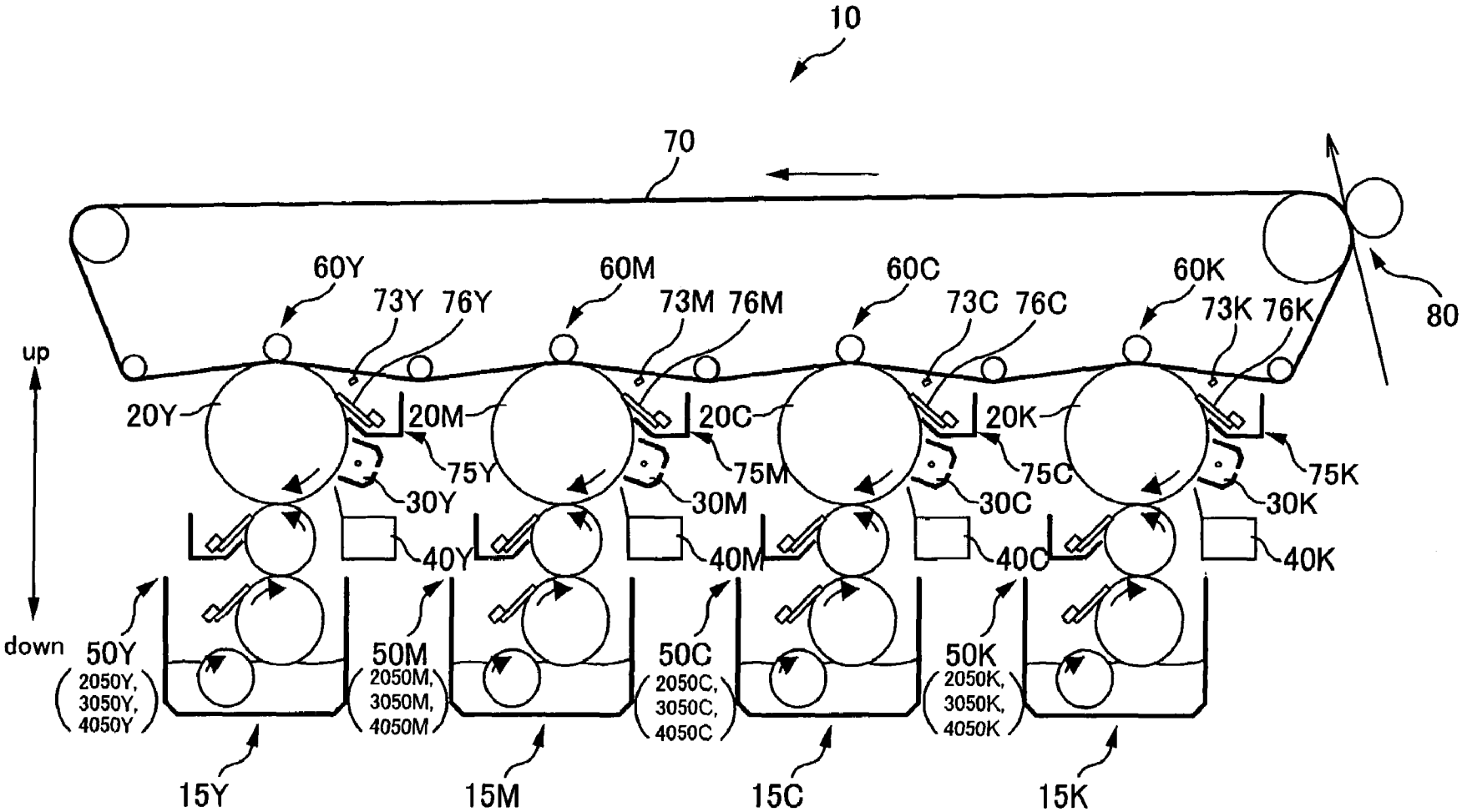
FIG. 1 is a diagram showing main structural components structuring an image forming apparatus according to an embodiment of the present invention.

At least the following matters will be made clear by the explanation in the present specification and the description of the accompanying drawings.

(1) An aspect of the present invention is a liquid development device comprising:

a developer retaining roller having recesses provided in the surface of the developer retaining roller, the recesses being provided for retaining liquid developer; and a supplying roller for supplying the liquid developer to the developer retaining roller, wherein the upper edge of the supplying roller is located above the lower edge of the developer retaining roller in the vertical direction, and wherein the supplying roller supplies the liquid developer to the developer retaining roller downwards from above.

According to such a liquid development device, it is possible to keep the liquid developer from getting fixed in the recesses of the developer retaining roller.

Further, in the liquid development device, among four quadrants formed by a first coordinate axis that passes the center of the developer retaining roller and that extends in the vertically upward direction and a second coordinate axis that passes the center of the developer retaining roller and that extends from left to right of the first coordinate axis, the rotating direction of the developer retaining roller may be in a direction in which the developer retaining roller moves from the third quadrant toward the second quadrant; the rotating direction of the supplying roller may be in the same direction as the rotating direction of the developer retaining roller; and the supplying roller may be located on the left side of the first coordinate axis.

Further, in the liquid development device, the liquid development device may further comprise an amount-restricting member that is for restricting the amount of the liquid developer retained in the recesses and that abuts against the developer retaining roller; and the supplying roller may be located in the third quadrant and the amount-restricting member may be located in the second quadrant.

According to such a liquid development device, the liquid developer that is retained in the recesses without getting fixed therein can be restricted by the amount-restricting member to a predetermined amount.

Further, in the liquid development device, an abutting position where the amount-restricting member abuts against the developer retaining roller may be located above the position of the liquid surface of the liquid developer in the vertical direction.

According to such a liquid development device, the liquid developer that is retained in the recesses without getting fixed therein can be restricted even certainly by the amount-restricting member to a predetermined amount.

Further, in the liquid development device, the developer retaining roller and the supplying roller do not have to abut against each other.

If the developer retaining roller and the supplying roller are in abutment, then it is possible for the supplying roller to scrape off the liquid developer retained in the recesses, and thus, the possibility of preventing the liquid developer from getting fixed in the recesses can be increased. However, in cases where the developer retaining roller and the supplying roller are not in abutment, the above-mentioned possibility is low. Therefore, the above-mentioned effect, that is, the effect of being able to prevent the liquid developer from getting fixed in the recesses of the developer retaining roller, will be achieved more advantageously in cases where the developer retaining roller and the supplying roller are not in abutment.

Further, in the liquid development device, the liquid development device does not have to be provided with a cleaning member for cleaning the liquid developer retained in the recesses.

In cases where a cleaning member for cleaning the liquid developer retained in the recesses is not provided, the liquid developer will be retained in the recesses without being removed, and thus, the possibility that the liquid developer gets fixed in the recesses rises. Therefore, the above-mentioned effect, that is, the effect of being able to prevent the liquid developer from getting fixed in the recesses of the developer retaining roller, will be achieved more advantageously.

Further, in the liquid development device, the recesses may be helical grooves; and a plurality of the helical grooves may be provided in the surface of the developer retaining roller at predetermined intervals.

Further, in the liquid development device, the liquid developer may be non-volatile liquid developer that is non-volatile at room temperature.

Non-volatile liquid developer has high viscosity. If the viscosity of the liquid developer is high, then the possibility that the liquid developer gets fixed in the recesses rises. Therefore, the above-mentioned effect, that is, the effect of being able to prevent the liquid developer from getting fixed in the recesses of the developer retaining roller, will be achieved more advantageously.

It is also possible to achieve a liquid development device comprising:

a developer retaining roller having recesses provided in the surface of the developer retaining roller, the recesses being provided for retaining liquid developer; and a supplying roller for supplying the liquid developer to the developer retaining roller, wherein:

the upper edge of the supplying roller is located above the lower edge of the developer retaining roller in the vertical direction;

the supplying roller supplies the liquid developer to the developer retaining roller downwards from above;

among four quadrants formed by a first coordinate axis that passes the center of the developer retaining roller and that extends in the vertically upward direction and a second coordinate axis that passes the center of the developer retaining roller and that extends from left to right of the first coordinate axis, the rotating direction of the developer retaining roller is in a direction in which the developer retaining roller moves from the third quadrant toward the second quadrant;

the rotating direction of the supplying roller is in the same direction as the rotating direction of the developer retaining roller;

the supplying roller is located on the left side of the first coordinate axis;

the liquid development device further comprises an amount-restricting member that is for restricting the amount of the liquid developer retained in the recesses and that abuts against the developer retaining roller;

the supplying roller is located in the third quadrant and the amount-restricting member is located in the second quadrant;

in the vertical direction, an abutting position where the amount-restricting member abuts against the developer retaining roller is located above the position of the liquid surface of the liquid developer;

the developer retaining roller and the supplying roller do not abut against each other;

the liquid development device is not provided with a cleaning member for cleaning the liquid developer retained in the recesses;

the recesses are helical grooves;

a plurality of the helical grooves are provided in the surface of the developer retaining roller at predetermined intervals; and the liquid developer is non-volatile liquid developer that is non-volatile at room temperature.

It is also possible to achieve an image forming apparatus comprising a liquid development device that includes:

a developer retaining roller having recesses provided in the surface of the developer retaining roller, the recesses being provided for retaining liquid developer; and a supplying roller for supplying the liquid developer to the developer retaining roller, wherein the upper edge of the supplying roller is located above the lower edge of the developer retaining roller in the vertical direction, and wherein the supplying roller supplies the liquid developer to the developer retaining roller downwards from above.

It is also possible to achieve an image forming system comprising:

a computer; and an image forming apparatus that is connectable to the computer and that has a liquid development device including:

a developer retaining roller having recesses provided in the surface of the developer retaining roller, the recesses being provided for retaining liquid developer; and a supplying roller for supplying the liquid developer to the developer retaining roller, wherein the upper edge of the supplying roller is located above the lower edge of the developer retaining roller in the vertical direction, and wherein the supplying roller supplies the liquid developer to the developer retaining roller downwards from above.

(2) Another aspect of the present invention is a liquid development device comprising:

a retaining roller having recesses provided in the surface of the retaining roller, the recesses being provided for retaining liquid developer;

a supplying roller for supplying the liquid developer to the retaining roller, the upper edge of the supplying roller being located above the lower edge of the retaining roller in the vertical direction; and an amount-restricting member for restricting the amount of the liquid developer retained in the recesses, wherein, among four quadrants formed by a first coordinate axis that passes the center of the retaining roller and that extends in the vertically upward direction and a second coordinate axis that passes the center of the retaining roller and that extends horizontally from left to right of the first coordinate axis, the supplying roller is located in either one of the third quadrant and the fourth quadrant, and the amount-restricting member is located in a quadrant vertically above the quadrant where the supplying roller is located, wherein the rotating direction of the retaining roller is in a direction in which the retaining roller moves from the quadrant where the supplying roller is located toward the quadrant where the amount-restricting member is located, and wherein the rotating direction of the supplying roller is in the same direction as the rotating direction of the retaining roller.

According to such a liquid development device, it is possible to prevent a shortage of liquid developer from occurring locally on the retaining roller.

Further, in the liquid development device, a vertical line that extends vertically downwards from an abutting position where the amount-restricting member abuts against the retaining roller may pass through the supplying roller.

According to such a liquid development device, the liquid developer that has been scraped off at the abutting position by the amount-restricting member falls towards the upper edge of the supplying roller due to gravity. Therefore, it becomes possible to supply the liquid developer from the supplying roller to the retaining roller stably.

Further, in the liquid development device, the supplying roller does not have to abut against the retaining roller; and an angle formed between a direction from the center of the retaining roller to the abutting position and a direction from the center of the retaining roller to the center of the supplying roller may be equal to or less than 90°.

According to such a liquid development device, the supplying roller and the amount-restricting member are arranged close to each other, and therefore, it becomes possible to allow the liquid developer to build up between the upper edge of the supplying roller and the amount-restricting member and in the periphery of the retaining roller.

Further, in the liquid development device, the abutting position may be located above the position of the liquid surface of the liquid developer in the vertical direction.

If the abutting position is located below the level of the liquid surface of the liquid developer in the vertical direction, then the liquid developer will adhere to the amount-restricting member. On the other hand, by arranging the abutting position above the position of the liquid surface of the liquid developer in the vertical direction, it is possible to prevent the liquid developer from adhering to the amount-restricting member.

Further, in the liquid development device, the liquid developer may be non-volatile liquid developer that is non-volatile at room temperature.

When non-volatile liquid developer is adopted as the liquid developer, the liquid developer will have high viscosity. Since liquid developer with high viscosity is low in flowability, it becomes possible to allow the liquid developer to build up easily between the supplying roller and the amount-restricting member and in the periphery of the retaining roller.

Further, in the liquid development device, the liquid development device may further comprise a developer bearing roller to which the liquid developer, whose amount has been restricted by the amount-restricting member, is applied by the retaining roller and that is for bearing the liquid developer that has been applied thereto; and the developer bearing roller may be located vertically above the second coordinate axis.

Further, in the liquid development device, the recesses of the retaining roller may be helical grooves; and a plurality of the helical grooves may be provided in the surface of the retaining roller at predetermined intervals.

It is also possible to achieve a liquid development device comprising:

a retaining roller having recesses provided in the surface of the retaining roller, the recesses being provided for retaining liquid developer;

a supplying roller for supplying the liquid developer to the retaining roller, the upper edge of the supplying roller being located above the lower edge of the retaining roller in the vertical direction; and an amount-restricting member for restricting the amount of the liquid developer retained in the recesses, wherein:

among four quadrants formed by a first coordinate axis that passes the center of the retaining roller and that extends in the vertically upward direction and a second coordinate axis that passes the center of the retaining roller and that extends horizontally from left to right of the first coordinate axis, the supplying roller is located in either one of the third quadrant and the fourth quadrant, and the amount-restricting member is located in a quadrant vertically above the quadrant where the supplying roller is located;

the rotating direction of the retaining roller is in a direction in which the retaining roller moves from the quadrant where the supplying roller is located toward the quadrant where the amount-restricting member is located;

the rotating direction of the supplying roller is in the same direction as the rotating direction of the retaining roller;

a vertical line that extends vertically downwards from an abutting position where the amount-restricting member abuts against the retaining roller passes through the supplying roller;

the supplying roller does not abut against the retaining roller;

an angle formed between a direction from the center of the retaining roller to the abutting position and a direction from the center of the retaining roller to the center of the supplying roller is equal to or less than 90°;

in the vertical direction, the abutting position is located above the position of the liquid surface of the liquid developer;

the liquid developer is non-volatile liquid developer that is non-volatile at room temperature;

the liquid development device further comprises a developer bearing roller to which the liquid developer, whose amount has been restricted by the amount-restricting member, is applied by the retaining roller and that is for bearing the liquid developer that has been applied thereto;

the developer bearing roller is located vertically above the second coordinate axis;

the recesses of the retaining roller are helical grooves; and a plurality of the helical grooves are provided in the surface of the retaining roller at predetermined intervals.

It is also possible to achieve an image forming apparatus comprising a liquid development device that includes:

a retaining roller having recesses provided in the surface of the retaining roller, the recesses being provided for retaining liquid developer;

a supplying roller for supplying the liquid developer to the retaining roller, the upper edge of the supplying roller being located above the lower edge of the retaining roller in the vertical direction; and an amount-restricting member for restricting the amount of the liquid developer retained in the recesses, wherein, among four quadrants formed by a first coordinate axis that passes the center of the retaining roller and that extends in the vertically upward direction and a second coordinate axis that passes the center of the retaining roller and that extends horizontally from left to right of the first coordinate axis, the supplying roller is located in either one of the third quadrant and the fourth quadrant, and the amount-restricting member is located in a quadrant vertically above the quadrant where the supplying roller is located, wherein the rotating direction of the retaining roller is in a direction in which the retaining roller moves from the quadrant where the supplying roller is located toward the quadrant where the amount-restricting member is located, and wherein the rotating direction of the supplying roller is in the same direction as the rotating direction of the retaining roller.

It is also possible to achieve an image forming system comprising:

a computer; and an image forming apparatus that is connectable to the computer and that has a liquid development device including:

a retaining roller having recesses provided in the surface of the retaining roller, the recesses being provided for retaining liquid developer;

a supplying roller for supplying the liquid developer to the retaining roller, the upper edge of the supplying roller being located above the lower edge of the retaining roller in the vertical direction; and an amount-restricting member for restricting the amount of the liquid developer retained in the recesses, wherein, among four quadrants formed by a first coordinate axis that passes the center of the retaining roller and that extends in the vertically upward direction and a second coordinate axis that passes the center of the retaining roller and that extends horizontally from left to right of the first coordinate axis, the supplying roller is located in either one of the third quadrant and the fourth quadrant, and the amount-restricting member is located in a quadrant vertically above the quadrant where the supplying roller is located, wherein the rotating direction of the retaining roller is in a direction in which the retaining roller moves from the quadrant where the supplying roller is located toward the quadrant where the amount-restricting member is located, and wherein the rotating direction of the supplying roller is in the same direction as the rotating direction of the retaining roller.

(3) Another aspect of the present invention is a liquid development device comprising:

a retaining roller for retaining liquid developer to be supplied to a developer bearing body;

a carrying roller for carrying the liquid developer to the retaining roller;

an amount-restricting member for restricting the amount of the liquid developer on the retaining roller; and a containing section for containing the liquid developer, wherein, among four quadrants formed by a first coordinate axis that passes the center of the retaining roller and that extends in the vertically upward direction and a second coordinate axis that passes the center of the retaining roller and that extends horizontally from left to right of the first coordinate axis, the amount-restricting member is located in the first quadrant when the carrying roller is located in the third quadrant, and the amount-restricting member is located in the second quadrant when the carrying roller is located in the fourth quadrant.

According to such a liquid development device, it is possible to certainly prevent the liquid developer from passing over the amount-restricting member when the carrying roller carries the liquid developer to the retaining roller.

Further, in the liquid development device, the upper edge of the carrying roller may be located above the lower edge of the retaining roller in the vertical direction.

When the amount of liquid developer contained in the containing section is small, it is more effective, in terms of carrying the liquid developer to the retaining roller, to arrange the upper edge of the carrying roller above the lower edge of the retaining roller rather than to arrange the upper edge of the carrying roller below the lower edge of the retaining roller.

Further, in the liquid development device, the amount-restricting member may have an abutting section that abuts against the surface of the retaining roller and a supporting section that supports the abutting section.

Since the amount-restricting member abuts against the surface of the retaining roller with its abutting section to restrict the amount of liquid developer on the retaining roller, it become difficult for the amount-restricting member to appropriately restrict the amount of liquid developer on the retaining roller if the liquid developer passes over the amount-restricting member and adheres thereto. Therefore, the effect of the present invention, that is, the effect that it becomes possible to certainly prevent the liquid developer from passing over the amount-restricting member when the carrying roller carries the liquid developer to the retaining roller, will be achieved more advantageously.

Further, in the liquid development device, the abutting section may abut against the surface of the retaining roller at one end; and in the vertical direction, the one end of the abutting section may be located above the other end of the abutting section.

There are cases in which the amount-restricting member carries out a so-called "trailing restriction" where one end of the abutting section, which abuts against the surface of the retaining roller, is located above the other end thereof. In trailing restriction, however, the liquid developer tends to pass over the amount-restricting member across the other end of the abutting section. Therefore, the effect of the present invention, that is, the effect that it becomes possible to certainly prevent the liquid developer from passing over the amount-restricting member when the carrying roller carries the liquid developer to the retaining roller, will be achieved more advantageously.

Further, in the liquid development device, the developer bearing body may be provided in the liquid development device; the developer bearing body may be a developing roller; the rotating direction of the developing roller may be opposite from the rotating direction of the retaining roller; and the carrying roller may be located in the fourth quadrant and the amount-restricting member is located in the second quadrant.

By structuring the liquid development device as above, it is possible to certainly prevent the liquid developer from passing over the amount-restricting member when the carrying roller carries the liquid developer to the retaining roller.

Further, in the liquid development device, the rotating direction of the carrying roller may be in the same direction as the rotating direction of the retaining roller.

According to such a liquid development device, the liquid developer carried by the carrying roller can easily adhere to the retaining roller because the carrying roller and the retaining roller pass each other when the carrying roller carries the liquid developer to the retaining roller.

Further, in the liquid development device, the liquid developer may be non-volatile liquid developer that is non-volatile at room temperature.

When non-volatile liquid developer is adopted as the liquid developer, the liquid developer, which is high in viscosity, clings to the carrying roller, and thus, a large amount of liquid developer may be carried by the carrying roller. If a large amount of liquid developer is carried to the retaining roller by the carrying roller, then the possibility that the liquid developer passes over the amount-restricting member becomes even higher. Therefore, the effect of the present invention, that is, the effect that it becomes possible to certainly prevent the liquid developer from passing over the amount-restricting member when the carrying roller carries the liquid developer to the retaining roller, will be achieved more advantageously.

It is also possible to achieve a liquid development device comprising:

a retaining roller for retaining liquid developer to be supplied to a developer bearing body;

a carrying roller for carrying the liquid developer to the retaining roller;

an amount-restricting member for restricting the amount of the liquid developer on the retaining roller; and a containing section for containing the liquid developer, wherein:

among four quadrants formed by a first coordinate axis that passes the center of the retaining roller and that extends in the vertically upward direction and a second coordinate axis that passes the center of the retaining roller and that extends horizontally from left to right of the first coordinate axis, the amount-restricting member is located in the first quadrant when the carrying roller is located in the third quadrant, and the amount-restricting member is located in the second quadrant when the carrying roller is located in the fourth quadrant;

the upper edge of the carrying roller is located above the lower edge of the retaining roller in the vertical direction;

the amount-restricting member has an abutting section that abuts against the surface of the retaining roller and a supporting section that supports the abutting section;

the abutting section abuts against the surface of the retaining roller at one end;

in the vertical direction, the one end of the abutting section is located above the other end of the abutting section;

the developer bearing body is provided in the liquid development device;

the developer bearing body is a developing roller;

the rotating direction of the developing roller is opposite from the rotating direction of the retaining roller;

the carrying roller is located in the fourth quadrant and the amount-restricting member is located in the second quadrant;

the rotating direction of the carrying roller is in the same direction as the rotating direction of the retaining roller; and the liquid developer is non-volatile liquid developer that is non-volatile at room temperature.

It is also possible to achieve an image forming apparatus comprising:

an image bearing body for bearing a latent image; and a liquid development device that includes:

a retaining roller for retaining liquid developer to be supplied to a developer bearing body;

a carrying roller for carrying the liquid developer to the retaining roller;

an amount-restricting member for restricting the amount of the liquid developer on the retaining roller; and a containing section for containing the liquid developer, the liquid development device developing the latent image bore by the image bearing body with the liquid developer bore by the developer bearing body, wherein, among four quadrants formed by a first coordinate axis that passes the center of the retaining roller and that extends in the vertically upward direction and a second coordinate axis that passes the center of the retaining roller and that extends horizontally from left to right of the first coordinate axis, the amount-restricting member is located in the first quadrant when the carrying roller is located in the third quadrant, and the amount-restricting member is located in the second quadrant when the carrying roller is located in the fourth quadrant.

It is also possible to achieve an image forming system comprising:

a computer; and an image forming apparatus that is connectable to the computer and that has:

an image bearing body for bearing a latent image; and a liquid development device that includes:

a retaining roller for retaining liquid developer to be supplied to a developer bearing body;

a carrying roller for carrying the liquid developer to the retaining roller;

an amount-restricting member for restricting the amount of the liquid developer on the retaining roller; and a containing section for containing the liquid developer, the liquid development device developing the latent image bore by the image bearing body with the liquid developer bore by the developer bearing body, wherein, among four quadrants formed by a first coordinate axis that passes the center of the retaining roller and that extends in the vertically upward direction and a second coordinate axis that passes the center of the retaining roller and that extends horizontally from left to right of the first coordinate axis, the amount-restricting member is located in the first quadrant when the carrying roller is located in the third quadrant, and the amount-restricting member is located in the second quadrant when the carrying roller is located in the fourth quadrant.

(4) Another aspect of the present invention is a liquid development device comprising:

a developer bearing roller that is capable of bearing liquid developer from the side on one end of the developer bearing roller up to the side on the other end along the axial direction thereof, the liquid developer bore by the developer bearing roller being used by the liquid development device to develop a latent image bore by an image bearing body;

a containing section for containing the liquid developer; and a carrying roller for carrying the liquid developer that is to be bore by the developer bearing roller, wherein the carrying roller rotates to carry the liquid developer towards the central section, in the axial direction, of the carrying roller.

According to such a liquid development device, it is possible to prevent deviation in the liquid level of the liquid developer contained in the containing section from occurring.

Further, in the liquid development device, the carrying roller may rotate to carry the liquid developer from the sides on both ends in the axial direction towards the central section.

According to such a liquid development device, the carrying roller carries the liquid developer from the sides on both ends towards the central section. Therefore, even when the liquid developer that is bore on the central section, rather than on the sides on both ends, in the axial direction of the developer bearing roller is used frequently for development, it is possible to minimize the difference in the liquid level of the liquid developer between the central section and the sides on both ends in the longitudinal direction of the containing section.

Further, in the liquid development device, the number of the carrying roller provided in the liquid development device may be one.

If only one carrying roller is provided for reasons such as to achieve downsizing of the device, then it becomes difficult to circulate the liquid developer in the containing section. As a result, deviation in the liquid level of the liquid developer, which is contained in the containing section, is likely to occur. Therefore, the effect of the present invention, that is, the effect that it is possible to prevent deviation in the liquid level of the liquid developer contained in the containing section from occurring, will be achieved more advantageously.

Further, in the liquid development device, the carrying roller may be a carrying screw.

According to such a liquid development device, it is possible to make it easier to carry the liquid developer in the axial direction with the screw.

Further, in the liquid development device, the carrying screw may be provided with a first helical blade provided from the side on one end in the axial direction up to the central section, and a second helical blade provided from the side on the other end in the axial direction up to the central section; and the twisting direction of the first blade may differ from the twisting direction of the second blade.

According to such a liquid development device, when the carrying roller is rotated, the two blades whose twisting directions are different from each other can carry the liquid developer, which is contained in the containing section, from the sides on both ends to the central section.

Further, in the liquid development device, the liquid development device may further comprise a cleaning member for scraping off the liquid developer bore by the developer bearing roller after the latent image has been developed; and the liquid developer that has been scraped off by the cleaning member may be collected into the containing section.

In such a liquid development device, when there are more latent images bore by the image bearing body in the central section, the amount of liquid developer, which is scraped off by the cleaning member, falling at the sides on both ends in the longitudinal direction of the containing section will be larger than the amount of developer that falls at the central section. Thus, the liquid level becomes higher at the sides on both ends and a difference in the liquid level of the liquid developer tends to arise between the central section and the sides on both ends. Therefore, the effect of the present invention, that is, the effect that it is possible to prevent deviation in the liquid level of the liquid developer contained in the containing section from occurring, will be achieved more advantageously.

Further, in the liquid development device, the liquid development device may further comprise a supplying roller that has depressions in its surface, that retains the liquid developer carried by the carrying roller in the depressions, and that supplies the liquid developer retained in the depressions to the developer bearing roller.

It is possible to prevent deviation in the liquid level of the liquid developer contained in the containing section from occurring, even if the liquid development device is further provided with a supplying roller having the above-mentioned structure.

Further, in the liquid development device, the liquid developer may be non-volatile liquid developer that is non-volatile at room temperature.

When non-volatile liquid developer is adopted as the liquid developer, the liquid developer will be poor in flowability. Thus, deviation in the liquid level of the liquid developer, which is contained in the containing section, is more likely to occur. Therefore, the effect of the present invention, that is, the effect that it is possible to prevent deviation in the liquid level of the liquid developer contained in the containing section from occurring, will be achieved more advantageously.

It is also possible to achieve a liquid development device comprising:

a developer bearing roller that is capable of bearing liquid developer from the side on one end of the developer bearing roller up to the side on the other end along the axial direction thereof, the liquid developer bore by the developer bearing roller being used by the liquid development device to develop a latent image bore by an image bearing body;

a containing section for containing the liquid developer; and a carrying roller for carrying the liquid developer that is to be bore by the developer bearing roller, wherein the carrying roller rotates to carry the liquid developer from the sides on both ends in the axial direction towards the central section of the carrying roller, wherein:

the number of the carrying roller provided in the liquid development device is one;

the carrying roller is a carrying screw;

the carrying screw is provided with a first helical blade provided from the side on one end in the axial direction up to the central section, and a second helical blade provided from the side on the other end in the axial direction up to the central section;

the twisting direction of the first blade differs from the twisting direction of the second blade;

the liquid development device further comprises a cleaning member for scraping off the liquid developer bore by the developer bearing roller after the latent image has been developed;

the liquid developer that has been scraped off by the cleaning member is collected into the containing section;

the liquid development device further comprises a supplying roller that has depressions in its surface, that retains the liquid developer carried by the carrying roller in the depressions, and that supplies the liquid developer retained in the depressions to the developer bearing roller; and the liquid developer is non-volatile liquid developer that is non-volatile at room temperature.

It is also possible to achieve an image forming apparatus comprising:

an image bearing body for bearing a latent image; and a liquid development device that includes:

a developer bearing roller that is capable of bearing liquid developer from the side on one end of the developer bearing roller up to the side on the other end along the axial direction thereof, the liquid developer bore by the developer bearing roller being used by the liquid development device to develop the latent image bore by the image bearing body;

a containing section for containing the liquid developer; and a carrying roller for carrying the liquid developer that is to be bore by the developer bearing roller, wherein the carrying roller rotates to carry the liquid developer towards the central section, in the axial direction, of the carrying roller.

It is also possible to achieve an image forming system comprising:

a computer; and an image forming apparatus that is connectable to the computer and that has:

an image bearing body for bearing a latent image; and a liquid development device that includes:

a developer bearing roller that is capable of bearing liquid developer from the side on one end of the developer bearing roller up to the side on the other end along the axial direction thereof, the liquid developer bore by the developer bearing roller being used by the liquid development device to develop the latent image bore by the image bearing body;

a containing section for containing the liquid developer; and a carrying roller for carrying the liquid developer that is to be bore by the developer bearing roller, wherein the carrying roller rotates to carry the liquid developer towards the central section, in the axial direction, of the carrying roller.

EMBODIMENT OF IMAGE FORMING APPARATUS

Next, with reference to FIG. 1, an outline of a laser beam printer 10 (referred to also as "printer 10" below) is described as an example of an image forming apparatus. FIG. 1 is a diagram showing main structural components structuring the printer 10. It should be noted that in FIG. 1, the arrow indicates the vertical direction, and, for example, developing units 50Y, 50M, 50C, and 50K (2050Y,M,C,K in the second embodiment; 3050Y,M,C,K in the third embodiment; 4050Y,M,C,K in the fourth embodiment) (which serve as an example of a liquid developing device) are arranged in the lower section of the printer 10, and an intermediate transferring body 70 is arranged in the upper section of the printer 10.

<Overall Configuration of Image Forming Apparatus>

As shown in FIG. 1, the printer 10 according to the present embodiment includes four developing sections 15Y, 15M, 15C, and 15K, an intermediate transferring body 70, and a second transferring unit 80. The printer 10 further includes a not-shown fusing unit, a displaying unit constructed of a liquid-crystal panel and serving as means for making notifications to users, and a control unit 100 (see FIG. 2) for controlling these units etc. and managing the operations as a printer.

Each of the developing sections 15Y, 15M, 15C, and 15K has the function of respectively developing latent images with yellow (Y) developer, magenta (M) developer, cyan (C) developer, and black (K) developer (which serve as an example of liquid developer). Since the structure of the developing sections 15Y, 15M, 15C, and 15K is substantially the same, only the developing section 15Y is described in detail below.

As shown in FIG. 1, the developing section 15Y includes a charging unit 30Y, an exposing unit 40Y, a developing unit 50Y (developing unit 2050Y in the second embodiment; developing unit 3050Y in the third embodiment; developing unit 4050Y in the fourth embodiment), a first transferring unit 60Y, a static eliminating unit 73Y, and a photoconductor cleaning unit 75Y, all of which being arranged in the direction of rotation of a photoconductor 20Y.

The photoconductor 20Y has a cylindrical base and a photoconductive layer formed on the outer peripheral surface of the base, and it is rotatable about its central axis. In the present embodiment, the photoconductor 20Y rotates clockwise, as shown by the arrow in FIG. 1.

The charging unit 30Y is a device for charging the photoconductor 20Y. The exposing unit 40Y is a device for forming a latent image on the charged photoconductor 20Y by radiating a laser beam thereon. The exposing unit 40Y has, for example, a semiconductor laser, a polygon mirror, and an F-θ lens, and radiates a modulated laser beam onto the charged photoconductor 20Y according to image signals having been input from a not-shown host computer such as a personal computer or a word processor.

The developing unit 50Y (developing unit 2050Y in the second embodiment; developing unit 3050Y in the third embodiment; developing unit 4050Y in the fourth embodiment) is a device for developing the latent image formed on the photoconductor 20Y using the yellow (Y) developer. Details on the developing unit 50Y (developing unit 2050Y in the second embodiment; developing unit 3050Y in the third embodiment; developing unit 4050Y in the fourth embodiment) will be described further below.

The first transferring unit 60Y is a device for transferring, onto the intermediate transferring body 70, the yellow developer image formed on the photoconductor 20Y. When developer of four colors are successively transferred in a superposed manner by the respective first transferring units 60Y, 60M, 60C, and 60K, a full-color developer image is formed on the intermediate transferring body 70.

The intermediate transferring body 70 is an endless belt that is wound around a plurality of supporting rollers, and is driven to rotate in the direction shown by the arrow in FIG. 1 while abutting against the photoconductors 20Y, 2OM, 20C, and 20K.

The second transferring unit 80 is a device for transferring the single-color developer image, or the full-color developer image, formed on the intermediate transferring body 70 onto a medium such as paper, film, and cloth.

The fusing unit, which is not shown, is a device for fusing the single-color developer image or the full-color developer image, which has been transferred to the medium, onto the medium such as paper to make it into a permanent image.

The static eliminating unit 73Y is a device for eliminating the electric charge remaining on the photoconductor 20Y after the developer image has been transferred onto the intermediate transferring body 70 by the first transferring unit 60Y.

The photoconductor cleaning unit 75Y is a device that has a photoconductor cleaning blade 76Y made of rubber and made to abut against the surface of the photoconductor 20Y, and that is for removing the developer remaining on the photoconductor 20Y by scraping it off with the photoconductor cleaning blade 76Y after the developer image has been transferred onto the intermediate transferring body 70 by the first transferring unit 60Y.

Figure 2:
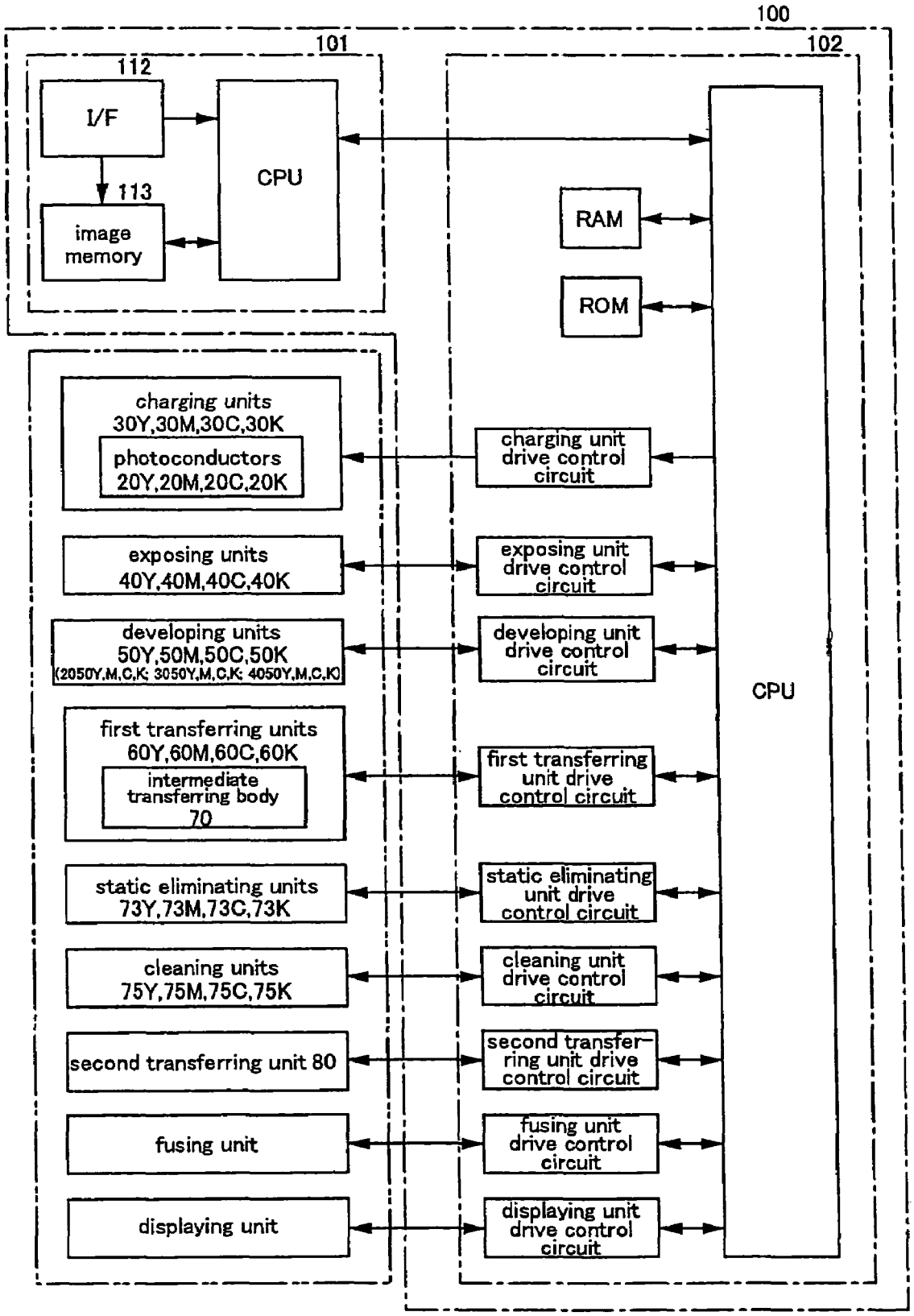
FIG. 2 is a block diagram showing a control unit of the image forming apparatus of FIG. 1.

The control unit 100 includes a main controller 101 and a unit controller 102 as shown in FIG. 2. Image signals and control signals are input to the main controller 101, and according to instructions based on these image signals and control signals, the unit controller 102 controls each of the above-mentioned units etc. to form an image.

<Operation of Image Forming Apparatus>

Next, operations of the printer 10, which is structured as above, is described below giving consideration to other structural components as well.

When image signals and control signals are input from the not-shown host computer to the main controller 101 of the printer 10 through the interface (I/F) 112, then the photoconductors 20Y, 20M, 20C, and 20K, the developing rollers (described further below) provided in the respective developing units 50Y, 50M, 50C, and 50K (2050Y,M,C,K in the second embodiment; 3050Y,M,C,K in the third embodiment; 4050Y,M,C,K in the fourth embodiment), and the intermediate transferring body 70 rotate under the control of the unit controller 102 according to the instructions from the main controller 101. While being rotated, the photoconductors 20Y, 20M, 20C, and 20K are successively charged, respectively, by the charging units 30Y, 30M, 30C, and 30K at respective charging positions.

With the rotation of the photoconductors 20Y, 20M, 20C, and 20K, the charged area of each of the photoconductors 20Y, 20M, 20C, and 20K reaches an exposing position. A latent image that corresponds to the image information for yellow Y, magenta M, cyan C, and black K is formed, respectively, in the charged area of the respective photoconductors by the respective exposing units 40Y, 40M, 40C, and 40K.

With the rotation of the photoconductors 20Y, 20M, 20C, and 20K, the latent image formed on the respective photoconductors 20Y, 20M, 20C, and 20K reaches the developing position, and is developed, respectively, by the respective developing units 50Y, 50M, 50C, and 50K (2050Y,M,C,K in the second embodiment; 3050Y,M,C,K in the third embodiment; 4050Y,M,C,K in the fourth embodiment). Thus, a developer image is formed on each of the photoconductors 20Y, 20M, 20C, and 20K.

With the rotation of the photoconductors 20Y, 20M, 20C, and 20K, the developer images formed on the respective photoconductors 20Y, 20M, 20C, and 20K reach their respective first transferring positions, and are transferred onto the intermediate transferring body 70 by the respective first transferring units 60Y, 60M, 60C, and 60K. At this time, a first transferring voltage, which is in an opposite polarity to the polarity to which the developer is charged, is applied to the first transferring units 60Y, 60M, 60C, and 60K. As a result, the developer images in four colors formed respectively on each photoconductor 20Y, 20M, 20C, and 20K are transferred onto the intermediate transferring body 70 in a superposed manner, thereby forming a full-color developer image on the intermediate transferring body 70.

With the rotation of the intermediate transferring body 70, the full-color developer image formed on the intermediate transferring body 70 reaches a second transferring position, and is transferred onto a medium by the second transferring unit 80. It should be noted that the medium is carried from a paper supply tray, which is not shown in the figure, to the second transferring unit 80 by means of various rollers. (The arrow in FIG. 1 indicates the direction in which the medium is carried.) During transferring operations, a second transferring voltage is applied to the second transferring unit 80 and also the unit 80 is pressed against the intermediate transferring body 70.

The full-color developer image transferred onto the medium is heated and pressurized by the fusing unit and fused to the medium.

On the other hand, after the photoconductors 20Y, 20M, 20C, and 20K have passed their respective first transferring positions, the electric charge is eliminated by the respective static eliminating units 73Y, 73M, 73C, and 73K, and the developer adhering to the surface of each photoconductor 20Y, 20M, 20C, and 20K is scraped of f by the respective photoconductor cleaning blades 76Y, 76M, 76C, and 76K that are supported on the respective photoconductor cleaning units 75Y, 75M, 75C, and 75K. In this way, the photoconductor 20 is prepared for charging for the next latent image to be formed. The scraped-off developer is collected in a remaining-developer collector of the respective photoconductor cleaning units 75Y, 75M, 75C, and 75K.

EMBODIMENT OF CONTROL UNIT

Next, with reference to FIG. 2, the configuration of the control unit 100 is described. The main controller 101 of the control unit 100 is connected to a host computer via an interface 112, and has an image memory 113 for storing image signals that have been input from the host computer.

The unit controller 102 is electrically connected to each of the units in the main apparatus body (that is, to the charging units 30Y, 30M, 30C, and 30K, the exposing units 40Y, 40M, 40C, and 40K, the developing units 50Y, 50M, 50C, and 50K (2050Y,M,C,K in the second embodiment; 3050Y, M,C,K in the third embodiment; 4050Y,M,C,K in the fourth embodiment), the first transferring units 60Y, 60M, 60C, and 60K, the static eliminating units 73Y, 73M, 73C, and 73K, the photoconductor cleaning units 75Y, 75M, 75C, and 75K, the second transferring unit 80, the fusing unit, and the displaying unit). The unit controller 102 controls each of these units according to signals received from the main controller 101 while detecting the state of each of these units by receiving signals from sensors provided in each unit.

FIRST EMBODIMENT OF THE DEVELOPING UNIT ETC

Configuration Example of Developing Unit

Figure 7:
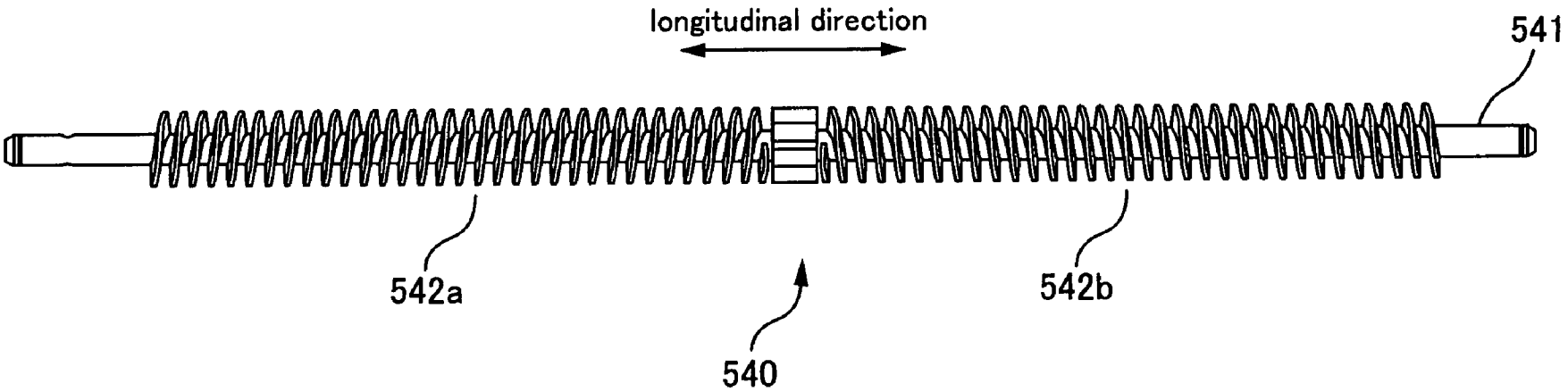
FIG. 7 is a diagram showing the shape of a developer drawing roller 540.

Next, with reference to the drawings, an example of a configuration of a developing unit according to the first embodiment is described below. FIG. 3 is a section view showing main structural components of a developing unit. FIG. 4 is a section view showing quadrants in which the main structural components of the developing unit are arranged. FIG. 5 is a perspective view conceptually showing the surface of an application roller 550. FIG. 6A is a section view showing a groove 550*a* having a trapezoidal cross section. FIG. 6B is a section view showing a groove 550*a* having a cross section in the shape of an inverted delta. FIG. 6C is a section view showing a groove 550*a* having a semicircular cross section. FIG. 7 is a diagram showing the shape of a developer drawing roller 540.

It should be noted that in FIG. 3 and FIG. 4, the arrow indicates the vertical direction as in FIG. 1, and, for example, the developing roller 510 is positioned above the developer drawing roller 540. Further, in FIG. 4, the Y-axis serves as an example of a first coordinate axis that passes the center of the application roller 550 and that extends in the vertically upward direction, and the X-axis serves as an example of a second coordinate axis that passes the center of the application roller 550 and that extends from left to right of the Y-axis. Further, in FIG. 4, "I", "II", "III", and "IV" indicate the first quadrant, the second quadrant, the third quadrant, and the fourth quadrant, respectively.

The printer 10 has, as developing units, a black developing unit 50K containing black (K) developer, a magenta developing unit 50M containing magenta (M) developer, a cyan developing unit 50C containing cyan (C) developer, and a yellow developing unit 50Y containing yellow (Y) developer. Since the structure of each developing unit is substantially the same, only the yellow developing unit 50Y is described in detail below.

The yellow developing unit 50Y has a developing roller 510, a developer containing section 530, a developer drawing roller 540 serving as an example of a supplying roller, an application roller 550 serving as an example of a developer retaining roller, a restriction blade 560 serving as an example of an amount-restricting member, and a developing-roller cleaning unit 570. As shown in FIG. 4, the developer drawing roller 540 and the restriction blade 560 are positioned on the left of the Y-axis. More specifically, the developer drawing roller 540 is positioned in the third quadrant, and the restriction blade 560 is positioned in the second quadrant. On the other hand, the developing roller 510 is positioned above the X-axis.

The developer containing section 530 contains developer D which is for developing a latent image formed on the photoconductor 20Y. The type of developer D contained in the developer containing section 530 is a high-concentration, high-viscosity, non-volatile liquid developer D that is non-volatile at room temperature, and is not the general, conventional volatile liquid developer which employs Isopar (trademark: Exxon Mobil Corporation) as a carrier, has low concentration (approximately 1 to 2 wt %) and low viscosity, and is volatile at room temperature. More specifically, the liquid developer D according to the present embodiment has a high viscosity (approximately 100 to 10000 mPa.s) and is made by dispersing, at a high concentration (approximately 5 to 40 wt %), toner particles having an average particle size of approximately 0.1 to 5 μm and being made, for example, of resin or pigment into a non-volatile, insulating carrier liquid such as silicone oil.

The developer drawing roller 540 draws up the developer D, which is contained in the developer containing section 530, and supplies it to the application roller 550. The lower section of the developer drawing roller 540 is immersed in the developer D contained in the developer containing section 530. The developer drawing roller 540 is separated from the application roller 550 at a distance of approximately 1 mm. That is, the developer drawing roller 540 supplies the developer D to the application roller 550 without abutting against the application roller 550.

The developer drawing roller 540 is rotatable about its central axis. The central axis of the roller 540 is below the central axis of rotation of the application roller 550. Further, the developer drawing roller 540 rotates in the same direction (clockwise in FIG. 4) as the rotating direction of the application roller 550 (the direction in which the roller moves from the third quadrant III toward the second quadrant II; that is, clockwise in FIG. 4). It should be noted that the developer drawing roller 540 not only has the function of drawing up the developer D contained in the developer containing section 530 and supplying it to the application roller 550, but also has the function of stirring the developer D in order to maintain the developer D in a suitable state.

Further, as shown in FIG. 7, the developer drawing roller 540 has two screws 542*a* and 542*b*, whose twisting directions are different from each other, provided on a roller shaft 541. These screws 542*a* and 542*b* allow the two functions of the developer drawing roller 540 described above to be achieved more effectively.

Further, as shown in FIG. 4, the upper edge 540T of the developer drawing roller 540 is located above the lower edge 550U of the application roller in the vertical direction. With such an arrangement, the developer drawing roller 540 supplies the developer D to the application roller 550 downwards from above, as shown by the arrow in FIG. 4. In this way, it is possible to exchange the developer D retained in the grooves 550*a* when the developer drawing roller 540 supplies the developer D to the application roller 550.

The application roller 550 applies the developer D, which has been supplied from the developer containing section 530 by the developer drawing roller 540, to the developing roller 510. The application roller 550 is made by providing helical grooves 550*a* in the surface of a roller made of metal such as iron as shown in FIG. 5, and providing a nickel plating thereon. The diameter of the application roller 550 is approximately 25 mm. A plurality of these helical grooves 550*a* are provided at predetermined intervals in the surface of the application roller 550. The application roller 550 of the present embodiment has, as the grooves, the grooves 550*a* which have a trapezoidal cross section as shown in FIG. 6A. It is instead possible, for example, to provide grooves having a cross section in the shape of an inverted delta as shown in FIG. 6B, or grooves having a semicircular cross section as shown in FIG. 6C. It should be noted that the size of the grooves of the application roller 550 of the present embodiment is as shown in FIG. 6A: the groove pitch is approximately 170 μm, the width of the crest is approximately 45 μm, the width of the trough is approximately 30 μm, and the depth of the groove is approximately 50 μm.

Further, the application roller 550 is pressed in contact with the developing roller 510 in order to appropriately apply the developer D on the application roller 550 to the developing roller 510. The application roller 550 is rotatable about its central axis, and the central axis thereof is below the central axis of rotation of the developing roller 510. Further, the rotating direction of the application roller 550 (clockwise in FIG. 4) is opposite from the rotating direction of the developing roller 510 (counterclockwise in FIG. 4).

The restriction blade 560 abuts against the surface of the application roller 550 to restrict the amount of developer D retained in the grooves 550*a*. More specifically, the restriction blade 560 serves as to scrape off any excessive developer D retained in the grooves 550*a* to measure the developer D in the grooves 550*a*, which is to be applied to the developing roller 510. It should be noted that, other than the developer D retained in the grooves 550*a*, the restriction blade 560 also restricts the developer D adhering to the surface of the application roller 550. The restriction blade 560 has a rubber section 560*a* that abuts against the application roller 550 and a rubber-supporting section 560b that supports the rubber section 560*a*. The rubber section 560*a* is made of urethane rubber, and its rubber hardness is approximately 62 degrees in JIS (Japanese Industrial Standards) A scale. The rubber-supporting section 560*b* is a plate made of metal such as iron.

The restriction blade 560 is placed in contact with the application roller 550 at the edge of the rubber section 560*a*, and thus, carries out a so-called "edge restriction". Further, as shown in FIG. 3, the restriction blade 560 is arranged such that its tip end faces toward the downstream side of the rotating direction of the application roller 550, and thus, carries out a so-called "trailing restriction". As shown in FIG. 3, in the present embodiment, the "trailing angle" at which the restriction blade 560 trails is approximately 10 degrees. Further, the "abutting position" where the restriction blade 560 abuts against the surface of the application roller 550 is above the position of the liquid level of the developer D, as shown in FIG. 4.

The developing roller 510 bears the developer D and carries it to a developing position, which is in opposition to the photoconductor 20Y, in order to develop a latent image bore by the photoconductor 20Y with the developer D. The developing roller 510 has a layer of an elastic body, which has conductivity, on the outer circumferential section of its inner core made of metal such as iron. The diameter of the developing roller 510 is approximately 20 mm. The layer of the elastic body has a two-layer structure: urethane rubber with a thickness of approximately 5 mm and a rubber hardness of approximately 30 degrees in JIS-A is provided as the inner layer; and urethane rubber with a thickness of approximately 30 μm and a rubber hardness of approximately 85 degrees in JIS-A is provided as the surface layer(outer layer). The developing roller 510 is pressed in contact with the application roller 550 and the photoconductor 20Y in an elastically-deformed state.

The developing roller 510 is rotatable about its central axis, and the central axis thereof is below the central axis of rotation of the photoconductor 20Y. Further, the developing roller 510 rotates in the direction (counterclockwise in FIG. 3) opposite from the rotating direction of the photoconductor 20Y (clockwise in FIG. 3). It should be noted that an electric field is generated between the developing roller 510 and the photoconductor 20Y when the latent image formed on the photoconductor 20Y is being developed.

The developing-roller cleaning unit 570 is a device that has a developing-roller cleaning blade 571, which is made of rubber and which is made to abut against the surface of the developing roller 510, and is for scraping off and removing the developer D remaining on the developing roller 510 with the developing-roller cleaning blade 571 after development has been carried out at the developing position.

Although it is also possible to provide a cleaning member for cleaning the developer D retained in the grooves 550*a*, no such cleaning member is provided in the present embodiment. This is because it is possible to exchange the developer D retained in the grooves 550*a* when the developer drawing roller 540 supplies the developer D to the application roller 550.

In the yellow developing unit 50Y structured as above, the developer drawing roller 540 rotates about its central axis to draw up the developer D contained in the developer containing section 530 and to supply it to the application roller 550.

With the rotation of the application roller 550, the developer D that has been supplied to the application roller 550 reaches an abutting position where the restriction blade 560 abuts against the roller 550. As the developer D on the roller 550 passes the abutting position, an excessive portion of the developer D is scraped off by the restriction blade 560, and thus, the amount of developer D to be applied to the developing roller 510 is measured. That is, since the application roller 550 is provided with the grooves 550*a* as described above, the restriction blade 560, which abuts against the application roller 550, scrapes off the developer D on the application roller 550 except for the developer D in the grooves 550*a*. The dimension of the grooves 550*a* is determined in advance such that the amount of developer D to be applied to the developing roller 510 becomes appropriate, so that when the restriction blade 560 scrapes off the developer D on the application roller 550, an appropriate amount of developer D, which has been suitably measured by means of the grooves 550*a*, will remain in the grooves 550*a*.

With further rotation of the application roller 550, the developer D remaining in the grooves 550*a* of the application roller 550 reaches a press-contact position where the roller 550 is pressed in contact with the developing roller 510, and at this press-contact position, the developer D is applied by the application roller 550 to the developing roller 510. Upon application, the developer D in the grooves 550*a* is spread by the action of a pressure that is created as a result of the application roller 550 and the developing roller 510 being pressed in contact with each other, thereby forming an even, thin layer of developer D on the developing roller 510.

The thin layer of developer D formed on the developing roller 510 in this way is carried by the rotation of the developing roller 510 and arrives at the developing position in opposition to the photoconductor 20Y (i.e., a press-contact position where the roller 510 abuts against the photoconductor 20Y). Then the developer D is used at the developing position for developing the latent image formed on the photoconductor 20 under an electric field of a predetermined intensity. With further rotation of the developing roller 510, the developer D on the developing roller 510 that has passed the developing position reaches an abutting position where the developing-roller cleaning blade 571 abuts against the roller 510. When passing the abutting position, the developer D adhering to the surface of the developing roller. 510 is scraped off by the developing-roller cleaning blade 571, and the scraped-off developer D is collected in a remaining-developer collector of the developing-roller cleaning unit 570.

Cause of Fixing of the Developer D in the Grooves 550*a*

Figure 8A:
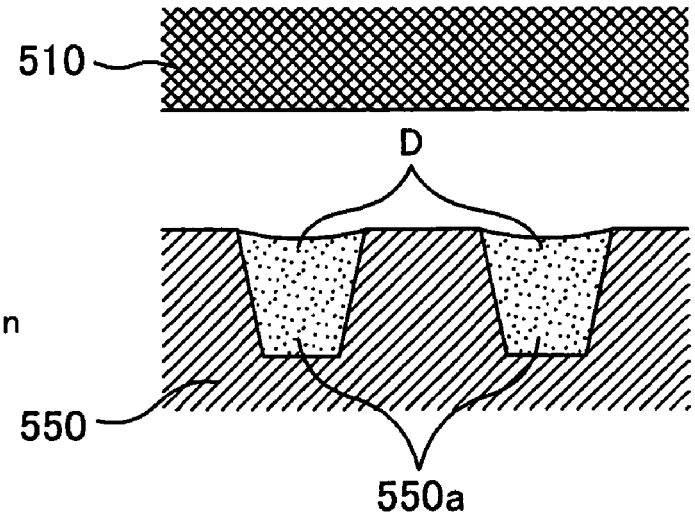
FIG. 8A is a conceptual diagram showing a state before the developer D, which is retained in the grooves 550*a*, is applied to the developing roller 510.
Figure 8B:
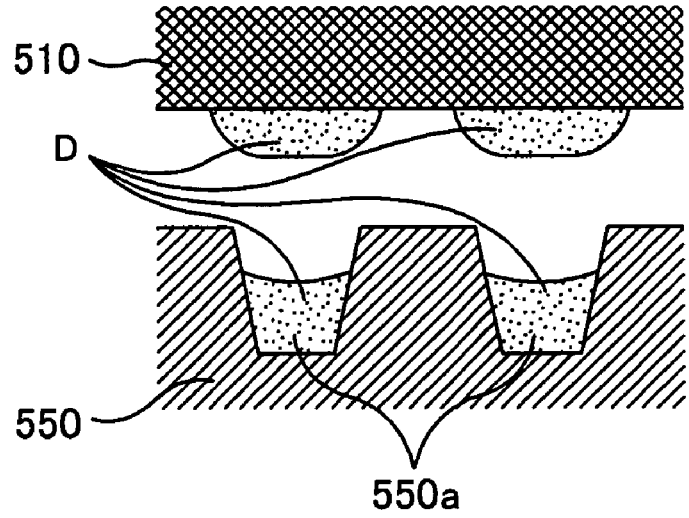
FIG. 8B is a conceptual diagram showing a state in which the developer D retained in the grooves 550*a* has been applied to the developing roller 510.
Figure 8C:
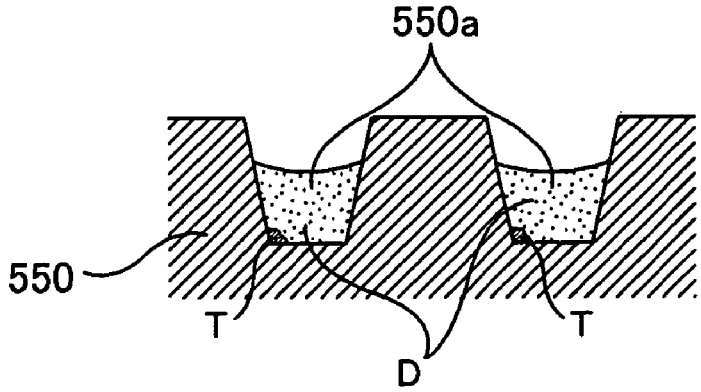
FIG. 8C is a conceptual diagram showing a state in which an aggregate T of toner particles has fixed to the grooves 550*a;*

As described in the section of the "Description of the Related Art", there are cases in which the developer D supplied from the developer drawing roller 540 to the application roller 550 gets fixed in the grooves 550*a* of the application roller 550. An example of the cause of the developer D getting fixed in the grooves 550*a* is described below. FIG. 8A is a conceptual diagram showing a state before the developer D, which is retained in the grooves 550*a*, is applied to the developing roller 510. FIG. 8B is a conceptual diagram showing a state in which the developer D retained in the grooves 550*a* has been applied to the developing roller 510. FIG. 8C is a conceptual diagram showing a state in which an aggregate T of toner particles has fixed to the grooves 550*a*.

As described above, the developer D on the application roller 550 that has reached the abutting position of the restriction blade 560 is scraped off, except for the developer D retained in the grooves 550*a*, at the abutting position, and the remaining developer D retained in the grooves 550*a* is carried to the press-contact position of the developing roller 510 and is applied to the developing roller 510.

FIG. 8A shows the state of the developer D, which is retained in the grooves 550*a* and whose amount has been restricted by the restriction blade 560, before being applied to the developing roller 510. It should be noted that the amount of developer that is retained in the grooves 550*a* before being applied to the developing roller 510 is smaller than the volumetric capacity of the grooves 550*a* retaining the developer D.

The developer D, which is retained in the grooves 550*a*, is applied to the developing roller 510 as shown in FIG. 8B. Among all of the developer D retained in a groove 550*a*, the developer D in the upper portion of the groove 550*a* is applied to the developing roller 510. On the contrary, the developer D in the bottom portion of the groove 550*a* is not applied to the developing roller 510 and is still retained in the groove 550*a*.

This developer D, which is not applied to the developing roller 510 and is still retained in the grooves 550*a*, gets fixed to the grooves 550*a* in some cases. More specifically, in some cases, the aggregate T of the powdered toner particles dispersed in the developer D gets fixed at the bottom portion of the grooves 550*a* as shown in FIG. 8C.

Effect of Preventing Fixing of Developer in the Grooves 550*a* According to the Present Embodiment In view of the above, in the printer 10 according to the present embodiment, the upper edge 540T of the developer drawing roller is located above the lower edge 550U of the application roller (as shown in FIG. 4), and the developer drawing roller 540 supplies the developer D to the application roller 550 downwards from above. In this way, it is possible to keep the developer D in the grooves 550*a* of the application roller 550 from getting fixed. This is described in detail below with reference to the drawings.

Figure 9:
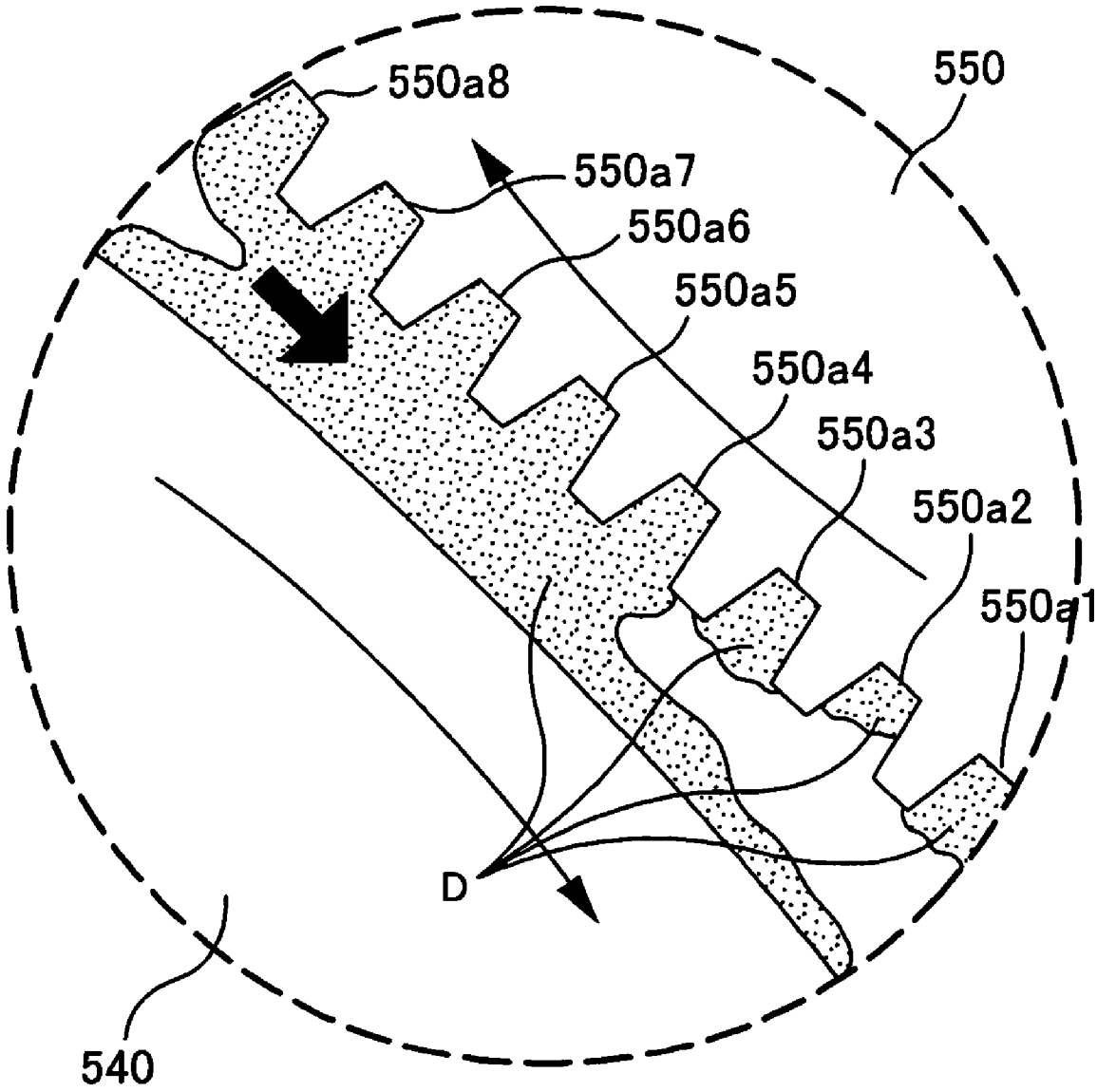
FIG. 9 is a-conceptual diagram showing in enlargement a section P (see FIG. 4) where the developer drawing roller 540 supplies the developer D to the application roller 550.

FIG. 9 is a conceptual diagram showing in enlargement a section P (see FIG. 4) where the developer drawing roller 540 supplies the developer D to the application roller 550. Here, the multitude of grooves 550*a* provided in the surface of the application roller 550 is expressed, for example, as groove 550*a*1, groove 550*a*2, groove 550*a*3, and so forth. The grooves 550*a*1, 550*a*2, and 550*a*3 in FIG. 9 are grooves before retaining the developer D supplied by the developer drawing roller 540. On the other hand, the grooves 550*a*4 through 550*a*8 are grooves that retain the developer D supplied by the developer drawing roller 540.

As described above, the developer drawing roller 540 supplies the developer D to the application roller 550 (more specifically, into the grooves 550*a*) downwards from above as shown in FIG. 9. The developer D supplied by the developer drawing roller 540 is subjected to gravity. When the developer D, which is subjected to gravity, is supplied into the grooves 550*a* by the developer drawing roller 540, the developer D is exchanged with the developer D retained in the grooves 550*a* (for example, the grooves 550*a*1 through 550*a*3). The developer D that has been exchanged is then retained by the other grooves 550*a* (for example, the grooves 550*a*4 through 550*a*8). Therefore, the developer D that has been exchanged will be retained in the grooves 550*a*, without the aggregate T of toner particles getting fixed in the bottom portion of the grooves 550*a* as described above.

In the above, description was made with regard to grooves 550*a*1 through 550*a*8 among the plurality of grooves 550*a* provided in the surface of the application roller 550, but the same actions occur with respect to the other grooves 550*a* as well.

Therefore, by arranging the upper edge 540T of the developer drawing roller above the lower edge 550U of the application roller (as shown in FIG. 4) and making the developer drawing roller 540 supply the developer D to the application roller 550 downwards from above, it becomes possible to prevent the above-described problem, that is, the problem that the developer D gets fixed in the grooves 550*a* of the application roller 550, from arising, because in this way, the developer D retained in the grooves 550*a* is exchanged when the developer drawing roller 540 supplies the developer D into the grooves 550*a*.

Other considerations

The first embodiment of the present invention relates to a liquid development device (for example, the developing units 50Y, 50M, 50C, and 50K) comprising: a developer retaining roller (for example, the application roller 550) having recesses (for example, the grooves 550*a*) provided in the surface of the roller, the recesses being provided for retaining liquid developer (for example, the developer D); and a supplying roller (for example, the developer drawing roller 540) for supplying the liquid developer to the developer retaining roller.

In the foregoing embodiment, the restriction blade 560 was arranged such that its tip end faced toward the downstream side of the rotating direction of the application roller 550, and thus, carried out a so-called "trailing restriction". This, however, is not a limitation.

Figure 10:
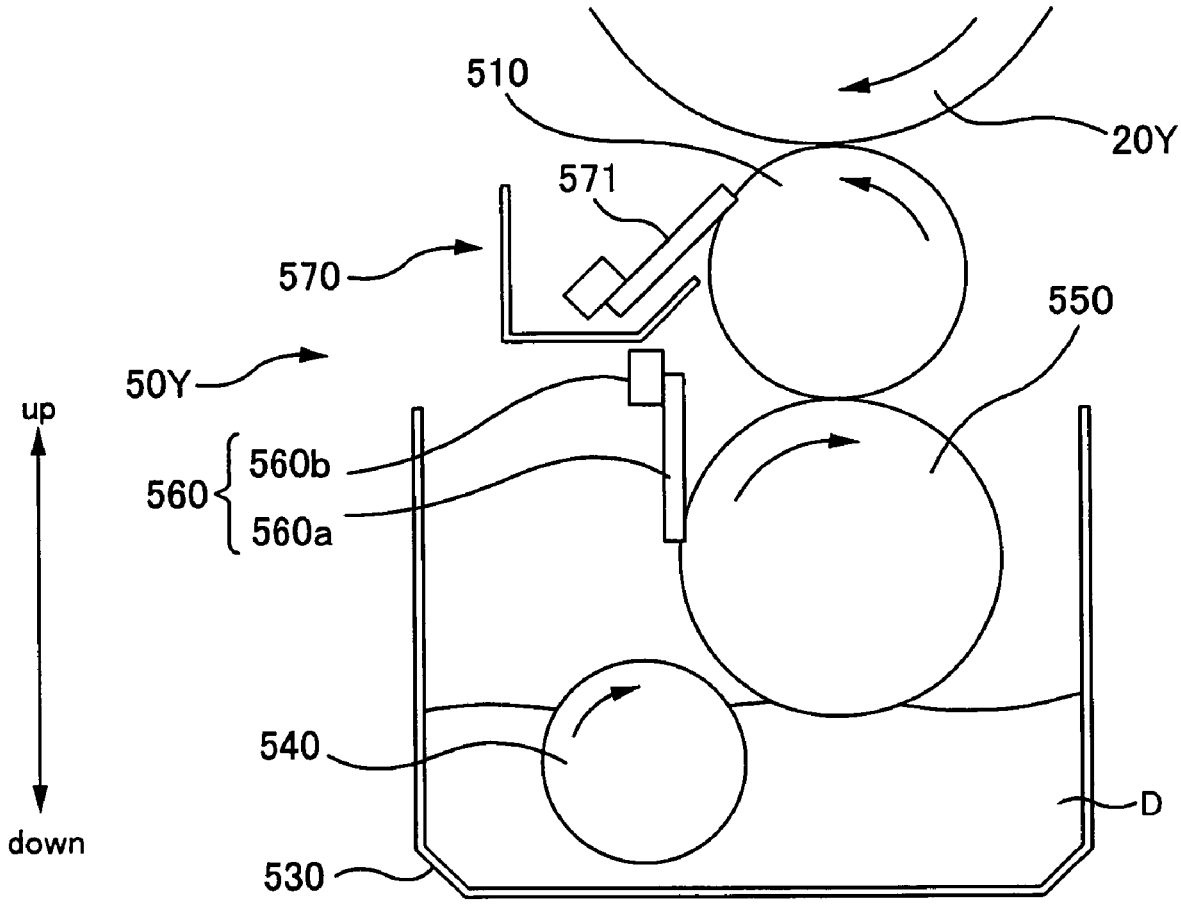
FIG. 10 is a section view showing an example of main structural components of a developing unit.

For example, as shown in FIG. 10, the restriction blade 560 may be arranged such that its tip end faces toward the upstream side of the rotating direction of the application roller 550, thus carrying out a so-called "counter restriction".

Further, in the foregoing embodiment, the developer drawing roller 540 was described as having two screws 542*a* and 542*b*, whose twisting directions are different from each other, provided on a roller shaft 541, as shown in FIG. 7. This, however, is not a limitation.

For example, a single screw may be provided on the roller shaft 541.

Further, in the foregoing embodiment, the application roller 550 was described as rotating in the opposite direction (clockwise in FIG. 3) from the rotating direction of the developing roller 510 (counterclockwise in FIG. 3). This, however, is not a limitation.

Figure 11:
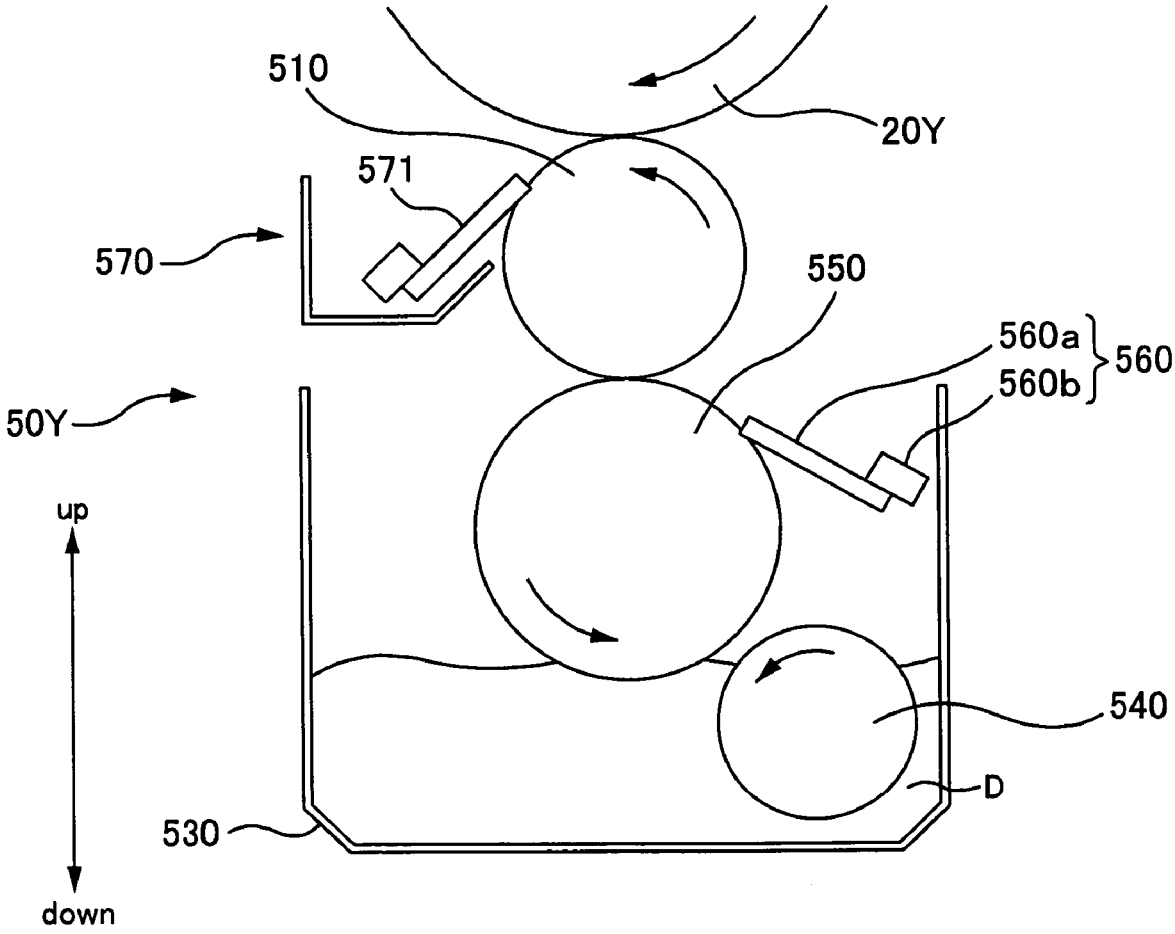
FIG. 11 is a section view showing another example of main structural components of a developing unit.

For example, as shown in FIG. 11, the application roller 550 may rotate in the same direction (counterclockwise in FIG. 11) as the rotating direction of the developing roller 510 (counterclockwise in FIG. 3 and FIG. 11). In this case, the arrangement of the developer drawing roller 540 and the restriction blade 560 shown in FIG. 11 will be different from the arrangement of the developer drawing roller 540 and the restriction blade 560 shown in FIG. 3. It should be noted that FIG. 11 is a section view showing an example of main structural components of a developing unit.

Further, in the foregoing embodiment, among four quadrants formed by a first coordinate axis (for example, the Y-axis) that passes the center of the application roller 550 and that extends in the vertically upward direction and a second coordinate axis (for example, the X-axis) that passes the center of the application roller 550 and that extends from left to right of the Y-axis, the rotating direction of the application roller 550 was in a direction in which the application roller 550 moves from the third quadrant toward the second quadrant (i.e., clockwise in FIG. 4); the rotating direction of the developer drawing roller 540 was in the same direction as the rotating direction of the application roller 550 (i.e., clockwise in FIG. 4); and the developer drawing roller 540 was located on the left side of the Y-axis. This, however, is not a limitation.

For example, as shown in FIG. 12, the rotating direction of the developer drawing roller 540 may be in the opposite direction (counterclockwise in FIG. 12) from the rotating direction of the application roller 550 (clockwise in FIG. 4 and FIG. 12), and the developer drawing roller 540 may be located on the right of the Y-axis. It should be noted that FIG. 12 is a section view showing an example of main structural components of a developing unit.

Further, in the foregoing embodiment, the developing unit further comprised a restriction blade 560 that is for restricting the amount of the developer D retained in the grooves 550*a* and that abuts against the application roller 550; and the developer drawing roller 540 was located in the third quadrant and the restriction blade 560 was located in the second quadrant. This, however, is not a limitation.

For example, the developing unit does not have to be provided with a restriction blade 560 that is for restricting the amount of the developer D retained in the grooves 550*a* and that abuts against the application roller 550.

The foregoing embodiment, however, is more preferable in terms that, when the developing unit has a restriction blade 560 that is for restricting the amount of the developer D retained in the grooves 550*a* and that abuts against the application roller 550, the developer D that is retained in the grooves 550*a* without getting fixed therein can be restricted by the restriction blade 560 to a predetermined amount.

Further, in the foregoing embodiment, an abutting position where the restriction blade 560 abuts against the application roller 550 was located above the position of the liquid surface of the developer D in the vertical direction. This, however, is not a limitation.

For example, the abutting position where the restriction blade 560 abuts against the application roller 550 may be located below the position of the liquid surface of the developer D in the vertical direction.

The foregoing embodiment, however, is more preferable in terms that, when the abutting position where the restriction blade 560 abuts against the application roller 550 is located above the position of the liquid surface of the developer D in the vertical direction, the developer D that is retained in the grooves 550*a* without getting fixed therein can be restricted even certainly by the restriction blade 560 to a predetermined amount.

Further, in the foregoing embodiment, the application roller 550 and the developer drawing roller 540 did not abut against each other. This, however, is not a limitation.

For example, the application roller 550 and the developer drawing roller 540 may abut against each other.

If the application roller 550 and the developer drawing roller 540 are in abutment, then it is possible for the developer drawing roller 540 to scrape off the developer D retained in the grooves 550*a*, and thus, the possibility of preventing the developer D from getting fixed in the grooves 550*a* can be increased. However, in cases where the application roller 550 and the developer drawing roller 540 are not in abutment, the above-mentioned possibility is low. The foregoing embodiment is therefore more preferable in terms that the above-mentioned effect, that is, the effect of being able to prevent the developer D from getting fixed in the grooves 550*a* of the application roller 550, will be achieved more advantageously in cases where the application roller 550 and the developer drawing roller 540 are not in abutment.

Further, in the foregoing embodiment, the developing unit was not provided with a cleaning member for cleaning the developer D retained in the grooves 550*a*. This, however, is not a limitation.

For example, the developing unit may be provided with a cleaning member for cleaning the developer D retained in the grooves 550*a*.

However, in cases where a cleaning member for cleaning the developer D retained in the grooves 550*a* is not provided, the developer D will be retained in the grooves 550*a* without being removed, and thus, the possibility that the developer D gets fixed in the grooves 550*a* rises. The foregoing embodiment is therefore more preferable in terms that the above-mentioned effect, that is, the effect of being able to prevent the developer D from getting fixed in the grooves 550*a* of the application roller 550, will be achieved more advantageously.

Further, in the foregoing embodiment, the recesses were helical grooves 550*a*; and a plurality of the helical grooves 550*a* were provided in the surface of the application roller 550 at predetermined intervals. This, however, is not a limitation.

For example, a plurality of recesses having a shape as shown in FIG. 13A or FIG. 13B may be provided in the surface of the application roller 550. It should be noted that FIG. 13A is a diagram showing an example of a recess provided in the surface of the application roller 550, and FIG. 13B is a diagram showing another example of a recess provided in the surface of the application roller 550.

Further, in the foregoing embodiment, the developer D was non-volatile liquid developer that is non-volatile at room temperature. This, however, is not a limitation.

For example, the developer D may be volatile liquid developer which employs Isopar (trademark: Exxon Mobil Corporation) as a carrier, has low concentration (approximately 1 to 2 wt %) and low viscosity, and is volatile at room temperature.

However, when non-volatile liquid developer is adopted as the developer D, the viscosity of the developer D will be high, and thus the possibility that the developer D gets fixed in the grooves 550*a* rises. The foregoing embodiment is therefore more preferable in terms that the above-mentioned effect, that is, the effect of being able to prevent the developer D from getting fixed in the grooves 550*a* of the application roller 550, is achieved more advantageously.

SECOND EMBODIMENT OF THE DEVELOPING UNIT ETC

Overview of Developing Unit

Figure 14:
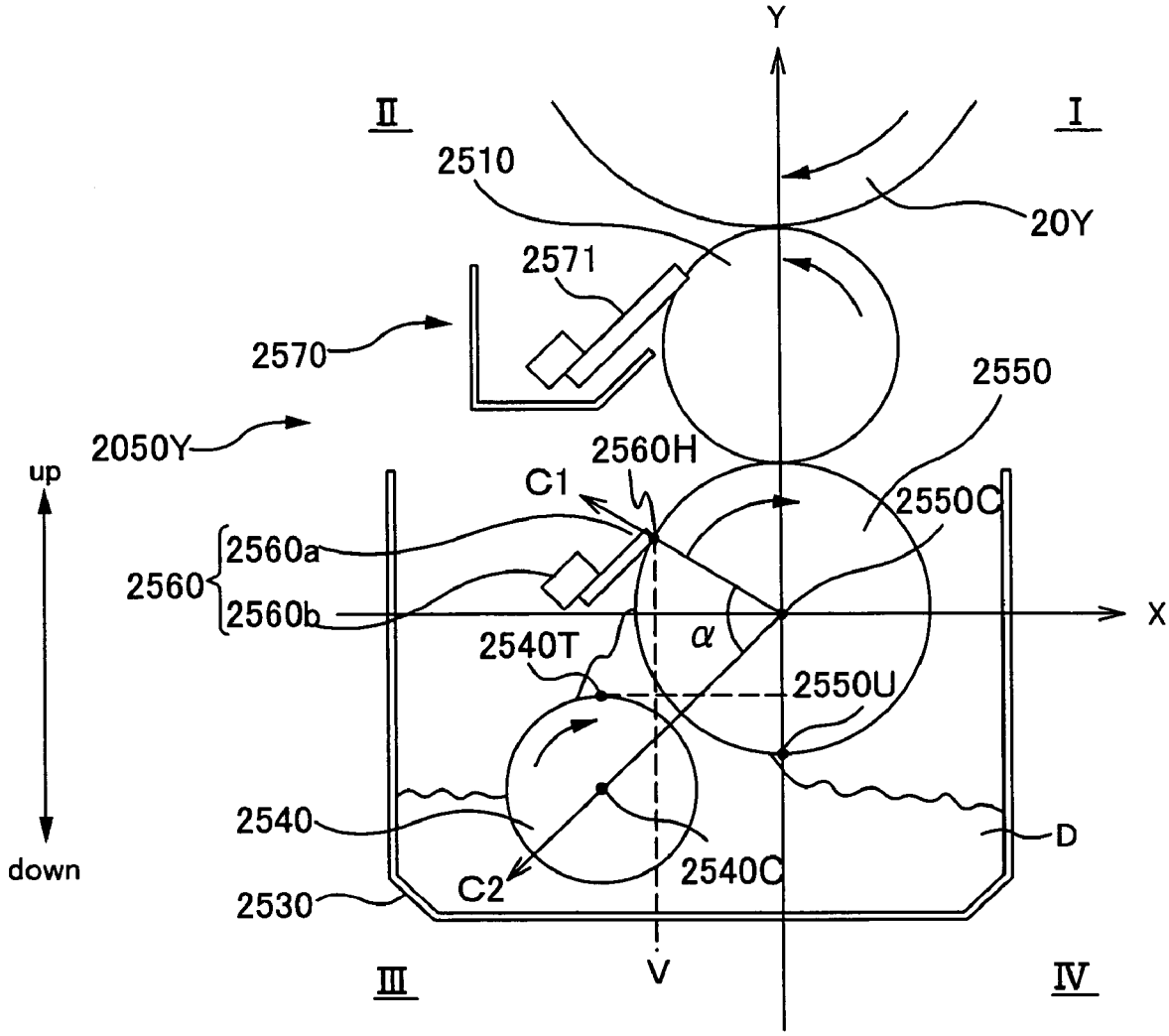
FIG. 14 is a section view showing main structural components of a developing unit according to a second embodiment.
Figure 15:
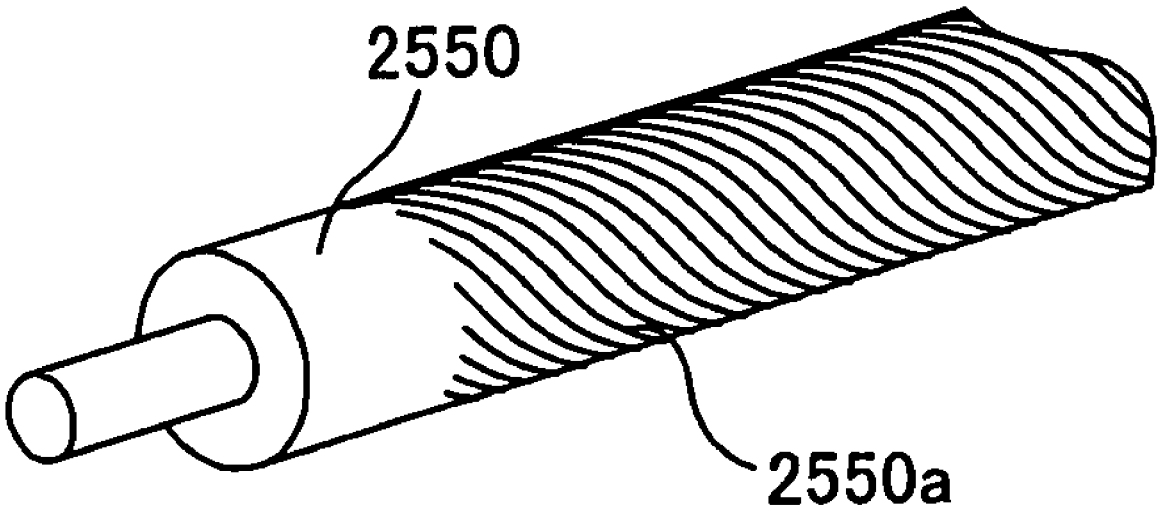
FIG. 15 is a perspective view showing the surface of an application roller 2550.
Figure 16A:
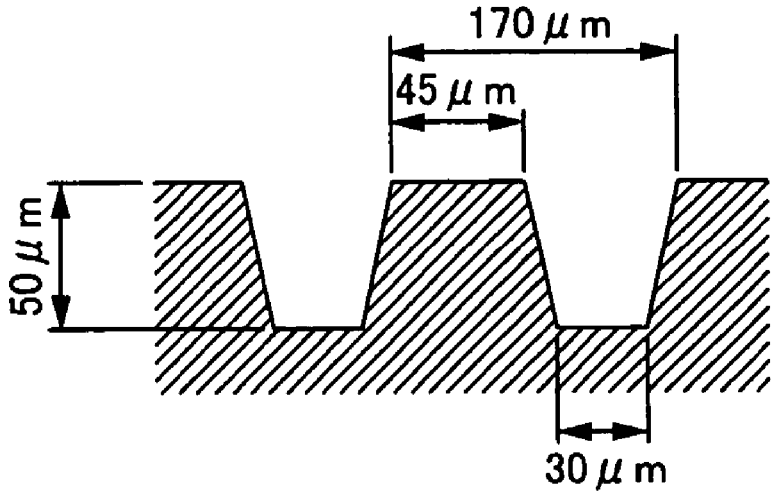
FIG. 16A is a section view showing a groove 2550*a* having a trapezoidal cross section.
Figure 16B:
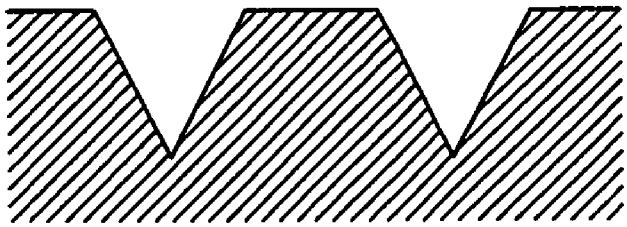
FIG. 16B is a section view showing a groove 2550*a* having a cross section in the shape of an inverted delta.
Figure 16C:
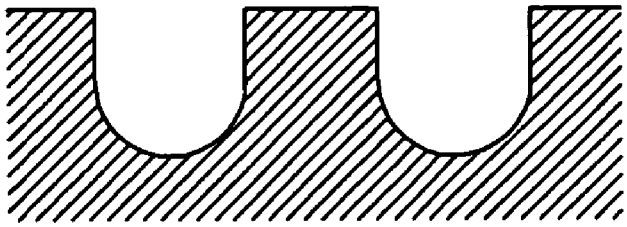
FIG. 16C is a section view showing a groove 2550*a* having a semicircular cross section.
Figure 17:
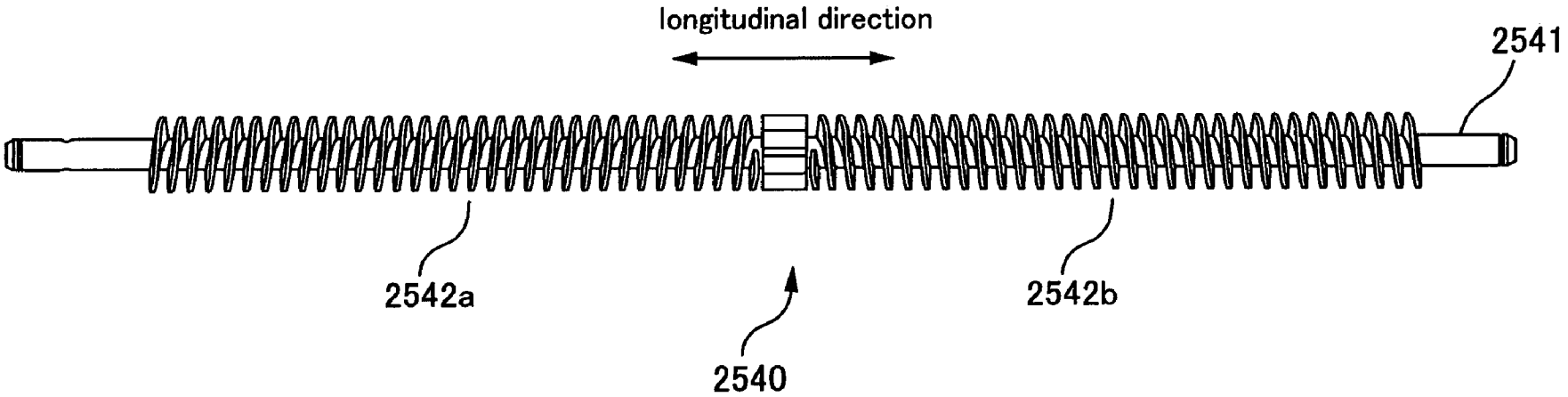
FIG. 17 is a diagram showing the shape of a developer drawing roller 2540.

Next, with reference to the drawings, an overview of a developing unit according to the second embodiment is described below. FIG. 14 is a section view showing main structural components of a developing unit. FIG. 15 is a perspective view conceptually showing the surface of an application roller 2550. FIG. 16A is a section view showing a groove 2550*a* having a trapezoidal cross section. FIG. 16B is a section view showing a groove 2550*a* having a cross section in the shape of an inverted delta. FIG. 16C is a section view showing a groove 2550*a* having a semicircular cross section. FIG. 17 is a diagram showing the shape of a developer drawing roller 2540.

It should be noted that in FIG. 14, the arrow indicates the vertical direction as in FIG. 1, and, for example, the developing roller 2510 is positioned above the developer drawing roller 2540. Further, in FIG. 14, the Y-axis serves as an example of a first coordinate axis that passes the center 2550C of the application roller 2550 and that extends in the vertically upward direction, and the X-axis serves as an example of a second coordinate axis that passes the center 2550C of the application roller 2550 and that extends from left to right of the Y-axis. Further, in FIG. 14, "I", "II", "III", and "IV" indicate the first quadrant, the second quadrant, the third quadrant, and the fourth quadrant, respectively.

<Configuration of Developing Unit>

The printer 10 has, as developing units, a black developing unit 2050K containing black (K) developer, a magenta developing unit 2050M containing magenta (M) developer, a cyan developing unit 2050C containing cyan (C) developer, and a yellow developing unit 2050Y containing yellow (Y) developer. Since the structure of each developing unit is substantially the same, only the yellow developing unit 2050Y is described in detail below.

The yellow developing unit 2050Y has a developing roller 2510 serving as an example of a developer bearing body, a developer containing section 2530, a developer drawing roller 2540 serving as an example of a supplying roller, an application roller 2550 serving as an example of a retaining roller, a restriction blade 2560 serving as an example of an amount-restricting member, and a developing-roller cleaning unit 2570.

The developer containing section 2530 contains developer D which is for developing a latent image formed on the photoconductor 20Y. The type of developer D contained in the developer containing section 2530 is a high-concentration, high-viscosity, non-volatile liquid developer D that is non-volatile at room temperature, and is not the general, conventional volatile liquid developer which employs Isopar (trademark: Exxon Mobil Corporation) as a carrier, has low concentration (approximately 1 to 2 wt %) and low viscosity, and is volatile at room temperature. More specifically, the liquid developer D according to the present embodiment has a high viscosity (approximately 100 to 10000 mPa.s) and is made by dispersing, at a high concentration (approximately 5 to 40 wt %), toner particles having an average particle size of approximately 0.1 to 5 μm and being made, for example, of resin or pigment into a non-volatile, insulating carrier liquid such as silicone oil.

The developer drawing roller 2540 draws up the developer D, which is contained in the developer containing section 2530, and supplies it to the application roller 2550. The lower section of the developer drawing roller 2540 is immersed in the developer D contained in the developer containing section 2530. The developer drawing roller 2540 is separated from the application roller 2550 at a distance of approximately 1 mm. That is, the developer drawing roller 2540 supplies the developer D to the application roller 2550 without abutting against the application roller 2550.

The developer drawing roller 2540 is rotatable about its central axis. The central axis of the roller 2540 is below the central axis of rotation of the application roller 2550. Further, the developer drawing roller 2540 rotates in the same direction (clockwise in FIG. 14) as the rotating direction of the application roller 2550 (the direction in which the roller moves from the third quadrant III toward the second quadrant II; that is, clockwise in FIG. 14). It should be noted that the developer drawing roller 2540 not only has the function of drawing up the developer D contained in the developer containing section 2530 and supplying it to the application roller 2550, but also has the function of stirring the developer D in order to maintain the developer D in a suitable state.

Further, as shown in FIG. 17, the developer drawing roller 2540 has two screws 2542*a* and 2542*b*, whose twisting directions are different from each other, provided on a roller shaft 2541. These screws 2542*a* and 2542*b* allow the two functions of the developer drawing roller 2540 described above to be achieved more effectively.

Further, as shown in FIG. 14, the developer drawing roller 2540 is located in the third quadrant, and the upper edge 2540T of the developer drawing roller 2540 is located above the lower edge 2550U of the application roller in the vertical direction. With such an arrangement, the developer drawing roller 2540 supplies the developer D to the application roller 2550 downwards from above.

The application roller 2550 applies the developer D, which has been supplied from the developer containing section 2530 by the developer drawing roller 2540, to the developing roller 2510. The application roller 2550 is made by providing helical grooves 2550*a* in the surface of a roller made of metal such as iron as shown in FIG. 15, and providing a nickel plating thereon. The diameter of the application roller 2550 is approximately 25 mm. A plurality of these helical grooves 2550*a* are provided at predetermined intervals in the surface of the application roller 2550. The application roller 2550 of the present embodiment has, as the grooves, the grooves 2550*a* which have a trapezoidal cross section as shown in FIG. 16A. It is instead possible, for example, to provide grooves having a cross section in the shape of an inverted delta as shown in FIG. 16B, or grooves having a semicircular cross section as shown in FIG. 16C. It should be noted that the size of the grooves of the application roller 2550 of the present embodiment is as shown in FIG. 16A: the groove pitch is approximately 170 μm, the width of the crest is approximately 45 μm, the width of the trough is approximately 30 μm, and the depth of the groove is approximately 50 μm.

Further, the application roller 2550 is pressed in contact with the developing roller 2510 in order to appropriately apply the developer D on the application roller 2550 to the developing roller 2510. The application roller 2550 is rotatable about its central axis, and the central axis thereof is below the central axis of rotation of the developing roller 2510. Further, the rotating direction of the application roller 2550 (clockwise in FIG. 14) is opposite from the rotating direction of the developing roller 2510 (counterclockwise in FIG. 14).

The restriction blade 2560 abuts against the surface of the application roller 2550 to restrict the amount of developer D retained in the grooves 2550*a*. More specifically, the restriction blade 2560 serves as to scrape off any excessive developer D retained in the grooves 2550*a* to measure the developer D in the grooves 2550*a*, which is to be applied to the developing roller 2510. It should be noted that, other than the developer D retained in the grooves 2550*a*, the restriction blade 2560 also restricts the developer D adhering to the surface of the application roller 2550. The restriction blade 2560 has a rubber section 2560*a* that abuts against the application roller 2550 and a rubber-supporting section 2560*b* that supports the rubber section 2560*a*. The rubber section 2560*a* is made of urethane rubber, and its rubber hardness is approximately 62 degrees in JIS (Japanese Industrial Standards) A scale. The rubber-supporting section 2560*b* is a plate made of metal such as iron.

The restriction blade 2560 is placed in contact with the application roller 2550 at the edge of the rubber section 2560*a*, and thus, carries out a so-called "edge restriction". Further, as shown in FIG. 14, the restriction blade 2560 is arranged such that its tip end faces toward the downstream side of the rotating direction of the application roller 2550, and thus, carries out a so-called "trailing restriction". As shown in FIG. 14, in the present embodiment, the "trailing angle" at which the restriction blade 2560 trails is approximately 10 degrees.

Further, as shown in FIG. 14, the restriction blade 2560 is located in the second quadrant, and an abutting position 2560H of the restriction blade 2560 where the restriction blade 2560 abuts against the surface of the application roller 2550 is above the position of the liquid level of the developer D, as shown in FIG. 14.

Further, as shown in FIG. 14, when the direction from the center 2550C of the application roller to the abutting position 2560H is assumed as the first direction C1, and the direction from the center 2550C of the application roller to the center 2540C of the developer drawing roller is assumed as the second direction C2, the angle $\alpha$ formed between the first direction C1 and the second direction C2 is equal to or smaller than 90°. When the angle $\alpha$ formed between the first direction C1 and the second direction C2 is equal to or smaller than 90°, then the developer drawing roller 2540 and the restriction blade 2560 will be arranged close to each other, and the developer D can easily build up between the developer drawing roller 2540 and the restriction blade 2560 and in the periphery of the application roller 2550.

Further, the abutting position 2560H of the restriction blade is located vertically above the developer drawing roller 2540, and as shown in FIG. 14, a straight line V, which is an example of a vertical line extending vertically downwards from the abutting position 2560H, passes through the developer drawing roller 2540. In this way, the excessive developer D that has been scraped off by the restriction blade 2560 at the abutting position 2560H falls, due to gravity, towards the upper edge of the developer drawing roller 2540, which is located vertically below the abutting position 2560H.

The developing roller 2510 bears the developer D and carries it to a developing position, which is in opposition to the photoconductor 20Y, in order to develop a latent image bore by the photoconductor 20Y with the developer D. The developing roller 2510 has a layer of an elastic body, which has conductivity, on the outer circumferential section of its inner core made of metal such as iron. The diameter of the developing roller 2510 is approximately 20 mm. The layer of the elastic body has a two-layer structure: urethane rubber with a thickness of approximately 5 mm and a rubber hardness of approximately 30 degrees in JIS-A is provided as the inner layer; and urethane rubber with a thickness of approximately 30 μm and a rubber hardness of approximately 85 degrees in JIS-A is provided as the surface layer (outer layer). The developing roller 2510 is pressed in contact with the application roller 2550 and the photoconductor 20Y in an elastically-deformed state.

The developing roller 2510 is rotatable about its central axis, and the central axis thereof is below the central axis of rotation of the photoconductor 20Y. Further, the developing roller 2510 rotates in the direction (counterclockwise in FIG. 14) opposite from the rotating direction of the photoconductor 20Y (clockwise in FIG. 14). It should be noted that an electric field is generated between the developing roller 2510 and the photoconductor 20Y when the latent image formed on the photoconductor 20Y is being developed.

Further, the developing roller 2510 is located downstream of the restriction blade 2560 in the rotating direction of the application roller 2550 (clockwise in FIG. 14), and located vertically above the X-axis.

The developing-roller cleaning unit 2570 is a device that has a developing-roller cleaning blade 2571, which is made of rubber and which is made to abut against the surface of the developing roller 2510, and is for scraping off and removing the developer D remaining on the developing roller 2510 with the developing-roller cleaning blade 2571 after development has been carried out at the developing position.

<Operations of the Developing Unit >

In the yellow developing unit 2050Y structured as above, the developer drawing roller 2540 rotates about its central axis to draw up the developer D contained in the developer containing section 2530 and to supply it to the application roller 2550.

With the rotation of the application roller 2550, the developer D that has been supplied to the application roller 2550 reaches an abutting position 2560H where the restriction blade 2560 abuts against the roller 2550. As the developer D on the roller 2550 passes the abutting position 2560H, an excessive portion of the developer D is scraped of f by the restriction blade 2560, and thus, the amount of developer D to be applied to the developing roller 2510 is measured. That is, since the application roller 2550 is provided with the grooves 2550*a* as described above, the restriction blade 2560, which abuts against the application roller 2550, scrapes off the developer D on the application roller 2550 except for the developer D in the grooves 2550*a*. The dimension of the grooves 2550*a* is determined in advance such that the amount of developer D to be applied to the developing roller 2510 becomes appropriate, so that when the restriction blade 2560 scrapes off the developer D on the application roller 2550, an appropriate amount of developer D, which has been suitably measured by means of the grooves 2550*a*, will remain in the grooves 2550*a*.

With further rotation of the application roller 2550, the developer D remaining in the grooves 2550*a* of the application roller 2550 reaches a press-contact position where the roller 2550 is pressed in contact with the developing roller 2510, and at this press-contact position, the developer D is applied by the application roller 2550 to the developing roller 2510. Upon application, the developer D in the grooves 2550*a* is spread by the action of a pressure that is created as a result of the application roller 2550 and the developing roller 2510 being pressed in contact with each other, thereby forming an even, thin layer of developer D on the developing roller 2510.

The thin layer of developer D formed on the developing roller 2510 in this way is carried by the rotation of the developing roller 2510 and arrives at the developing position in opposition to the photoconductor 20Y (i.e., a press-contact position where the roller 2510 abuts against the photoconductor 20Y). Then the developer D is used at the developing position for developing the latent image formed on the photoconductor 20 under an electric field of a predetermined intensity. With further rotation of the developing roller 2510, the developer D on the developing roller 2510 that has passed the developing position reaches an abutting position where the developing-roller cleaning blade 2571 abuts against the roller 2510. When passing the abutting position, the developer D adhering to the surface of the developing roller 2510 is scraped off by the developing-roller cleaning blade 2571, and the scraped-off developer D is collected in a remaining-developer collector of the developing-roller cleaning unit 2570.

Effect of Preventing a Shortage of Developer from Occurring Locally on the Application Roller As described above, in the printer 10 according to the present embodiment, the developer drawing roller 2540 is located in the third quadrant, the restriction blade 2560 is located in the second quadrant, the rotating direction of the application roller 2550 is in the direction in which the roller 2550 moves from the third quadrant, in which the developer drawing roller 2540 is located, toward the second quadrant, in which the restriction blade 2560 is located, and the rotating direction of the developer drawing roller 2540 is in the same direction as the rotating direction of the application roller 2550. In this way, it is possible to prevent a shortage of the developer D from occurring locally on the application roller 2550.

More specifically, as described in the section of the "Description of the Related Art", there are cases in which a shortage of the developer D occurs locally on the application roller 2550. For example, such a shortage of the developer D may locally occur on the application roller 2550 if the developer D retained in the grooves 2550*a* of the application roller 2550 flows out from the grooves 2550*a* when the application roller 2550 rotates.

In view of the above, in the present embodiment, the developer drawing roller 2540 is located in the third quadrant, the restriction blade 2560 is located in the second quadrant, the rotating direction of the application roller 2550 is in the direction in which the roller 2550 moves from the third quadrant, in which the developer drawing roller 2540 is located, toward the second quadrant, in which the restriction blade 2560 is located, and the rotating direction of the developer drawing roller 2540 is in the same direction as the rotating direction of the application roller 2550.

By positioning the developer drawing roller 2540 in the third quadrant and the restriction blade 2560 in the second quadrant, the developer D that has been scraped off from the application roller 2550 by the restriction blade 2560 falls in a region above the developer drawing roller 2540.

By making the developer drawing roller 2540 rotate in the same direction (clockwise in FIG. 14) as the rotating direction of the application roller 2550 (the direction in which the roller 2550 moves from the third quadrant toward the second quadrant; i.e., clockwise in FIG. 14), the developer D supplied by the developer drawing roller 2540 builds up between the developer drawing roller 2540 and the restriction blade 2560 and in the periphery of the application roller 2550. On the other hand, if the rotating direction of the developer drawing roller 2540 (counterclockwise in FIG. 14) is in the opposite direction from the rotating direction of the application roller 2550 (clockwise in FIG. 14), then a portion of the developer D supplied by the developer drawing roller 2540 will move toward the wall surface of the developer containing section 2530 (i.e., toward the surface of the wall on the left of the developer drawing roller 2540 in FIG. 14). Therefore, in terms of causing the developer D to build up in the periphery of the application roller 2550, it is preferable to make the developer drawing roller 2540 rotate in the same direction (clockwise in FIG. 14) as the rotating direction of the application roller 2550 (clockwise in FIG. 14).

Therefore, according to the printer 10 structured as above, both the developer D supplied by the developer drawing roller 2540 and the developer D scraped off from the application roller 2550 by the restriction blade 2560 will build up between the developer drawing roller 2540 and the restriction blade 2560 and in the periphery of the application roller 2550. Thus, it becomes possible to allow the application roller 2550 to retain an amount of developer D equal to or more than a predetermined amount.

Further, in the printer 10 according to the present embodiment, the upper edge 2540T of the developer drawing roller is located above the lower edge 2550U of the application roller as shown in FIG. 14. In this way, the developer drawing roller 2540 and the restriction blade 2560 are arranged close to each other, and the developer D that has been scraped off from the application roller 2550 by the restriction blade 2560 will fall into the region above the developer drawing roller 2540 more quickly. Further, the amount of developer D supplied by the developer drawing roller 2540 and adhering to the application roller 2550 is larger when the upper edge 2540T of the developer drawing roller is located above the lower edge 2550U of the application roller than when the upper edge 2540T of the developer drawing roller is located below the lower edge 2550U of the application roller.

Therefore, a larger amount of developer D supplied by the developer drawing roller 2540, as well as developer D scraped off from the application roller 2550 by the restriction blade 2560, will build up between the developer drawing roller 2540 and the restriction blade 2560 and in the periphery of the application roller 2550. Therefore, it becomes easier to allow the application roller 2550 to retain an amount of developer D equal to or more than a predetermined amount.

Consequently, it becomes possible to prevent the above-described problem, that is, the problem that a shortage of the developer D may occur locally on the application roller 2550, from arising.

Other Considerations

The second embodiment of the present invention relates to a liquid development device (for example, the printer 10) comprising: a retaining roller (for example, the application roller 2550) having recesses (for example, the grooves 2550*a*) provided in the surface of the roller, the recesses being provided for retaining liquid developer (for example, the developer D); a supplying roller (for example, the developer drawing roller 2540) for supplying the liquid developer to the retaining roller, the upper edge of the supplying roller being located above the lower edge of the retaining roller in the vertical direction; and an amount-restricting member (for example, the restriction blade 2560) for restricting the amount of the liquid developer retained in the recesses.

In the foregoing embodiment, the restriction blade 2560 was arranged such that its tip end faced toward the downstream side of the rotating direction of the application roller 2550, and thus, carried out a so-called "trailing restriction". This, however, is not a limitation.

Figure 18:
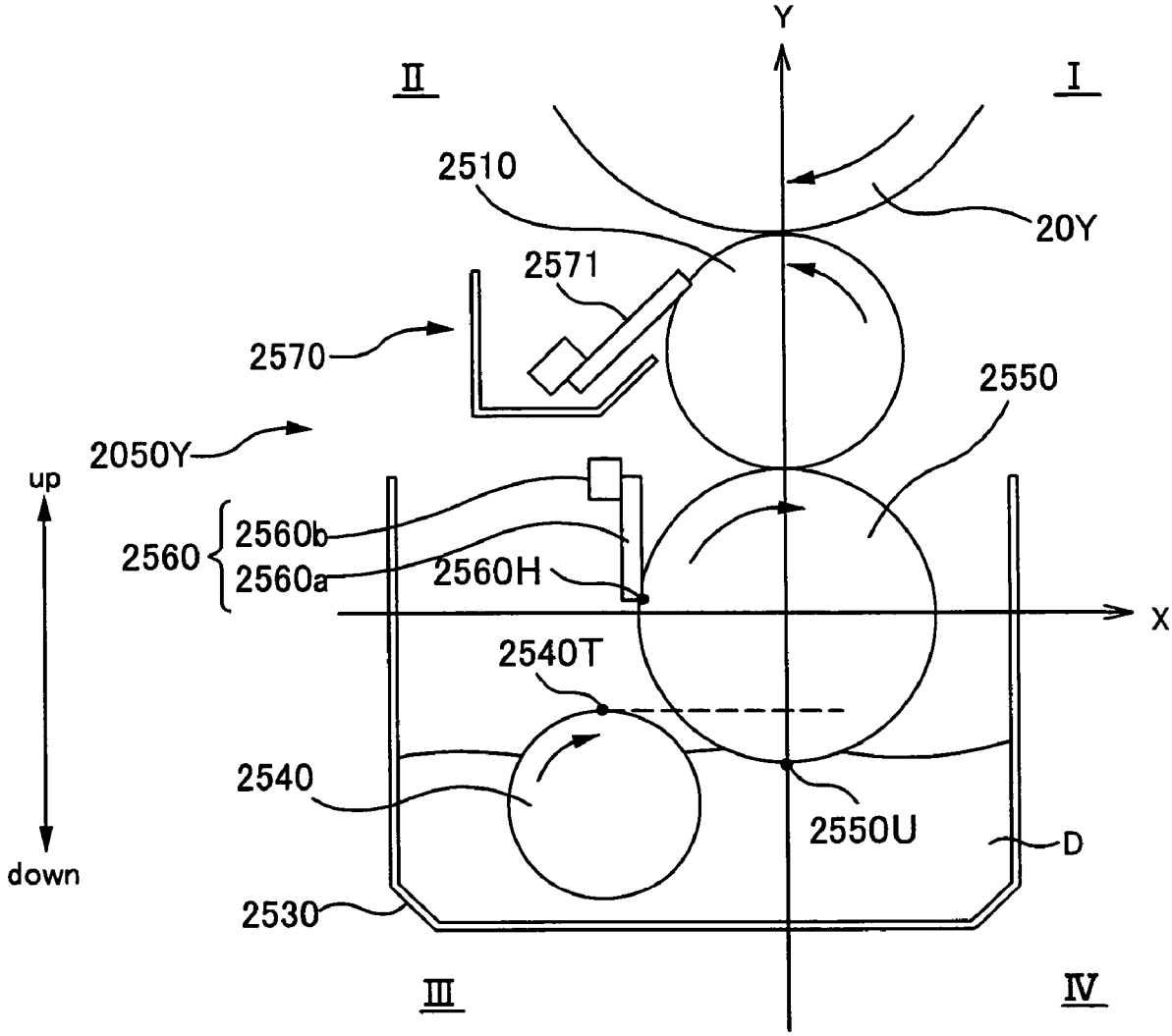
FIG. 18 is a section view showing an example of main structural components of a developing unit.

For example, as shown in FIG. 18, the restriction blade 2560 may be arranged such that its tip end faces toward the upstream side of the rotating direction of the application roller 2550, thus carrying out a so-called "counter restriction".

Further, in the foregoing embodiment, the developer drawing roller 2540 was described as having two screws 2542*a* and 2542*b*, whose twisting directions are different from each other, provided on a roller shaft 2541, as shown in FIG. 17. This, however, is not a limitation.

For example, a single screw may be provided on the roller shaft 2541.

Further, in the foregoing embodiment, the developer drawing roller 2540 was arranged in the third quadrant and the restriction blade 2560 was arranged in the second quadrant. This, however, is not a limitation.

Figure 19:
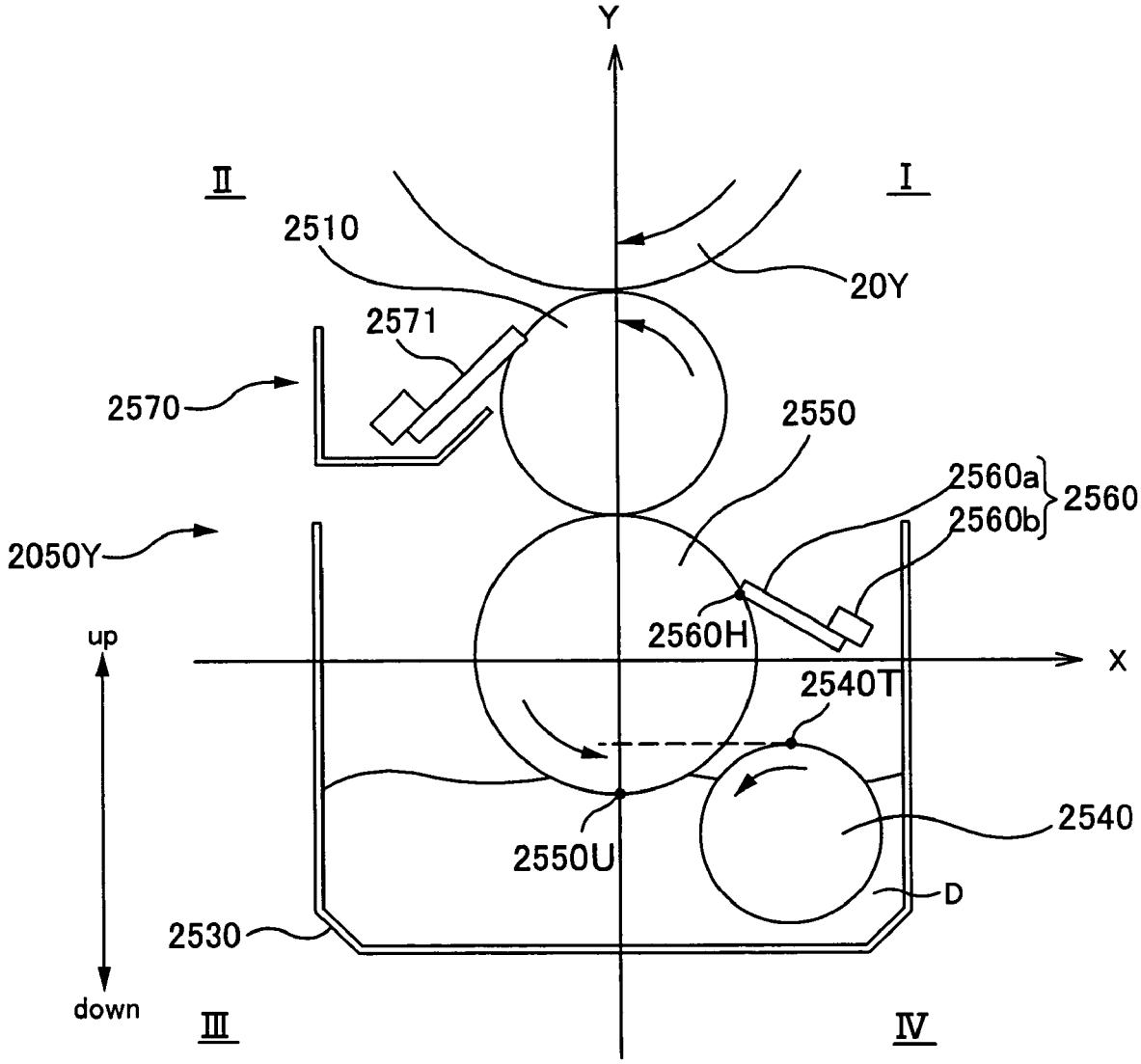
FIG. 19 is a section view showing another example of main structural components of a developing unit.

For example, as shown in FIG. 19, the developer drawing roller 2540 may be arranged in the fourth quadrant, and the restriction blade 2560 may be arranged in the first quadrant. Even in this example, the effect of being able to prevent a shortage of the developer D from occurring locally on the application roller 2550, can be achieved. It should be noted that FIG. 19 is a section view showing an example of main structural components of a developing unit.

Further, in the foregoing embodiment, the application roller 2550 was described as rotating in the opposite direction (clockwise in FIG. 14) from the rotating direction of the developing roller 2510 (counterclockwise in FIG. 14). This, however, is not a limitation.

For example, as shown in FIG. 19, the application roller 2550 may rotate in the same direction (counterclockwise in FIG. 19) as the rotating direction of the developing roller 2510 (counterclockwise in FIG. 14 and FIG. 19).

Further, in the foregoing embodiment, a vertical line (for example, the straight line V in FIG. 14) that extends vertically downwards from an abutting position 2560H where the restriction member abuts against the application roller 2550 passed through the developer drawing roller 2540. This, however, is not a limitation.

Figure 20:
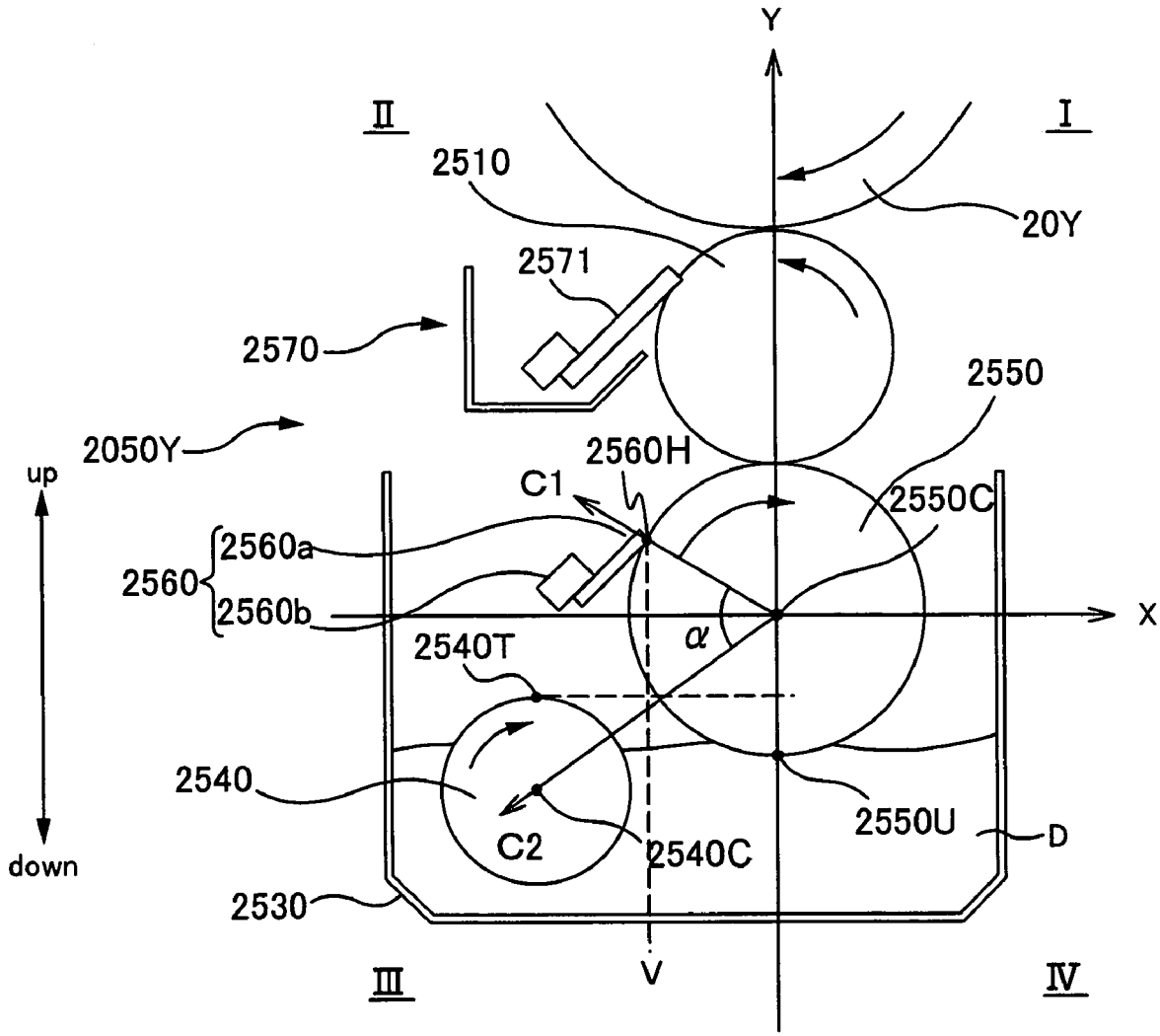
FIG. 20 is a section view showing another example of main structural components of a developing unit.

For example, the straight line V does not have to pass through the developer drawing roller 2540 as shown in FIG. 20.

The foregoing embodiment, however, is more preferable because when the straight line V that extends vertically downwards from the abutting position 2560H where the restriction member abuts against the application roller 2550 passes through the developer drawing roller 2540, the developer D that has been scraped off at the abutting position by the restriction blade 2560 falls towards the upper edge of the developer drawing roller 2540 due to gravity, and therefore, it becomes possible to supply the developer D from the developer drawing roller 2540 to the application roller 2550 stably.

Further, in the foregoing embodiment, the developer drawing roller 2540 did not abut against the application roller 2550; and an angle (for example, the angle α in FIG. 14) formed between a direction (for example, the first direction C1 in FIG. 14) from the center 2550C of the application roller to the abutting position 2560H of the restriction blade and a direction (for example, the second direction C2 in FIG. 14) from the center 2550C of the application roller to the center 2540C of the developer drawing roller was equal to or less than 90°. This, however, is not a limitation.

For example, the angle α formed between the first direction C1 and the second direction C2 may be more than 90° and equal to or less than 180°.

The foregoing embodiment, however, is more preferable because when the angle α formed between the first direction C1 and the second direction C2 is equal to or less than 90°, the developer drawing roller 2540 and the restriction blade 2560 are arranged close to each other, and therefore, it becomes possible to allow the developer D to build up between the developer drawing roller 2540 and the restriction blade 2560 and in the periphery of the application roller 2550.

Further, in the foregoing embodiment, the abutting position 2560H of the restriction blade was located above the position of the liquid surface of the developer D in the vertical direction. This, however, is not a limitation.

For example, the abutting position 2560H of the restriction blade may be located below the position of the liquid surface of the developer D in the vertical direction.

However, if the abutting position 2560H of the restriction blade is located below the level of the liquid surface of the developer D in the vertical direction, then the developer D will adhere to the restriction blade 2560. The foregoing embodiment is therefore more preferable in terms that, by arranging the abutting position 2560H of the restriction blade above the position of the liquid surface of the developer D in the vertical direction, it is possible to prevent the developer D from adhering to the restriction blade 2560.

Further, in the foregoing embodiment, the developer D was non-volatile liquid developer that is non-volatile at room temperature. This, however, is not a limitation.

For example, the developer D may be volatile liquid developer which employs Isopar (trademark: Exxon Mobil Corporation) as a carrier, has low concentration (approximately 1 to 2 wt %) and low viscosity, and is volatile at room temperature.

The foregoing embodiment, however, is more preferable because when non-volatile liquid developer is adopted as the developer D, the developer D will have high viscosity and be low in flowability, and thus, it becomes possible to allow the developer D to build up easily between the developer drawing roller 2540 and the restriction blade 2560 and in the periphery of the application roller 2550.

Further, in the foregoing embodiment, the liquid development device further comprised a developing roller 2510 to which the developer D, whose amount has been restricted by the restriction blade 2560, is applied by the application roller 2550 and that is for bearing the developer D that has been applied thereto; and the developing roller 2510 was located vertically above the X-axis. This, however, is not a limitation.

For example, the developing roller 2510 may be located vertically below the X-axis.

Further, in the foregoing embodiment, the recesses of the application roller 2550 were helical grooves 2550*a*; and a plurality of the helical grooves 2550*a* were provided in the surface of the application roller 2550 at predetermined intervals. This, however, is not a limitation.

Figure 21A:
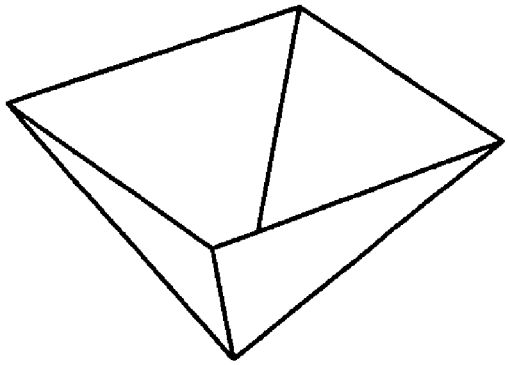
FIG. 21A is a diagram showing an example of a recess provided in the surface of the application roller 2550.
Figure 21B:
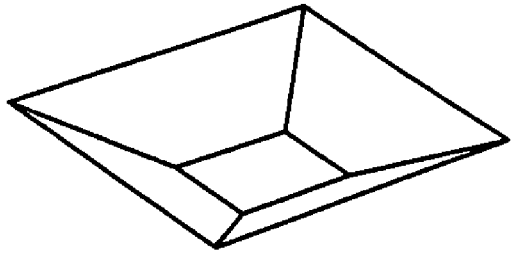
FIG. 21B is a diagram showing another example of a recess provided in the surface of the application roller 2550.

For example, a plurality of recesses having a shape as shown in FIG. 21A or FIG. 21B may be provided in the surface of the application roller 2550. It should be noted that FIG. 21A is a diagram showing an example of a recess provided in the surface of the application roller 2550, and FIG. 21B is a diagram showing another example of a recess provided in the surface of the application roller 2550.

THIRD EMBODIMENT OF THE DEVELOPING UNIT ETC

Overview of Developing Unit

Figure 22:
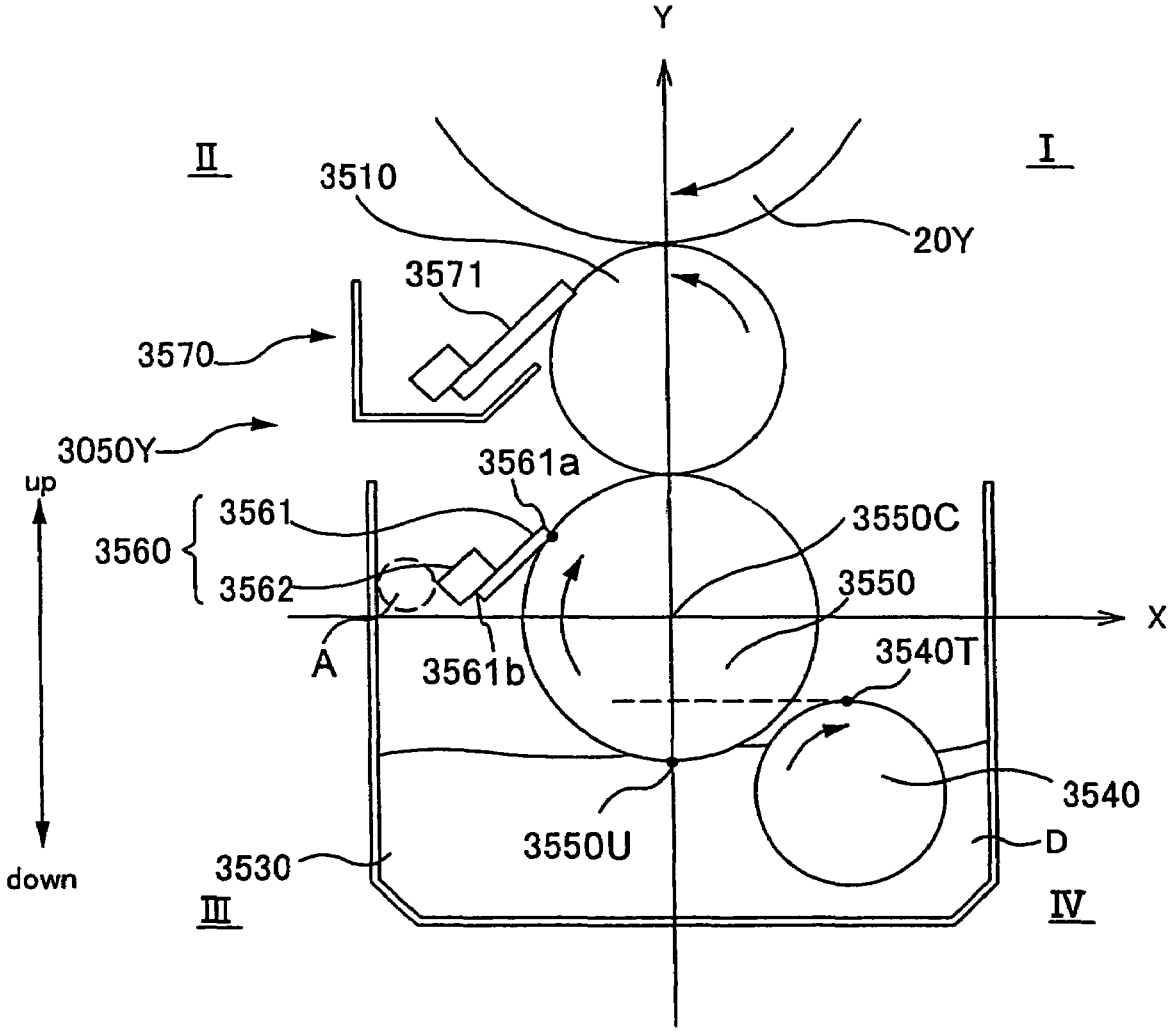
FIG. 22 is a section view showing main structural components of a developing unit according to a third embodiment.
Figure 23:
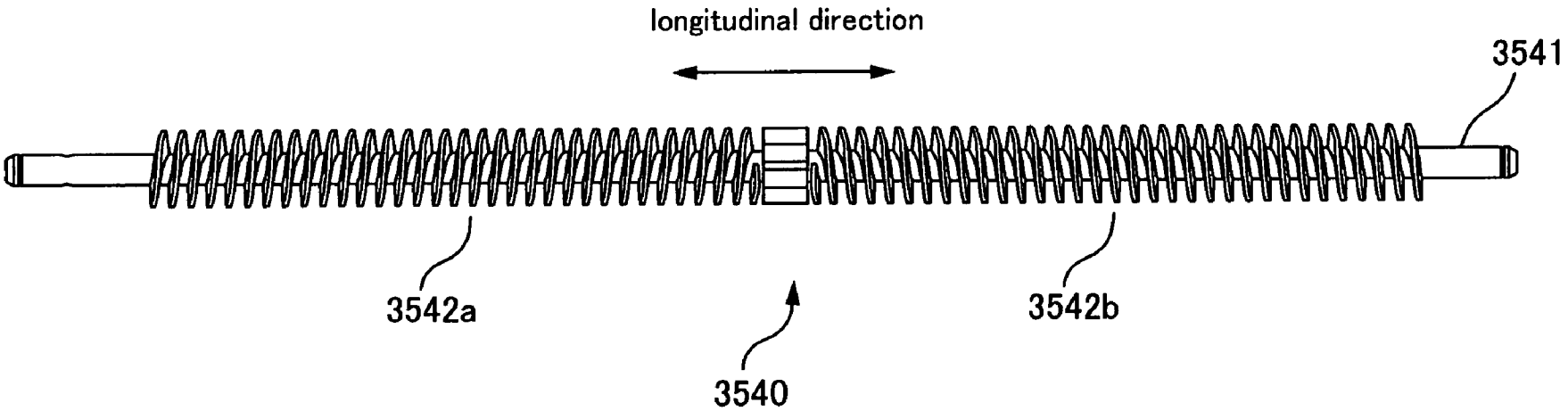
FIG. 23 is a diagram showing an example of the shape of a developer drawing roller 3540.
Figure 24:
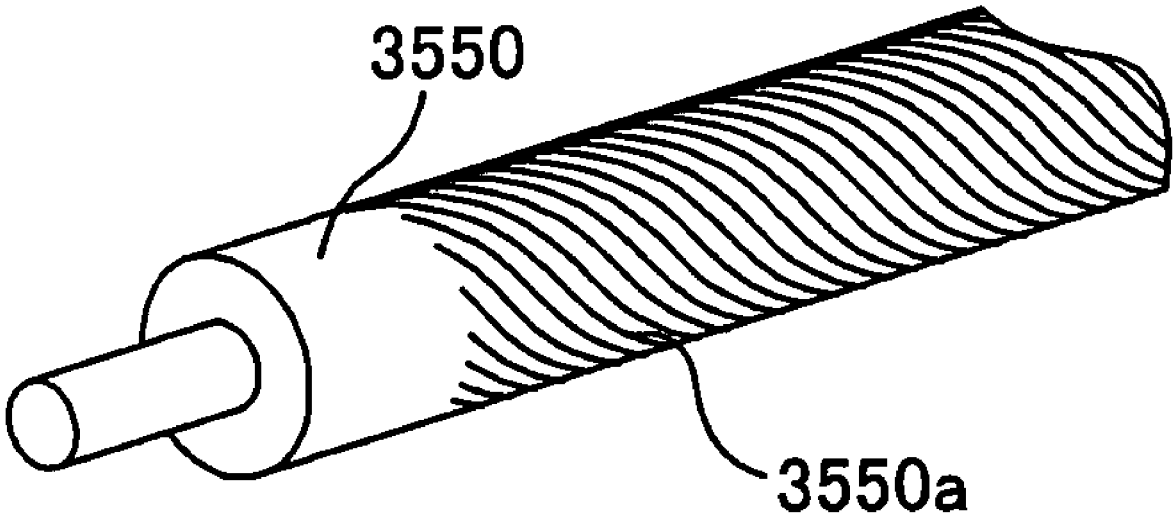
FIG. 24 is a perspective view showing the surface of a developer supplying roller 3550.
Figure 25A:
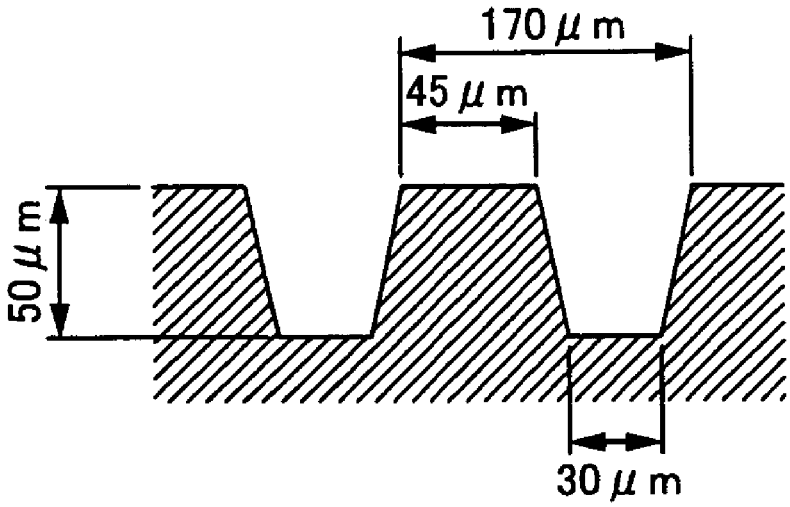
FIG. 25A is a section view showing a groove 3550*a*, which is provided in the surface of the developer supplying roller 3550, having a trapezoidal cross section.
Figure 25B:
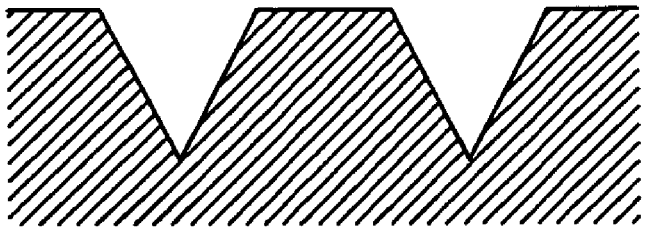
FIG. 25B is a section view showing a groove 3550*a*, which is provided in the surface of the developer supplying roller 3550, having a cross section in the shape of an inverted delta.
Figure 25C:
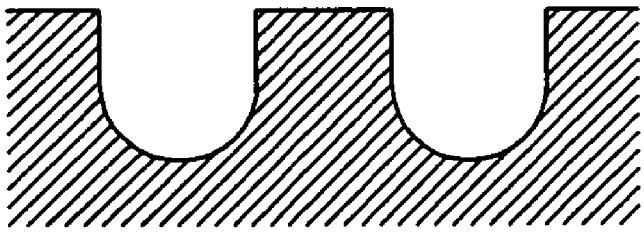
FIG. 25C is a section view showing a groove 3550*a*, which is provided in the surface of the developer supplying roller 3550, having a semicircular cross section.

Next, with reference to FIG. 22 etc., an overview of a developing unit according to the third embodiment is described below. FIG. 22 is a section view showing main structural components of a developing unit. FIG. 23 is a diagram showing an example of the shape of a developer drawing roller 3540. FIG. 24 is a perspective view conceptually showing the surface of a developer supplying roller 3550. FIG. 25A is a section view showing a groove 3550*a*, which is provided in the surface of the developer supplying roller 3550, having a trapezoidal cross section. FIG. 25B is a section view showing a groove 3550*a*, which is provided in the surface of the developer supplying roller 3550, having a cross section in the shape of an inverted delta. FIG. 25C is a section view showing a groove 3550*a*, which is provided in the surface of the developer supplying roller 3550, having a semicircular cross section.

It should be noted that in FIG. 22, the arrow indicates the vertical direction as in FIG. 1. For example, the developing roller 3510 is positioned above the developer drawing roller 3540. Further, in FIG. 22, the Y-axis serves as an example of a first coordinate axis that passes the center 3550C of the developer supplying roller 3550 and that extends in the vertically upward direction, and the X-axis serves as an example of a second coordinate axis that passes the center 3550C of the developer supplying roller 3550 and that extends from left to right of the Y-axis. Further, in FIG. 22, "I", "II", "III", and "IV" indicate the first quadrant, the second quadrant, the third quadrant, and the fourth quadrant, respectively. (This is the same for FIG. 28 through FIG. 30.)

<Configuration of Developing Unit>

The printer 10 has, as developing units, a black developing unit. 3050K containing black (K) developer, a magenta developing unit 3050M containing magenta (M) developer, a cyan developing unit 3050C containing cyan (C) developer, and a yellow developing unit 3050Y containing yellow (Y) developer. Since the structure of each developing unit is substantially the same, only the yellow developing unit 3050Y is described in detail below.

The yellow developing unit 3050Y has a developing roller 3510 serving as an example of a developer bearing body, a developer containing section 3530 serving as an example of a containing section, a developer drawing roller 3540 serving as an example of a carrying roller, a developer supplying roller 3550 serving as an example of a retaining roller, a restriction blade 3560 serving as an example of an amount-restricting member, and a developing-roller cleaning unit 3570.

The developer containing section 3530 contains developer D which is for developing a latent image formed on the photoconductor 20Y. The type of developer D contained in the developer containing section 3530 is a high-concentration, high-viscosity, non-volatile liquid developer D, and is not the general, conventional volatile liquid developer which employs Isopar (trademark: Exxon Mobil Corporation) as a carrier and has low concentration (approximately 1 to 2 wt %) and low viscosity. More specifically, the liquid developer D according to the present embodiment has a high viscosity (approximately 100 to 10000 mPa.s) and is made by dispersing, at a high concentration (approximately 5 to 40 wt %), toner particles having an average particle size of approximately 0.1 to 5 μm and being made, for example, of resin or pigment into a non-volatile, insulating carrier liquid such as silicone oil.

The developer drawing roller 3540 draws up the developer D, which is contained in the developer containing section 3530, and carries it to the developer supplying roller 3550. The lower section of the developer drawing roller 3540 is immersed in the developer D contained in the developer containing section 3530. The developer drawing roller 3540 is separated from the developer supplying roller 3550 at a distance of approximately 1 mm.

The developer drawing roller 3540 is rotatable about its central axis. The central axis of the roller 3540 is below the central axis of rotation of the developer supplying roller 3550. Further, the developer drawing roller 3540 rotates in the same direction (clockwise in FIG. 22) as the rotating direction of the developer supplying roller 3550 (the direction in which the roller moves from the third quadrant toward the second quadrant; that is, clockwise in FIG. 22). It should be noted that the developer drawing roller 3540 not only has the function of drawing up the developer D contained in the developer containing section 3530 and carrying it to the developer supplying roller 3550, but also has the function of stirring the developer D in order to maintain the developer D in a suitable state.

Further, as shown in FIG. 23, the developer drawing roller 3540 has two screws 3542*a* and 3542*b*, whose twisting directions are different from each other, provided on a roller shaft 3541. These screws 3542*a* and 3542*b* allow the two functions of the developer drawing roller 3540 described above to be achieved more effectively.

Further, as shown in FIG. 22, the developer drawing roller 3540 is located in the fourth quadrant IV, and the upper edge 3540T of the developer drawing roller is located above the lower edge 3550U of the developer supplying roller in the vertical direction.

The developer supplying roller 3550 supplies the developer D, which has been carried from the developer containing section 3530 by the developer drawing roller 3540, to the developing roller 3510. The developer supplying roller 3550 is made by providing helical grooves 3550*a* at even pitches in the surface of a roller made of metal such as iron as shown in FIG. 24, and providing a nickel plating thereon. The diameter of the developer supplying roller 3550 is approximately 25 mm. A plurality of these helical grooves 3550*a* are provided in the surface of the developer supplying roller 3550 at predetermined intervals. The developer supplying roller 3550 of the present embodiment has, as grooves, the grooves 3550*a* which have a trapezoidal cross section as shown in FIG. 25A. It is instead possible, for example, to provide grooves having a cross section in the shape of an inverted delta as shown in FIG. 25B, or grooves having a semicircular cross section as shown in FIG. 25C. It should be noted that the size of the grooves of the developer supplying roller 3550 of the present embodiment is as shown in FIG. 25A: the groove pitch is approximately 170 μm, the width of the crest is approximately 45 μm, the width of the trough is approximately 30 μm, and the depth of the groove is approximately 50 μm.

Further, the developer supplying roller 3550 is pressed in contact with the developing roller 3510 in order to appropriately transfer the developer D on the developer supplying roller 3550 to the developing roller 3510. The developer supplying roller 3550 is rotatable about its central axis, and the central axis thereof is below the central axis of rotation of the developing roller 3510. Further, the developer supplying roller 3550 rotates in the direction (clockwise in FIG. 22) opposite from the rotating direction of the developing roller 3510 (counterclockwise in FIG. 22).

The restriction blade 3560 abuts against the surface of the developer supplying roller 3550 to restrict the amount of developer D on the developer supplying roller 3550. More specifically, the restriction blade 3560 serves as to scrape off any excessive developer D on the developer supplying roller 3550 to measure the developer D on the developer supplying roller 3550, which is to be supplied to the developing roller 3510.

The restriction blade 3560 has a rubber section 3561 that serves as an example of an abutting section abutting against the surface of the developer supplying roller 3550, and a rubber-supporting section 3562 that serves as a supporting section supporting the rubber section 3561. The rubber section 3561 is made of urethane rubber, and its rubber hardness is approximately 62 degrees in JIS (Japanese Industrial Standards) A scale. The rubber-supporting section 3562 is a plate made of metal such as iron.

The rubber section 3561 abuts against the surface of the developer supplying roller 3550 with one end 3561*a* thereof. The restriction blade 3560 is placed in contact with the developer supplying roller 3550 at the edge of the rubber section 3561, and thus, carries out a so-called "edge restriction".

As shown in FIG. 22, the restriction blade 3560 is located in the second quadrant II. Further, the end 3561*a* of the rubber section is located above the other end 3561*b* of the rubber section in the vertical direction, and thus, the restriction blade 3560 carries out a so-called "trailing restriction". In the present embodiment, the "trailing angle" at which the restriction blade 3560 trails is approximately 10 degrees.

Further, a gap ("A" in FIG. 22) is provided between the back surface of the restriction blade 3560 and the developer containing section 3530. As described above, since the developer drawing roller 3540 is located in the fourth quadrant IV and the restriction blade 3560 is located in the second quadrant II, it is possible to certainly prevent the developer D from passing over the restriction blade 3560 through the gap ("A" in FIG. 22) when the developer drawing roller 3540 carries the developer D.

The developing roller 3510 bears the developer D and carries it to a developing position, which is in opposition to the photoconductor 20Y, in order to develop a latent image bore by the photoconductor 20Y with the developer D. The developing roller 3510 has a layer of an elastic body, which has conductivity, on the outer circumferential section of its inner core made of metal such as iron. The diameter of the developing roller 3510 is approximately 20 mm. The layer of the elastic body has a two-layer structure: urethane rubber with a thickness of approximately 5 mm and a rubber hardness of approximately 30 degrees in JIS-A is provided as the inner layer; and urethane rubber with a thickness of approximately 30 μm and a rubber hardness of approximately 85 degrees in JIS-A is provided as the surface layer (outer layer). The developing roller 3510 is pressed in contact with the developer supplying roller 3550 and the photoconductor 20Y in an elastically-deformed state.

The developing roller 3510 is rotatable about its central axis, and the central axis thereof is below the central axis of rotation of the photoconductor 20Y. Further, the developing roller 3510 rotates in the direction (counterclockwise in FIG. 22) opposite from the rotating direction of the photoconductor 20Y (clockwise in FIG. 22). It should be noted that an electric field is generated between the developing roller 3510 and the photoconductor 20Y when the latent image formed on the photoconductor 20Y is being developed.

The developing-roller cleaning unit 3570 is a device that has a developing-roller cleaning blade 3571, which is made of rubber and which is made to abut against the surface of the developing roller 3510, and is for scraping off and removing the developer D remaining on the developing roller 3510 with the developing-roller cleaning blade 3571 after development has been carried out at the developing position.

<Operations of the Developing Unit>

In the yellow developing unit 3050Y structured as above, the developer drawing roller 3540 rotates about its central axis to draw up the developer D contained in the developer containing section 3530 and carry it to the developer supplying roller 3550.

With the rotation of the developer supplying roller 3550, the developer D that has been carried to the developer supplying roller 3550 reaches an abutting position where the restriction blade 3560 abuts against the roller 3550. As the developer D on the roller 3550 passes the abutting position, an excessive portion of the developer D is scraped off by the restriction blade 3560, and thus, the amount of developer D to be supplied to the developing roller 3510 is measured. That is, since the developer supplying roller 3550 is provided with the grooves 3550*a* as described above, the restriction blade 3560, which abuts against the developer supplying roller 3550, scrapes off the developer D on the developer supplying roller 3550 except for the developer D in the grooves 3550*a*. The dimension of the grooves 3550*a* is determined in advance such that the amount of developer D to be supplied to the developing roller 3510 becomes appropriate, so that when the restriction blade 3560 scrapes off the developer D on the developer supplying roller 3550, an appropriate amount of developer D, which has been suitably measured by means of the grooves 3550*a*, will remain in the grooves 3550*a*.

With further rotation of the developer supplying roller 3550, the developer D remaining in the grooves 3550*a* of the developer supplying roller 3550 reaches a press-contact position where the roller 3550 is pressed in contact with the developing roller 3510, and is transferred from the developer supplying roller 3550 to the developing roller 3510 at the press-contact position. Upon transferring, the developer D in the grooves 3550*a* is spread by the action of a pressure that is created as a result of the developer supplying roller 3550 and the developing roller 3510 being pressed in contact with each other, thereby forming an even, thin layer of developer D on the developing roller 3510.

The thin layer of developer D formed on the developing roller 3510 in this way is carried by the rotation of the developing roller 3510 and arrives at the developing position in opposition to the photoconductor 20Y (i.e., a press-contact position where the roller 3510 abuts against the photoconductor 20Y). Then the developer D is used at the developing position for developing the latent image formed on the photoconductor 20 under an electric field of a predetermined intensity.

With further rotation of the developing roller 3510, the developer D on the developing roller 3510 that has passed the developing position reaches an abutting position where the developing-roller cleaning blade 3571 abuts against the roller 3510. When passing the abutting position, the developer D adhering to the surface of the developing roller 3510 is scraped off by the developing-roller cleaning blade 3571, and the scraped-off developer D is collected in a remaining-developer collector of the developing-roller cleaning unit 3570.

Effect of Preventing the Liquid Developer from Passing Over the Amount-Restricting Member As described above, in the printer 10 according to the present embodiment, the developer drawing roller 3540 is located in the fourth quadrant (IV in FIG. 22), and the restriction blade 3560 is located in the second quadrant (II in FIG. 22). In this way, it is possible to certainly prevent the developer D from passing over the restriction blade 3560 when the developer drawing roller 3540 carries the developer D to the developer supplying roller 3550.

More specifically, as described in the section of the "Description of the Related Art", there are cases in which the developer D passes over the restriction blade 3560 when the developer drawing roller 3540 carries the developer D to the developer supplying roller 3550.

Figure 26:
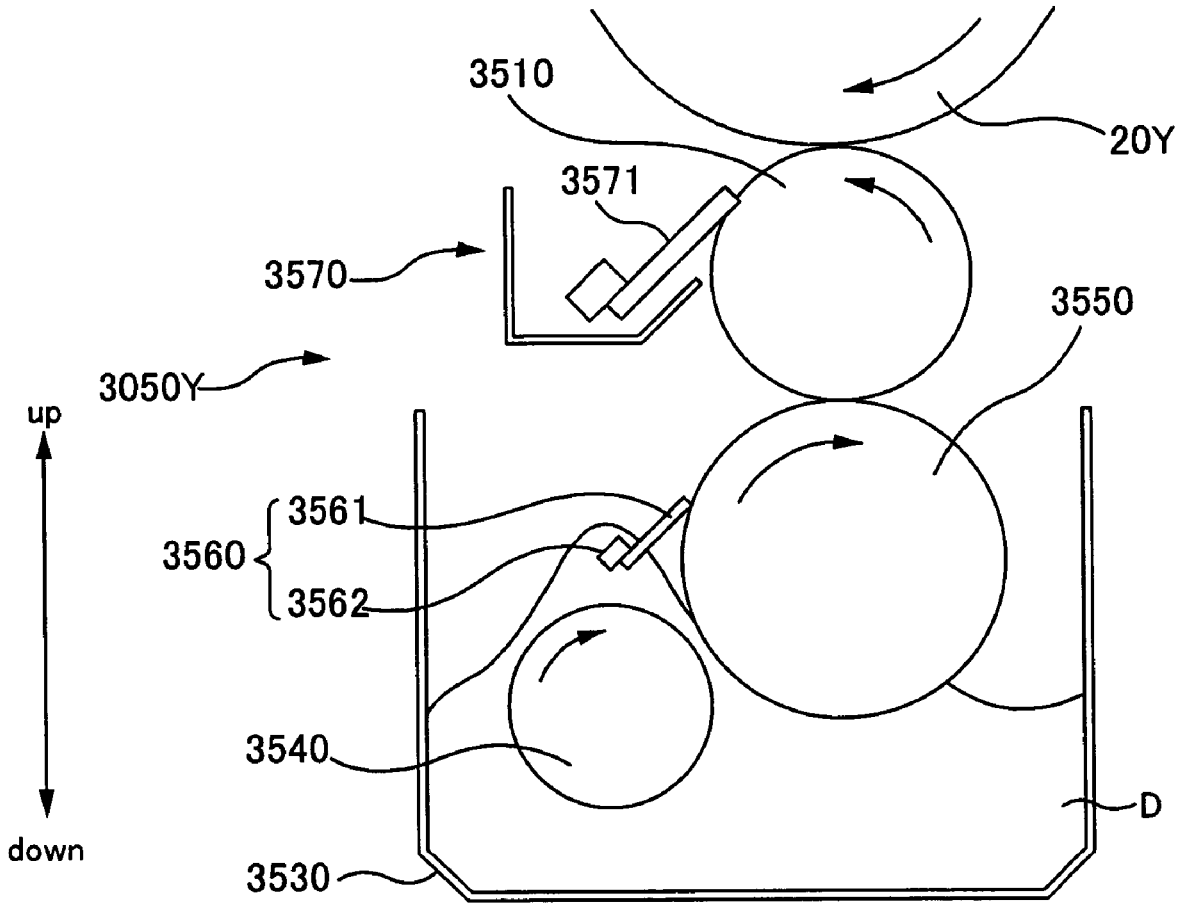
FIG. 26 is a diagram for describing a comparison example.

For example, if the developer drawing roller 3540 is located in the lower section of the restriction blade 3560 as shown in FIG. 26 which is provided for describing a comparison example, the developer D is raised due to its viscosity when the developer drawing roller 3540 carries the developer D to the developer supplying roller 3550, and the raised developer D may pass over the restriction blade 3560 through a gap provided between the restriction blade 3560 and the developer containing section 3530, which is a separate member. In other cases, the developer D may scatter when the developer drawing roller 3540 carries the developer D, and the scattered developer D may pass over the restriction blade 3560 through the gap between the restriction blade 3560 and the developer containing section 3530. Further, if the developer drawing roller 3540 carries a large amount of developer D, then the tendency for the developer D to pass over the restriction blade 3560 becomes even larger. It should be noted that FIG. 26 is a diagram for describing a comparison example.

Further, the developer D that has passed over the restriction blade 3560 may adhere to the developer supplying roller 3550. In this case, the developer D will adhere to the developer supplying roller 3550 even if the restriction blade 3560 has restricted the amount of developer D to an appropriate amount. Therefore, the amount of developer D retained by the developer supplying roller 3550 will change.

In view of the above, in the present embodiment, the restriction blade 3560 is arranged in the second quadrant (II in FIG. 22) when the developer drawing roller 3540 is located in the fourth quadrant (IV in FIG. 22). In this way, the developer drawing roller 3540 and the restriction blade 3560 are located respectively in quadrants whose positional relationship becomes furthest from each other. Therefore, it is possible to certainly prevent the developer D from passing over the restriction blade 3560 when the developer drawing roller 3540 carries the developer D to the developer supplying roller 3550.

It should be noted that, although the above description was about an example in which the developer drawing roller 3540 was located in the fourth quadrant (IV in FIG. 22) and the restriction blade 3560 was located in the second quadrant (II in FIG. 22), the same effects as those described above can be achieved even when the developer drawing roller 3540 is located in the third quadrant (III in FIG. 22) and the restriction blade 3560 is located in the first quadrant (I of FIG. 22).

Consequently, it becomes possible to solve the above-described problem, that is, the problem that the developer D may pass over the restriction blade 3560 when the developer drawing roller 3540 carries the developer D to the developer supplying roller 3550.

Other considerations

The third embodiment of the present invention relates to a liquid development device (for example, the developing units 3050Y, 3050M, 3050C, and 3050K) comprising: a retaining roller (for example, developer supplying roller 3550) for retaining liquid developer (for example, the developer D) to be supplied to a developer bearing body (for example, the developing roller 3510); a carrying roller (for example, the developer drawing roller 3540) for carrying the liquid developer to the retaining roller; an amount-restricting member (for example, the restriction blade 3560) for restricting the amount of the liquid developer on the retaining roller; and a containing section (for example, the developer containing section 3530) for containing the liquid developer.

In the foregoing embodiment, the developer drawing roller 3540 was described as having two screws 3542*a* and 3542*b*, whose twisting directions are different from each other, provided on a roller shaft 3541, as shown in FIG. 23. This, however, is not a limitation.

Figure 27A:
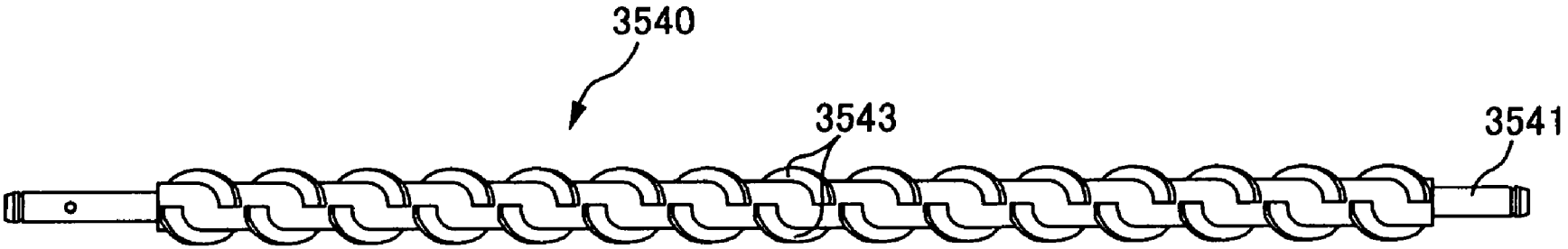
FIG. 27A is a front view showing an example of the shape of a developer drawing roller 3540.
Figure 27B:
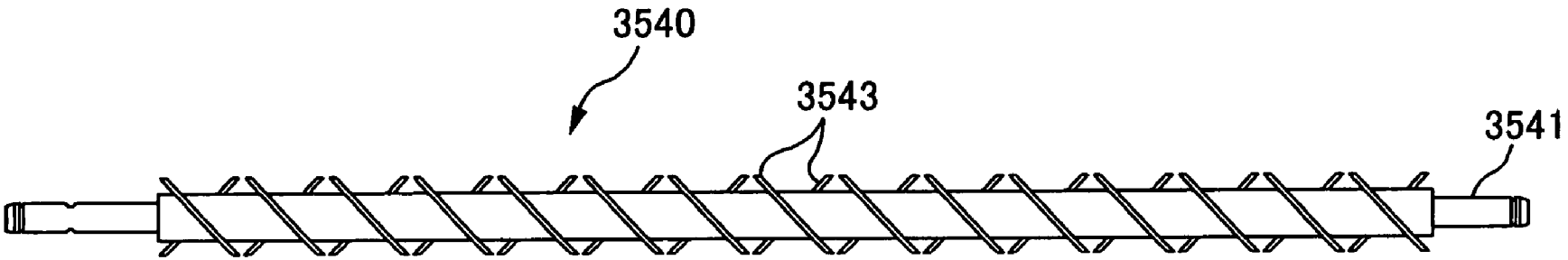
FIG. 27B is a top view showing the developer drawing roller 3540 shown in FIG. 27A.

For example, the developer drawing roller 3540 may have a blade section 3543 provided on the roller shaft 3541 as shown in FIG. 27A and FIG. 27B. It should be noted that FIG. 27A is a front view showing an example of the shape of a developer drawing roller 3540, and FIG. 27B is a top view showing the developer drawing roller 3540 shown in FIG. 27A.

Further, in the foregoing embodiment, the upper edge 3540T of the developer drawing roller was located above the lower edge 3550U of the developer supplying roller in the vertical direction, as shown in FIG. 22. This, however, is not a limitation.

For example, the upper edge 3540T of the developer drawing roller may be located below the lower edge 3550U of the developer supplying roller in the vertical direction.

The foregoing embodiment, however, is more preferable because when the amount of developer D contained in the developer containing section 3530 is small, it is more effective, in terms of carrying the developer D to the developer supplying roller 3550, to arrange the upper edge 3540T of the developer drawing roller above the lower edge 3550U of the developer supplying roller rather than to arrange the upper edge 3540T of the developer drawing roller below the lower edge 3550U of the developer supplying roller.

Further, in the foregoing embodiment, the restriction blade 3560 had an rubber section 3561 that abuts against the surface of the developer supplying roller 3550 and a rubber-supporting section 3562 that supports the rubber section 3561. This, however, is not a limitation.

For example, the restriction blade 3560 does not have to abut against the surface of the developer supplying roller 3550.

However, when the rubber section 3561 abuts against the surface of the developer supplying roller 3550, since the restriction blade 3560 abuts against the surface of the developer supplying roller 3550 with its rubber section 3561 to restrict the amount of developer D on the developer supplying roller 3550, it become difficult for the restriction blade 3560 to appropriately restrict the amount of developer D on the developer supplying roller 3550 if the developer D passes over the restriction blade 3560 and adheres thereto. The foregoing embodiment is therefore more preferable in terms that the effect of the present invention, that is, the effect that it becomes possible to certainly prevent the developer D from passing over the restriction blade 3560 when the developer drawing roller 3540 carries the developer D to the developer supplying roller 3550, is achieved more advantageously.

Further, in the foregoing embodiment, the rubber section 3561 abutted against the surface of the developer supplying roller 3550 at one end 3561*a*; and in the vertical direction, the one end 3561*a* of the rubber section 3561 was located above the other end 3561*b* of the rubber section 3561, as shown in FIG. 22. This, however, is not a limitation.

Figure 28:
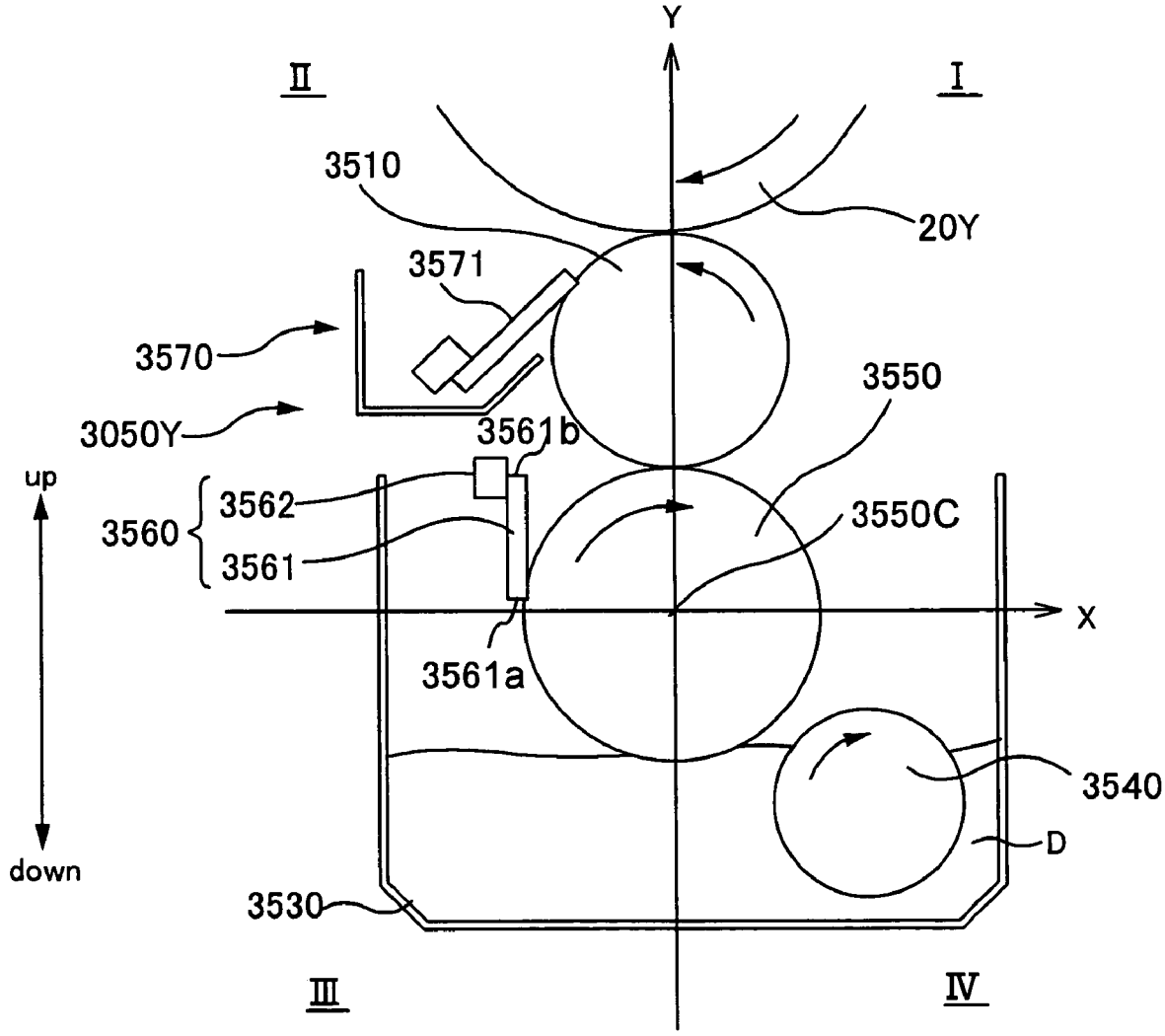
FIG. 28 is a section view showing main structural components of a developing unit according to another embodiment.

For example, as shown in FIG. 28, the one end 3561*a* of the rubber section may be located below the other end 3561*b* of the rubber section. It should be noted that FIG. 28 is a section view showing main structural components of a developing unit according to another embodiment.

There are cases in which the restriction blade 3560 carries out a so-called "trailing restriction" where one end 3561*a* of the rubber section 3561, which abuts against the surface of the developer supplying roller 3550, is located above the other end 3561*b* thereof. In trailing restriction, however, the developer D tends to pass over the restriction blade 3560 across the other end 3561*b* of the rubber section 3561. The foregoing embodiment is therefore more preferable in terms that the effect of the present invention, that is, the effect that it becomes possible to certainly prevent the developer D from passing over the restriction blade 3560 when the developer drawing roller 3540 carries the developer D to the developer supplying roller 3550, is achieved more advantageously.

Further, in the foregoing embodiment, the developer bearing body was provided in each developing unit 3050Y, 3050M, 3050C, and 3050K; the developer bearing body was a developing roller 3510; the rotating direction of the developing roller 3510 was opposite from the rotating direction of the developer supplying roller 3550; and the developer drawing roller 3540 was located in the fourth quadrant (IV in FIG. 22) and the restriction blade 3560 was located in the second quadrant (II in FIG. 22). This, however, is not a limitation.

Figure 29:
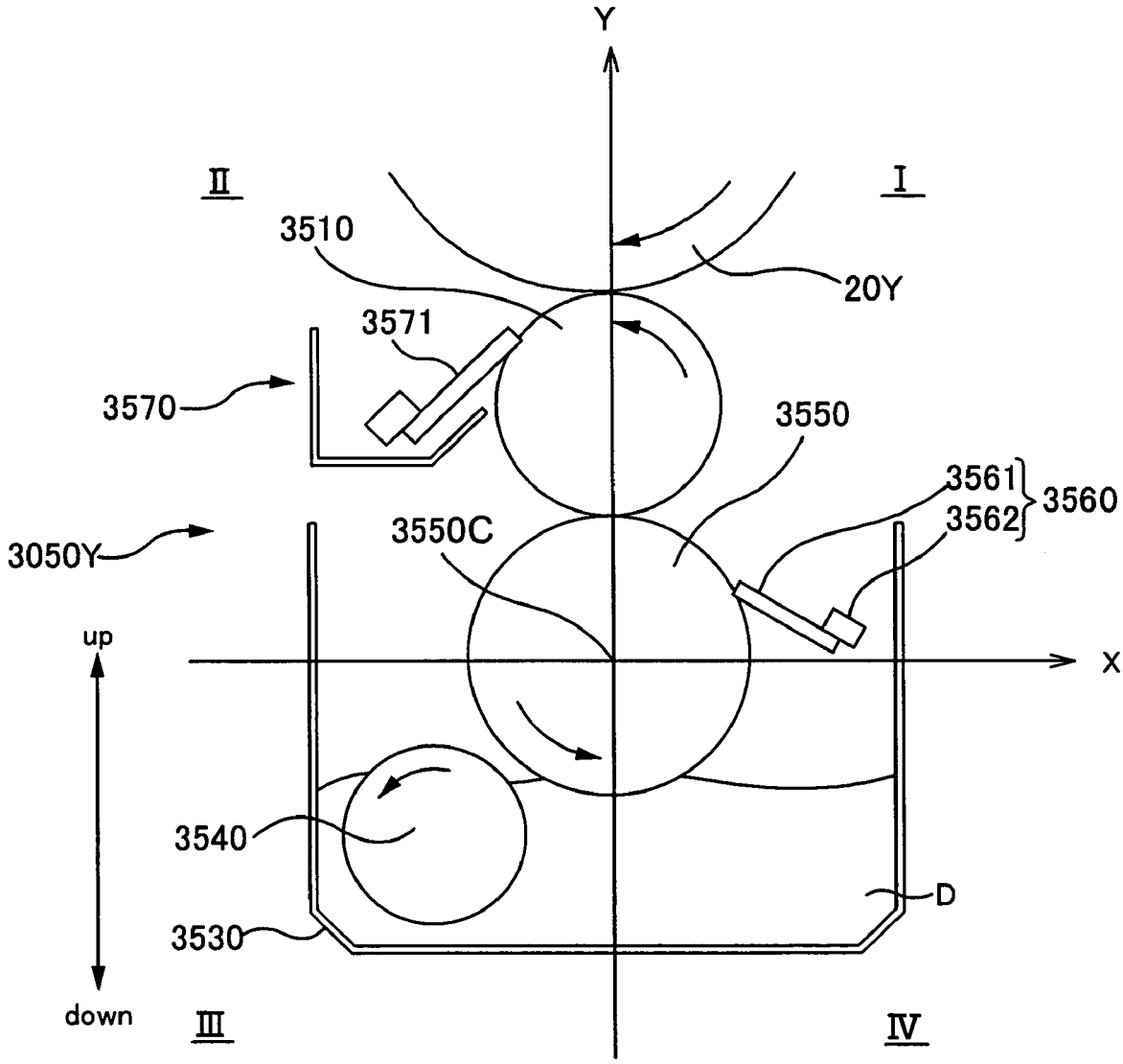
FIG. 29 is a section view showing main structural components of a developing unit according to another embodiment.

For example, as shown in FIG. 29, the rotating direction of the developing roller 3510 may be in the same direction as the rotating direction of the developer supplying roller 3550; and the developer drawing roller 3540 may be located in the third quadrant (III in FIG. 22) and the restriction blade 3560 may be located in the first quadrant (I in FIG. 22). It should be noted that FIG. 29 is a section view showing main structural components of a developing unit according to another embodiment.

Further, in the foregoing embodiment, the rotating direction of the developer drawing roller 3540 was in the same direction as the rotating direction of the developer supplying roller 3550. This, however, is not a limitation.

Figure 30:
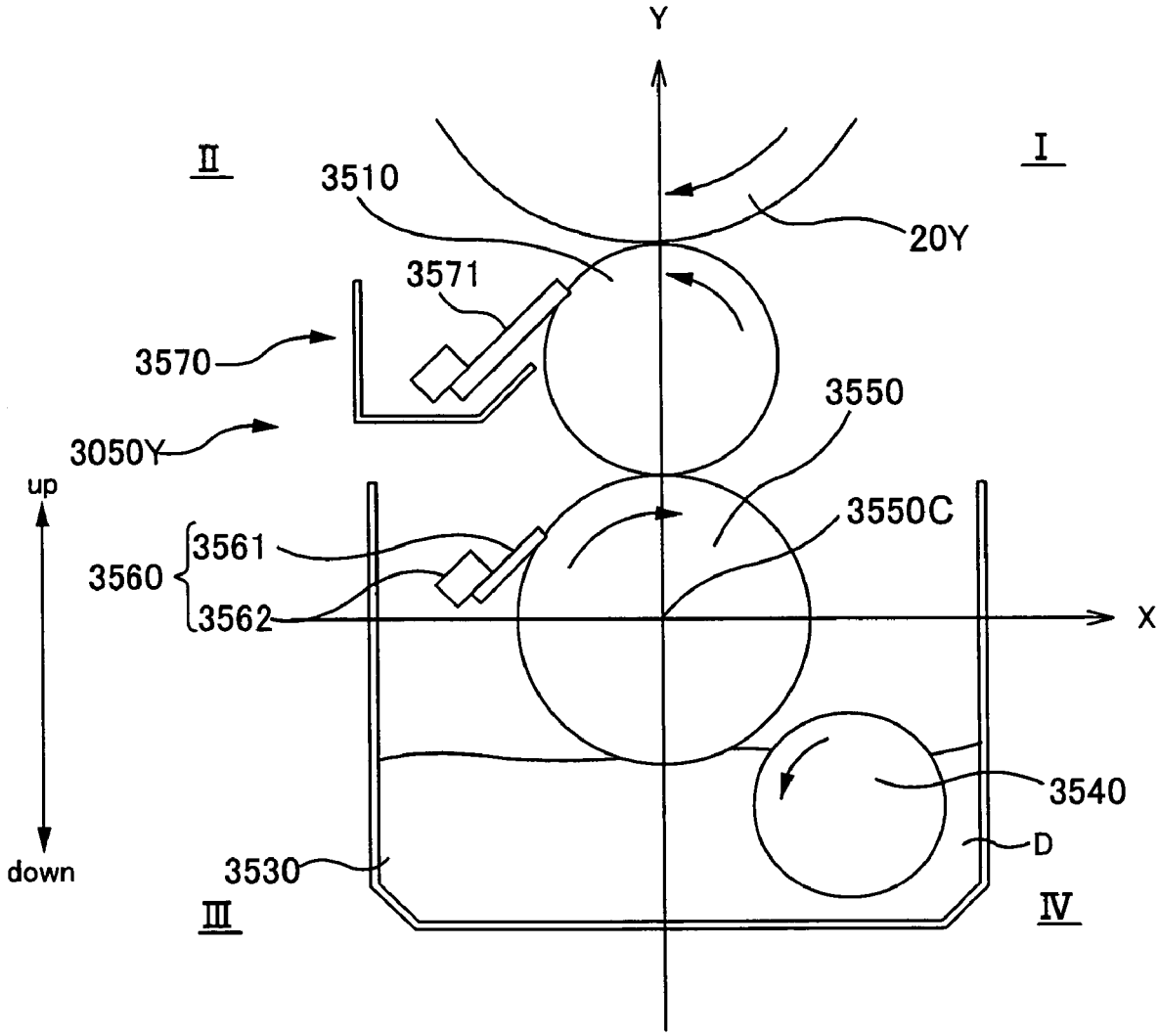
FIG. 30 is a section view showing main structural components of a developing unit according to another embodiment.

For example, as shown in FIG. 30, the rotating direction of the developer drawing roller 3540 may be opposite from the rotating direction of the developer supplying roller 3550. It should be noted that FIG. 30 is a section view showing main structural components of a developing unit according to another embodiment.

The foregoing embodiment, however, is more preferable because, when the rotating direction of the developer drawing roller 3540 is in the same direction as the rotating direction of the developer supplying roller 3550, the developer D carried by the developer drawing roller 3540 can easily adhere to the developer supplying roller 3550 since the developer drawing roller 3540 and the developer supplying roller 3550 pass each other when the developer drawing roller 3540 carries the developer D to the developer supplying roller 3550.

Further, in the foregoing embodiment, the developer D was non-volatile liquid developer that is non-volatile at room temperature. This, however, is not a limitation.

For example, the developer D may be volatile liquid developer which employs Isopar (trademark: Exxon Mobil Corporation) as a carrier, has low concentration (approximately 1 to 2 wt %) and low viscosity, and is volatile at room temperature.

However, when non-volatile liquid developer D is adopted as the developer D, the developer D, which is high in viscosity, clings to the developer drawing roller 3540, and thus, a large amount of developer D may be carried by the developer drawing roller 3540. If a large amount of developer D is carried to the developer supplying roller 3550 by the developer drawing roller 3540, then the possibility that the developer D passes over the restriction blade 3560 becomes even higher. The foregoing embodiment is therefore more preferable in terms that the effect of the present invention, that is, the effect that it becomes possible to certainly prevent the developer D from passing over the restriction blade 3560 when the developer drawing roller 3540 carries the developer D to the developer supplying roller 3550, is achieved more advantageously.

FOURTH EMBODIMENT OF THE DEVELOPING UNIT ETC

Overview of Developing Unit

Figure 31:
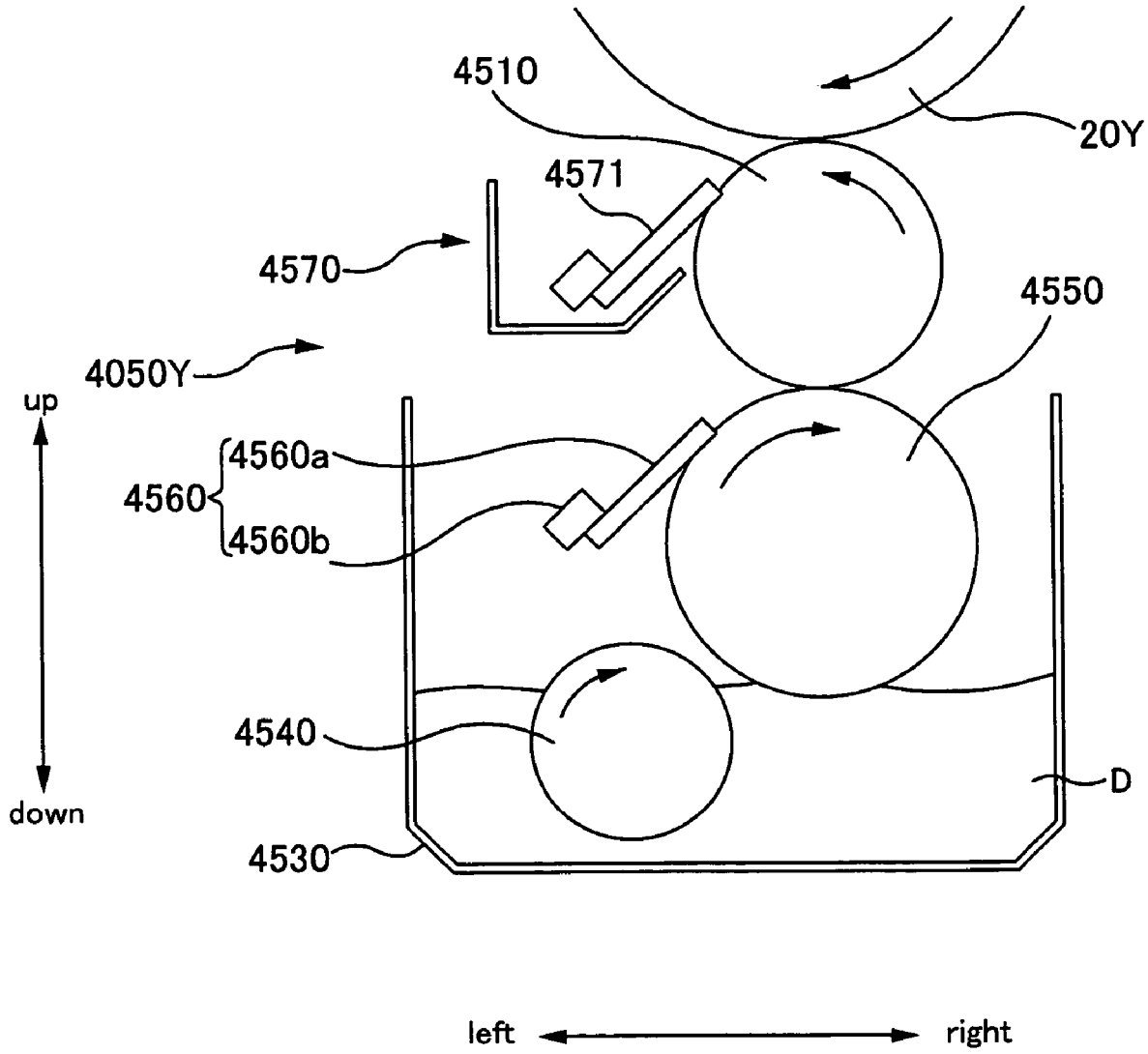
FIG. 31 is a section view showing main structural components of a developing unit according to a fourth embodiment.
Figure 32:
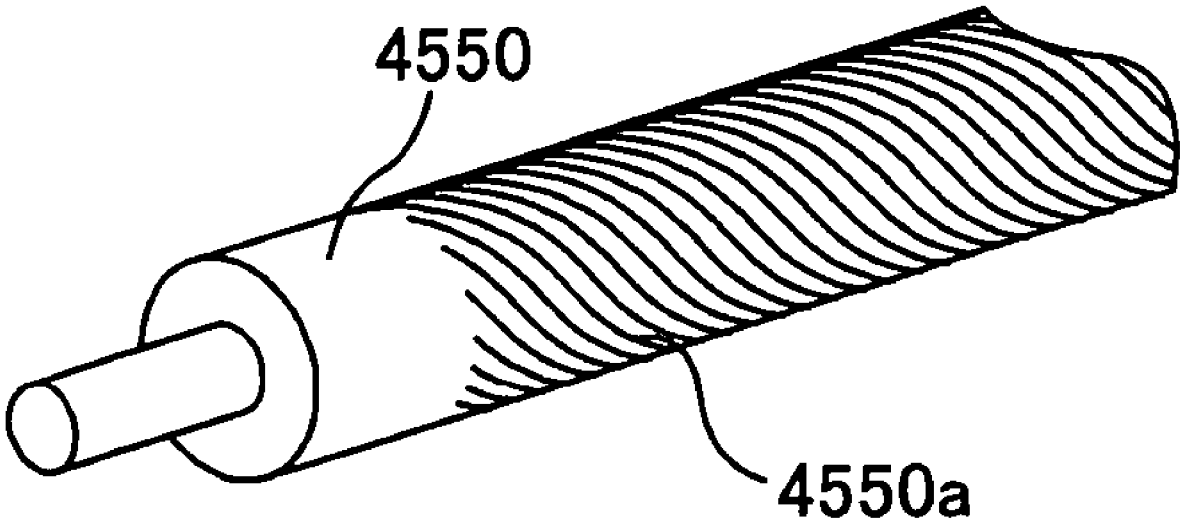
FIG. 32 is a perspective view showing the surface of a developer supplying roller 4550.
Figure 33A:
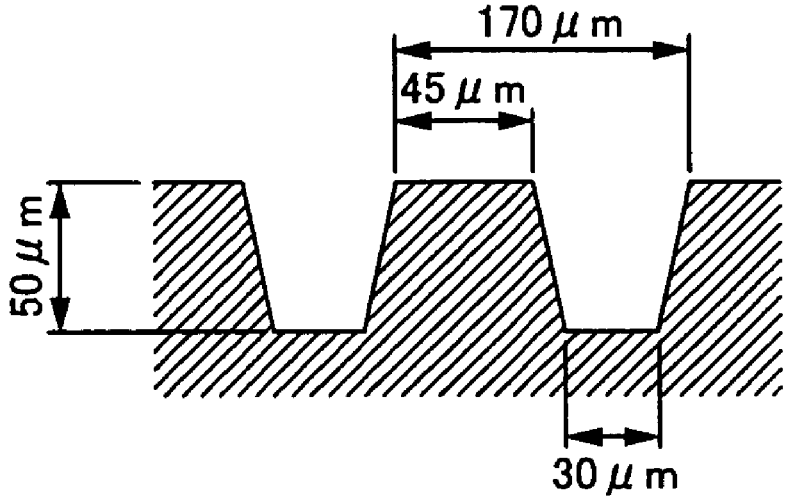
FIG. 33A is a section view showing a groove 4550*a* having a trapezoidal cross section.
Figure 33B:
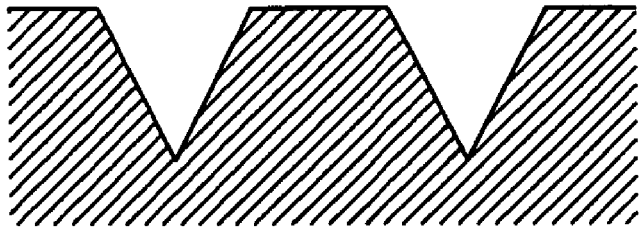
FIG. 33B is a section view showing a groove 4550*a* having a cross section in the shape of an inverted delta.
Figure 33C:
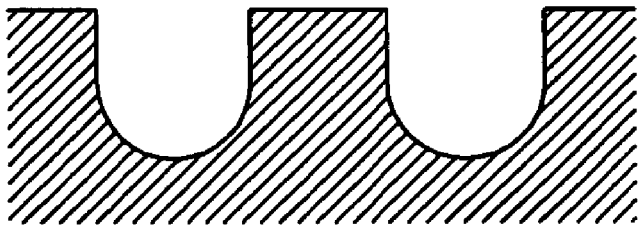
FIG. 33C is a section view showing a groove 4550*a* having a semicircular cross section.

Next, with reference to FIG. 31 etc., an overview of a developing unit according to the fourth embodiment is described below. FIG. 31 is a section view showing main structural components of a developing unit. FIG. 32 is a perspective view conceptually showing the surface of a developer supplying roller 4550. FIG. 33A is a section view showing a groove 4550*a* having a trapezoidal cross section. FIG. 33B is a section view showing a groove 4550*a* having a cross section in the shape of an inverted delta. FIG. 33C is a section view showing a groove 4550*a* having a semicircular cross section.

It should be noted that in FIG. 31, the arrows indicate the vertical and lateral directions as in FIG. 1. For example, the developing roller 4510 is positioned above the developer drawing roller 4540, and the amount-restricting member 4560 is on the left of the developer supplying roller 4550.

The printer 10 has, as developing units, a black developing unit 4050K containing black (K) developer, a magenta developing unit 4050M containing magenta (M) developer, a cyan developing unit 4050C containing cyan (C) developer, and a yellow developing unit 4050Y containing yellow (Y) developer. Since the structure of each developing unit is substantially the same, only the yellow developing unit 4050Y is described in detail below.

<Configuration of Developing Unit>

The yellow developing unit 4050Y has a developing roller 4510 serving as an example of a developer bearing roller, a developer containing section 4530 serving as an example of a containing section, a developer drawing roller 4540 serving as an example of a carrying roller, a developer supplying roller 4550 serving as an example of a supplying roller, a restriction blade 4560, and a developing-roller cleaning unit 4570 serving as an example of a cleaning member.

The developer containing section 4530 contains developer D which is for developing a latent image formed on the photoconductor 20Y. The type of developer D contained in the developer containing section 4530 is a high-concentration, high-viscosity, non-volatile liquid developer D, and is not the general, conventional volatile liquid developer which employs Isopar (trademark: Exxon Mobil Corporation) as a carrier and has low concentration (approximately 1 to 2 wt %) and low viscosity. More specifically, the liquid developer D according to the present embodiment has a high viscosity (approximately 100 to 10000 mPa.s) and is made by dispersing, at a high concentration (approximately 5 to 40 wt %), toner particles having an average particle size of approximately 0.1 to 5 μm and being made, for example, of resin or pigment into a non-volatile, insulating carrier liquid such as silicone oil.

The developer drawing roller 4540 draws up the developer D, which is contained in the developer containing section 4530, and supplies it to the developer supplying roller 4550. It should be noted that the developer drawing roller 4540 is described in detail further below.

The developer supplying roller 4550 supplies the developer D, which has been supplied from the developer containing section 4530 by the developer drawing roller 4540, to the developing roller 4510. The developer supplying roller 4550 is made by providing helical grooves 4550*a* (which serve as an example of depressions) at even pitches in the surface of a roller made of metal such as iron as shown in FIG. 32, and providing a nickel plating thereon. The diameter of the developer supplying roller 4550 is approximately 25 mm. A plurality of these helical grooves 4550*a* are provided in the surface of the developer supplying roller 4550 at predetermined intervals. These helical grooves 4550*a* retain the developer D that has been supplied by the developer drawing roller 4540.

The developer supplying roller 4550 of the present embodiment has, as grooves, the grooves 4550*a* which have a trapezoidal cross section as shown in FIG. 33A. It is instead possible, for example, to provide grooves having a cross section in the shape of an inverted delta as shown in FIG. 33B, or grooves having a semicircular cross section as shown in FIG. 33C. It should be noted that the size of the grooves of the developer supplying roller 4550 of the present embodiment is as shown in FIG. 33A: the groove pitch is approximately 170 μm, the width of the crest is approximately 45 μm, the width of the trough is approximately 30 μm, and the depth of the groove is approximately 50 μm.

Further, the developer supplying roller 4550 is pressed in contact with the developing roller 4510 in order to appropriately transfer the developer D on the developer supplying roller 4550 to the developing roller 4510. The developer supplying roller 4550 is rotatable about its central axis, and the central axis thereof is below the central axis of rotation of the developing roller 4510. Further, the developer supplying roller 4550 rotates in the direction (clockwise in FIG. 31) opposite from the rotating direction of the developing roller 4510 (counterclockwise in FIG. 31).

The restriction blade 4560 abuts against the surface of the developer supplying roller 4550 to restrict the amount of developer D on the developer supplying roller 4550. More specifically, the restriction blade 4560 serves as to scrape off any excessive developer D on the developer supplying roller 4550 to measure the developer D on the developer supplying roller 4550, which is to be supplied to the developing roller 4510. The restriction blade 4560 has a rubber section 4560*a* that abuts against the developer supplying roller 4550 and a rubber-supporting section 4560*b* that supports the rubber section 4560*a*. The rubber section 4560*a* is made of urethane rubber, and its rubber hardness is approximately 62 degrees in JIS (Japanese Industrial Standards) A scale. The rubber-supporting section 4560*b* is a plate made of metal such as iron.

The restriction blade 4560 is placed in contact with the developer supplying roller 4550 with its edge, and thus, carries out a so-called "edge restriction". Further, as shown in FIG. 31, the restriction blade 4560 is arranged such that its tip end faces toward the downstream side of the rotating direction of the developer supplying roller 4550, and thus, carries out a so-called "trailing restriction". In the present embodiment, the "trailing angle" at which the restriction blade 4560 trails is approximately 10 degrees.

The developing roller 4510 bears the developer D from the side on one end up to the side on the other end along its axial direction and carries it to a developing position, which is in opposition to the photoconductor 20Y, in order to develop a latent image bore by the photoconductor 20Y with the developer D. The developing roller 4510 has a layer of an elastic body, which has conductivity, on the outer circumferential section of its inner core made of metal such as iron. The diameter of the developing roller 4510 is approximately 20 mm. The layer of the elastic body has a two-layer structure: urethane rubber with a thickness of approximately 5 mm and a rubber hardness of approximately 30 degrees in JIS-A is provided as the inner layer; and urethane rubber with a thickness of approximately 30 μm and a rubber hardness of approximately 85 degrees in JIS-A is provided as the surface layer (outer layer). The developing roller 4510 is pressed in contact with the developer supplying roller 4550 and the photoconductor 20Y in an elastically-deformed state.

The developing roller 4510 is rotatable about its central axis, and the central axis thereof is below the central axis of rotation of the photoconductor 20Y. Further, the developing roller 4510 rotates in the direction (counterclockwise in FIG. 31) opposite from the rotating direction of the photoconductor 20Y (clockwise in FIG. 31). It should be noted that an electric field is generated between the developing roller 4510 and the photoconductor 20Y when the latent image formed on the photoconductor 20Y is being developed.

The developing-roller cleaning unit 4570 is a device that has a developing-roller cleaning blade 4571, which is made of rubber and which is made to abut against the surface of the developing roller 4510, and is for scraping off and removing the developer D remaining on the developing roller 4510 with the developing-roller cleaning blade 4571 after development has been carried out at the developing position.

<Overview of Developer Drawing Roller>

Figure 34:
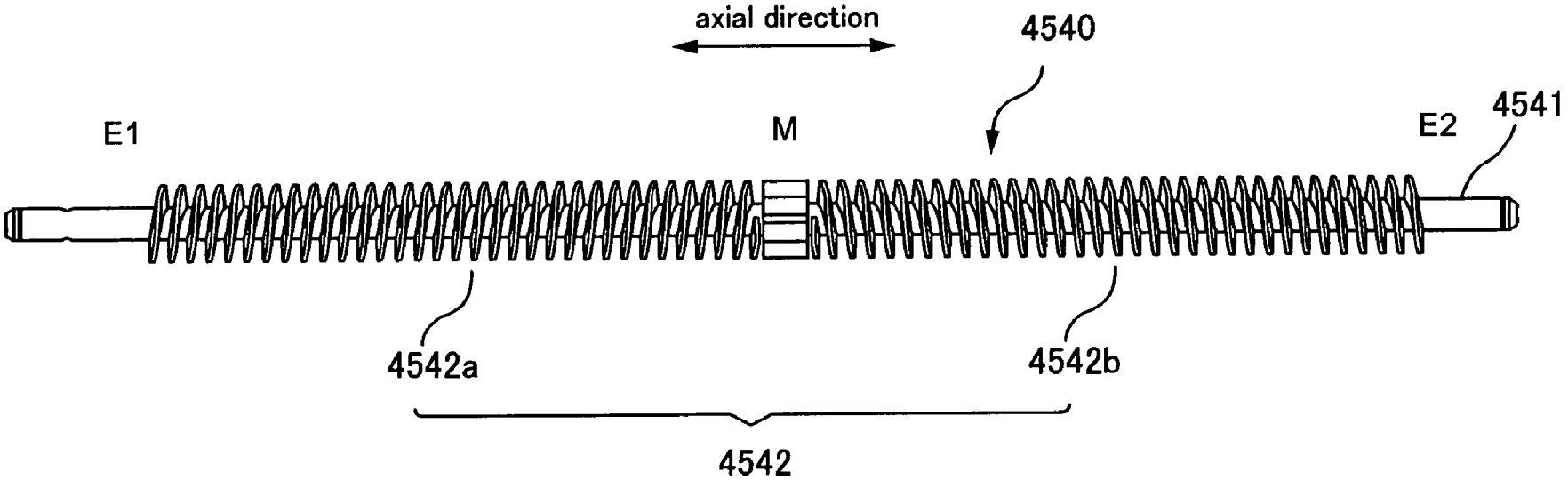
FIG. 34 is a diagram showing the shape of a developer drawing roller 4540.
Figure 35:
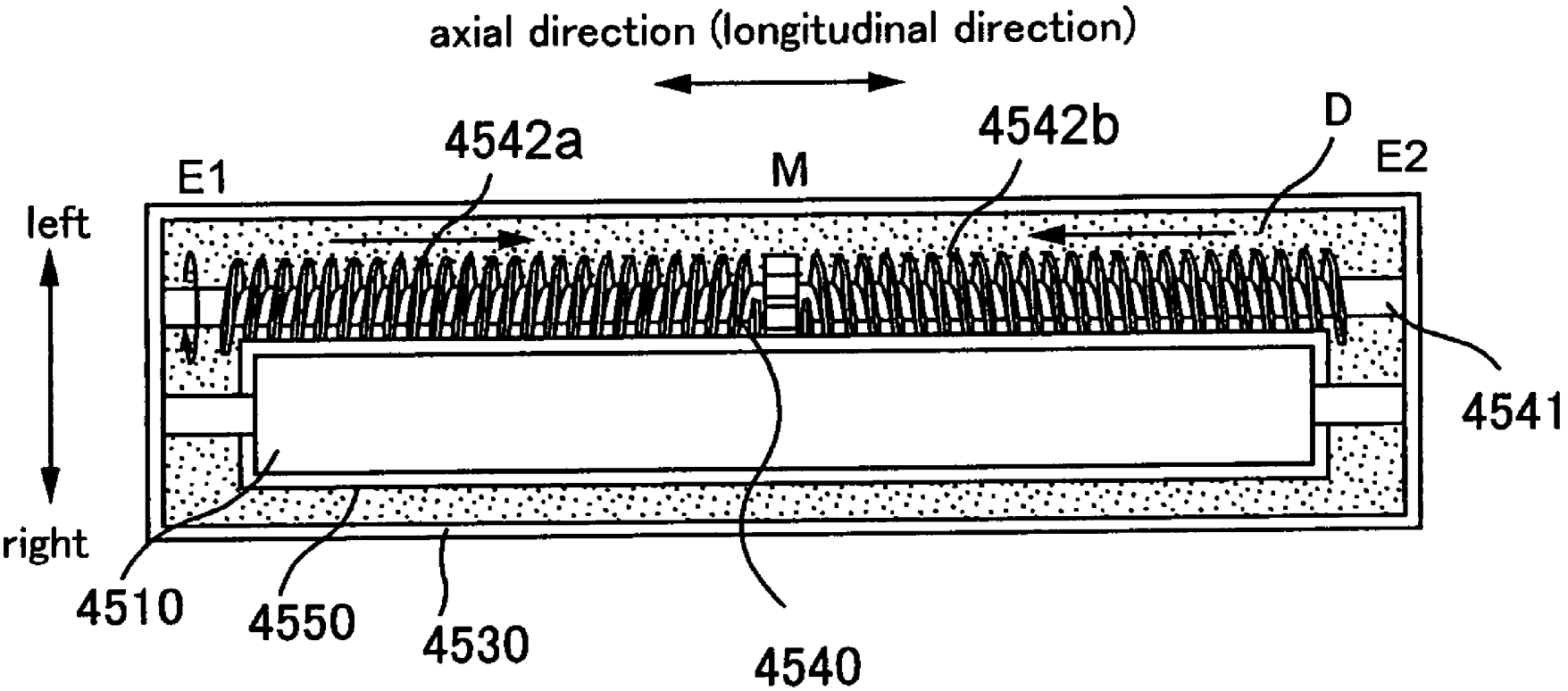
FIG. 35 is a schematic diagram of the developing unit 4050Y of FIG. 31 when it is viewed downwards from above.
Figure 36:
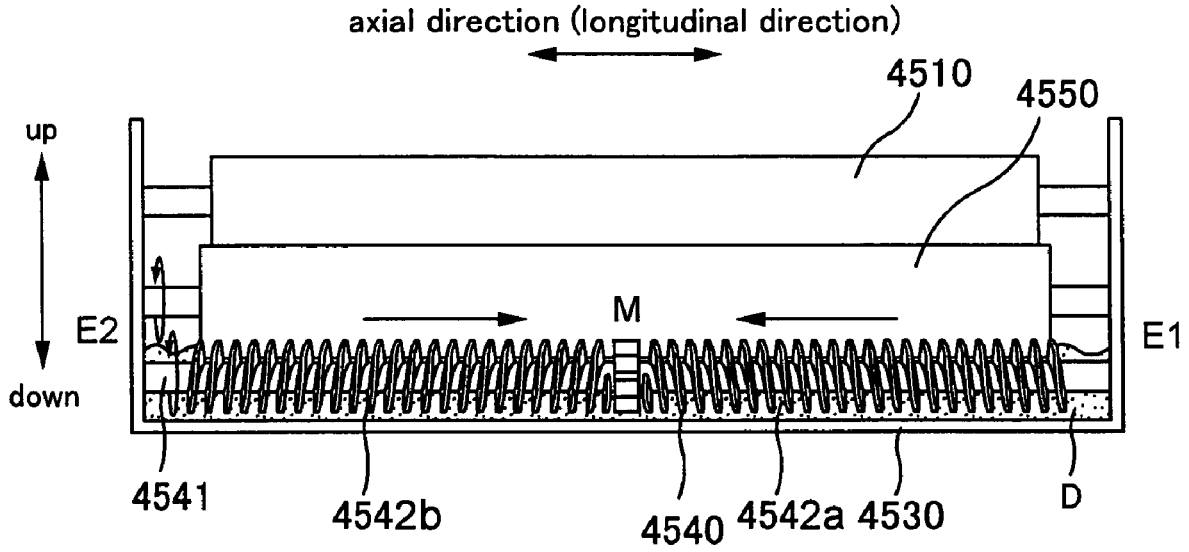
FIG. 36 is a schematic diagram of the developing unit 4050Y of FIG. 31 when it is viewed rightwards from the left side.
Figure 37:
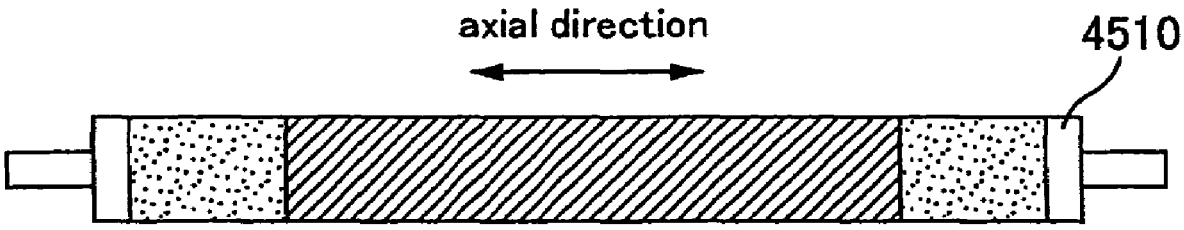
FIG. 37 is a diagram showing a developing roller 4510.

Next, the developer drawing roller 4540 is described below with reference to the drawings. FIG. 34 is a diagram showing the shape of the developer drawing roller 4540. FIG. 35 is a schematic diagram of the developing unit 4050Y of FIG. 31 when it is viewed downwards from above. FIG. 36 is a schematic diagram of the developing unit 4050Y of FIG. 31 when it is viewed rightwards from the left side. FIG. 37 is a diagram showing the developing roller 4510.

It should be noted that the vertical and lateral directions shown by the arrows in FIG. 31 correspond to the vertical and lateral directions shown in FIG. 35 and FIG. 36. Further, the single-headed arrow shown in FIG. 35 and FIG. 36 indicates the direction in which the developer D is carried when the developer drawing roller 4540 rotates. Further, in FIG. 34 through FIG. 36, "E1" indicates the side on one end of the developer drawing roller 4540, "E2" indicates the side on the other end of the developer drawing roller 4540, and "M" indicates the central section of the developer drawing roller 4540.

The developer drawing roller 4540 has a rotatable roller shaft 4541 and a helical blade 4542. In other words, the developer drawing roller 4540 is a carrying screw for carrying the developer D.

The blade 4542 is made of a first helical blade 4542*a* provided from the one-end side E1 to the central section M in the axial direction of the developer drawing roller 4540 and a second helical blade 4542*b* provided from the other-end side E2 to the central section M in the axial direction. The twisting direction of the first blade 4542*a* and the twisting direction of the second blade 4542*b* differ from each other. That is, as shown in FIG. 34, the first blade 4542*a* has a left-handed twist, whereas the second blade 4542*b* has a right-handed twist.

As shown in FIG. 31, the lower section of the developer drawing roller 4540 is immersed in the developer D contained in the developer containing section 4530. The developer drawing roller 4540 is separated from the developer supplying roller 4550 at a distance of approximately 1 mm. Further, the single developer drawing roller 4540 is located on the lower left of the developer supplying roller 4550. Furthermore, as shown in FIG. 31, the upper edge of the developer drawing roller 4540 is located above the lower edge of the developer supplying roller 4550.

The developer drawing roller 4540 is rotatable about its central axis. The central axis of the roller 4540 is below the central axis of rotation of the developer supplying roller 4550. Further, the developer drawing roller 4540 rotates in the same direction (clockwise in FIG. 31) as the rotating direction of the developer supplying roller 4550 (clockwise in FIG. 31).

As described above, the twisting direction of the first blade 4542*a* (left-handed twist) and the twisting direction of the second blade 4542*b* (right-handed twist) differ from each other. Therefore, when the developer drawing roller 4540 is rotated in the direction shown in FIG. 35 and FIG. 36 (i.e., in the clockwise direction of FIG. 31), the developer D is carried from the sides on both ends (E1 and E2) towards the central section M in the axial direction, as shown in FIG. 35 and FIG. 36.

Further, while carrying the developer D towards the central section M in the axial direction, the developer drawing roller 4540 supplies the developer D to the developer supplying roller 4550. Further, while carrying the developer D, the developer drawing roller 4540 stirs the developer D in the developer containing section 4530. Stirring of the developer D allows the toner particles in the developer D to be dispersed evenly.

<Operations of the Developing Unit>

Next, operations of the developing unit 4050Y, which is structured as above, are described below. It should be noted that the other developing units 4050M, 4050C, and 4050K carry out the same operations as those of the developing unit 4050Y.

In the yellow developing unit 4050Y, the developer drawing roller 4540 rotates about its central axis such that the developer D contained in the developer containing section 4530 is carried from the sides on both ends in the axial direction towards the central section and supplied to the developer supplying roller 4550.

With the rotation of the developer supplying roller 4550, the developer D that has been supplied to the developer supplying roller 4550 reaches an abutting position where the restriction blade 4560 abuts against the roller 4550. As the developer D on the roller 4550 passes the abutting position, an excessive portion of the developer D is scraped off by the restriction blade 4560, and thus, the amount of developer D to be supplied to the developing roller 4510 is measured. That is, since the developer supplying roller 4550 is provided with the grooves 4550*a* as described above, the restriction blade 4560, which abuts against the developer supplying roller 4550, scrapes off the developer Don the developer supplying roller 4550 except for the developer D in the grooves 4550*a*. The dimension of the grooves 4550*a* is determined in advance such that the amount of developer D to be supplied to the developing roller 4510 becomes appropriate, so that when the restriction blade 4560 scrapes off the developer D on the developer supplying roller 4550, an appropriate amount of developer D, which has been suitably measured by means of the grooves 4550*a*, will remain in the grooves 4550*a*.

With further rotation of the developer supplying roller 4550, the developer D remaining in the grooves 4550*a* of the developer supplying roller 4550 reaches a press-contact position where the roller 4550 is pressed in contact with the developing roller 4510, and is transferred from the developer supplying roller 4550 to the developing roller 4510 at the press-contact position. Upon transferring, the developer D in the grooves 4550*a* is spread by the action of a pressure that is created as a result of the developer supplying roller 4550 and the developing roller 4510 being pressed in contact with each other, thereby forming an even, thin layer of developer D on the developing roller 4510.

The thin layer of developer D formed on the developing roller 4510 in this way is carried by the rotation of the developing roller 4510 and arrives at the developing position in opposition to the photoconductor 20Y (i.e., a press-contact position where the roller 4510 abuts against the photoconductor 20Y). Then the developer D is used at the developing position for developing the latent image formed on the photoconductor 20 under an electric field of a predetermined intensity. With further rotation of the developing roller 4510, the developer D on the developing roller 4510 that has passed the developing position reaches an abutting position where the developing-roller cleaning blade 4571 abuts against the roller 4510. When passing the abutting position, the developer D adhering to the surface of the developing roller 4510 is scraped off by the developing-roller cleaning blade 4571, and the scraped-off developer D is collected into the developer containing section 4530.

Effect of Preventing Deviation in the Liquid Level of the Liquid Developer Caused by Developer Drawing Roller As described above, in the printer 10 according to the present embodiment, the developer drawing roller 4540 rotates to carry the developer D towards the central section ("M" in FIG. 35 and FIG. 36) in the axial direction of the developer drawing roller 4540. In this way, it is possible to prevent deviation in the liquid level of the developer D contained in the developer containing section 4530 from occurring. This is described in detail below.

As described in the section of the "Description of the Related Art", there are cases in which deviation occurs in the liquid level of the developer D contained in the developer containing section 4530.

For example, latent images that are bore by each of the photoconductors 20Y, 20M, 20C, and 20K and that are subjected to development are more likely to be formed in the central section in the axial direction of each photoconductor 20Y, 20M, 20C, and 20K rather than at the sides on both ends thereof. One reason to this is that in the image data for forming the latent image, there tends to be image data such as text and pictures in the central section but no text or pictures at the sides on both ends thereof.

When a latent image is formed only in the central section in the axial direction of each of the photoconductors 20Y, 20M, 20C, and 20K, the developing units 4050Y, 4050M, 4050C, and 4050K will develop the latent image using the developer D bore on the central section (the hatched region in FIG. 37) in the axial direction of the developing roller 4510. On the other hand, the developer D bore on the sides on both ends in the axial direction of the developing roller 4510, which was not used for development, is scraped off by the developing-roller cleaning blade 4571. The developer D that has been scraped off by the developing-roller cleaning blade 4571 is collected into the developer containing section 4530 at the sides on both ends in the longitudinal direction of the containing section 4530. It should be noted that FIG. 37 is a diagram showing the developing roller 4510.

Figure 38:
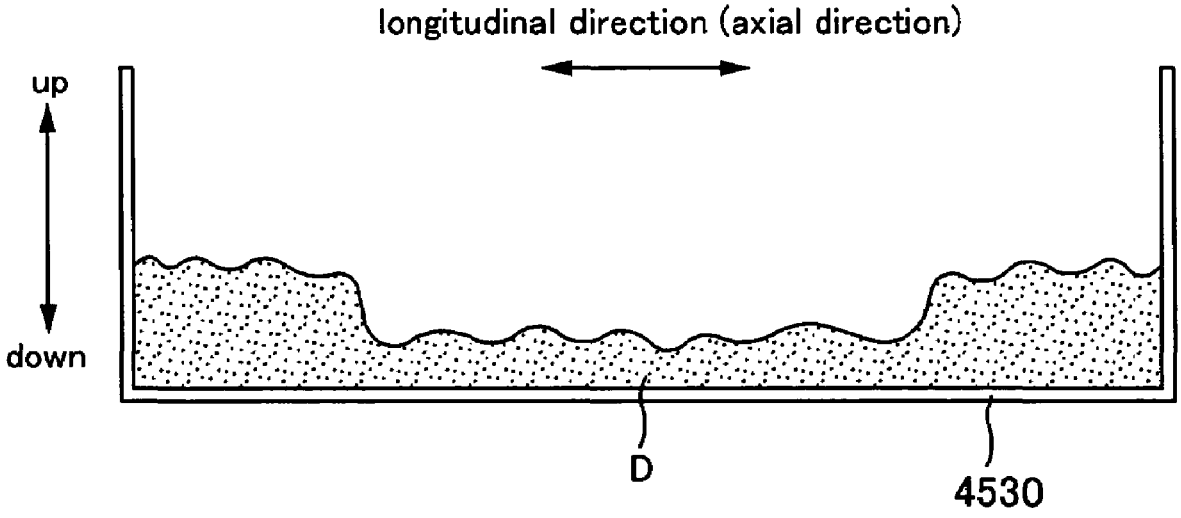
FIG. 38 is a diagram showing the developer D contained in the developer containing section 4530.

If latent images formed in the central section in the axial direction of each photoconductor 20Y, 20M, 20C, and 20K are continuously developed, then only the developer D on the central section in the longitudinal direction of the developer containing section 4530, which corresponds to the axial direction, will be used for development. As a result, the liquid level of the liquid developer at the central section in the longitudinal direction of the developer containing section 4530 becomes low, and the liquid level of the liquid developer at the sides on both ends becomes high, as shown in FIG. 38. Therefore, deviation will occur in the liquid level of the developer D contained in the developer containing section 4530. It should be noted that FIG. 38 is a diagram showing the developer D contained in the developer containing section 4530.

In view of the above, as shown in FIG. 35 and FIG. 36, the developer drawing roller 4540 is made to rotate to carry the developer D towards the central section in the axial direction of the developer drawing roller 4540. In this way, it is possible to prevent deviation in the liquid level of the developer D contained in the developer containing section, even when latent images are mainly formed in the central section in the axial direction of the photoconductors 20Y, 20M, 20C, and 20K as described above.

Consequently, it is possible to solve the above-described problem, that is, the problem that deviation occurs in the liquid level of the developer D contained in the developer containing section 4530.

Other Considerations

The fourth embodiment of the present invention relates to a liquid development device (for example, the developing units 4050Y, 4050M, 4050C, and 4050K) comprising: a developer bearing roller (for example, the developing roller 4510) that is capable of bearing liquid developer (for example, the developer D) from the side on one end of the roller up to the side on the other end along the axial direction thereof, the liquid developer bore by the developer bearing roller being used by the liquid development device to develop a latent image bore by an image bearing body (for example, the photoconductors 20Y, 20M, 20C, and 20K); a containing section (for example, the developer containing section 4530) for containing the liquid developer; and a carrying roller (for example, the developer drawing roller 4540) for carrying the liquid developer that is to be bore by the developer bearing roller.

In the foregoing embodiment, the restriction blade 4560 was arranged such that its tip end faced toward the downstream side of the rotating direction of the developer supplying roller 4550, and thus, carried out a so-called "trailing restriction". This, however, is not a limitation.

For example, the restriction blade 4560 may be arranged such that its tip end faces toward the upstream side of the rotating direction of the developer supplying roller 4550, thus carrying out a so-called "counter restriction".

Further, in the foregoing embodiment, the grooves 4550*a* were given as an example of the depressions provided in the developer supplying roller 4550. This, however, is not a limitation.

Figure 39A:
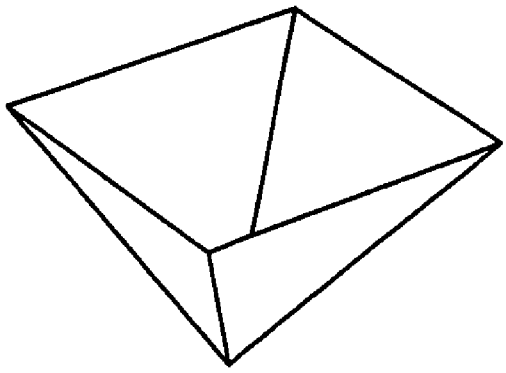
FIG. 39A is a diagram showing an example of a depression provided in the surface of the developer supplying roller 4550.
Figure 39B:
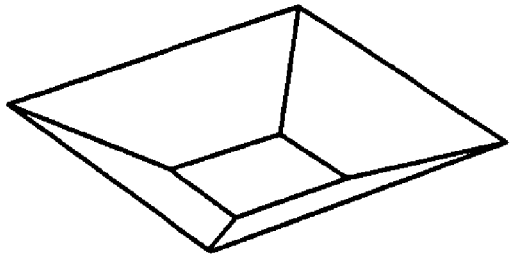
FIG. 39B is a diagram showing another example of a depression provided in the developer supplying roller 4550.

For example, a plurality of recesses having a shape as shown in FIG. 39A or FIG. 39B may be provided in the surface of the developer supplying roller 4550. It should be noted that FIG. 39A is a diagram showing an example of a recess provided in the surface of the developer supplying roller 4550, and FIG. 39B is a diagram showing another example of a recess provided in the developer supplying roller 4550.

Further, in the foregoing embodiment, the rotating direction of the developing roller 4510 was opposite from the rotating direction of the developer supplying roller 4550. This, however, is not a limitation.

For example, the rotating direction of the developing roller 4510 may be in the same direction as the rotating direction of the developer supplying roller 4550.

Further, in the foregoing embodiment, the developer drawing roller 4540 rotated to carry the developer D from the sides on both ends (E1 and E2 in FIG. 35 and FIG. 36) in the axial direction towards the central section (M in FIG. 35 and FIG. 36). This, however, is not a limitation.

For example, the developer drawing roller 4540 may rotate to carry the developer D from either the side on one end (E1 in FIG. 35 and FIG. 36) or the side on the other end (E2 in FIG. 35 and FIG. 36) in the axial direction towards the central section (M in FIG. 35 and FIG. 36).

The foregoing embodiment, however, is more preferable because when the developer drawing roller 4540 rotates to carry the developer D from the sides on both ends (E1 and E2) in the axial direction towards the central section (M), the developer drawing roller 4540 carries the developer D from the sides on both ends (E1 and E2) towards the central section (M), and therefore, even when the developer D that is bore on the central section, rather than on the sides on both ends, in the axial direction of the developing roller 4510 is used frequently for development, it is possible to minimize the difference in the liquid level of the developer D between the central section and the sides on both ends in the longitudinal direction of the developer containing section 4530.

Further, in the foregoing embodiment, the number of the developer drawing roller 4540 provided in the developing unit was one. This, however, is not a limitation.

For example, it is possible to circulate the developer D in the developer containing section 4530 using two developer drawing rollers 4540.

However, if only one developer drawing roller 4540 is provided for reasons such as to achieve downsizing of the device, then it becomes difficult to circulate the developer D in the developer containing section 4530. As a result, deviation in the liquid level of the developer D, which is contained in the developer containing section 4530, is likely to occur. The foregoing embodiment is therefore more preferable in terms that the effect of the present invention, that is, the effect that it is possible to prevent deviation in the liquid level of the developer D contained in the developer containing section 4530 from occurring, is achieved more advantageously.

Further, in the foregoing embodiment, the developer drawing roller 4540 was a carrying screw. This, however, is not a limitation.

For example, the developer drawing roller 4540 may be a carrying paddle that has paddles around the roller shaft 4541.

The foregoing embodiment, however, is more preferable because when the developer drawing roller 4540 is a carrying screw, it is possible to make it easier to carry the developer D in the axial direction.

Further, in the foregoing embodiment, the developer drawing roller 4540 was provided with a first helical blade 4542*a* provided from the side on one end (E1 in FIG. 35 and FIG. 36) in the axial direction up to the central section (M in FIG. 35 and FIG. 36), and a second helical blade 4542*b* provided from the side on the other end (E2 in FIG. 35 and FIG. 36) in the axial direction up to the central section (M in FIG. 35 and FIG. 36); and the twisting direction of the first blade 4542*a* differed from the twisting direction of the second blade 4542*b*. This, however, is not a limitation.

For example, the developer drawing roller 4540 may have only one blade.

The foregoing embodiment, however, is more preferable because, when the developer drawing roller 4540 is provided with a first helical blade 4542*a* provided from the side on one end (E1 in FIG. 35 and FIG. 36) in the axial direction up to the central section (M in FIG. 35 and FIG. 36) and a second helical blade 4542*b* provided from the side on the other end (E2 in FIG. 35 and FIG. 36) in the axial direction up to the central section (M in FIG. 35 and FIG. 36), and the twisting direction (left-handed twist; see FIG. 34) of the first blade 4542*a* differs from the twisting direction (right-handed twist; see FIG. 34) of the second blade 4542*b*, the two blades can carry the developer D, which is contained in the developer containing section 4530, towards the central section (M in FIG. 35 and FIG. 36) with the rotation of the developer drawing roller 4540.

Further, in the foregoing embodiment, the developing unit further comprised a developing-roller cleaning unit 4570 for scraping off the developer D bore by the developing roller 4510 after the latent image has been developed; and the developer D that has been scraped off by the developing-roller cleaning unit 4570 was collected into the developer containing section 4530. This, however, is not a limitation.

For example, the developing-roller cleaning unit 4570 does not have to be provided.

However, in a device where the developing unit comprises a developing-roller cleaning unit 4570 for scraping off the developer D bore by the developing roller 4510 after the latent image has been developed and the developer D that has been scraped off by the developing-roller cleaning unit 4570 is collected into the developer containing section 4530, when there are more latent images bore by each of the photoconductors 20Y, 20M, 20C, and 20K in the central section, the amount of developer D, which is scraped off by the developing-roller cleaning unit 4570, falling at the sides on both ends in the longitudinal direction of the developer containing section 4530 will be larger than the amount of developer that falls at the central section. Thus, the liquid level becomes higher at the sides on both ends and a difference in the liquid level of the developer D is likely to arise between the central section and the sides on both ends in the longitudinal direction of the developer containing section 4530. The foregoing embodiment is therefore more preferable in terms that the effect of the present invention, that is, the effect that it is possible to prevent deviation in the liquid level of the developer D contained in the developer containing section 4530 from occurring, is achieved more advantageously.

Further, in the foregoing embodiment, the developing unit further comprised a developer supplying roller 4550 that has grooves 4550*a* in its surface, that retains the developer D carried by the developer drawing roller 4540 in the grooves 4550*a*, and that supplies the developer D retained in the grooves 4550*a* to the developing roller 4510. This, however, is not a limitation.

For example, the developer supplying roller 4550 does not have to be provided.

Further, in the foregoing embodiment, the developer D was non-volatile liquid developer that is non-volatile at room temperature. This, however, is not a limitation.

For example, the developer D may be a volatile liquid developer that is volatile at room temperature.

When non-volatile liquid developer is adopted as the developer D, the developer D will be poor in flowability. Thus, deviation in the liquid level of the developer D, which is contained in the developer containing section 4530, is more likely to occur. The foregoing embodiment is therefore more preferable in terms that the effect of the present invention, that is, the effect that it is possible to prevent deviation in the liquid level of the developer D contained in the developer containing section 4530 from occurring, is achieved more advantageously.

OTHER EMBODIMENTS

In the foregoing, an image forming apparatus etc. according to the present invention was described according to the above-described embodiments thereof. However, the foregoing embodiments of the invention are for the purpose of facilitating understanding of the present invention and are not to be interpreted as limiting the present invention. The present invention can be altered and improved without departing from the gist thereof, and needless to say, the present invention includes its equivalents.

In the foregoing embodiments, an intermediate transferring type full-color laser beam printer was described as an example of the image forming apparatus. This, however, is not a limitation.

For example, the present invention is also applicable to full-color laser beam printers that are not of the intermediate transferring type. Further, other than full-color laser printers, the present invention is also applicable to monochrome laser beam printers. Furthermore, other than printers, the present invention is also applicable to various other types of image forming apparatuses such as copying machines and facsimiles.

Further, in the foregoing embodiments, the photoconductor was described as having a structure in which a photoconductive layer was provided on the outer peripheral surface of a cylindrical conductive base. This, however, is not a limitation.

For example, the photoconductor can be a so-called "photoconductive belt" structured by providing a photoconductive layer on a surface of a belt-like conductive base.

Configuration of Image Forming System Etc.

Next, an embodiment of an image forming system, which serve as an example of an embodiment of the present invention, is described with reference to the drawings.

Figure 40:
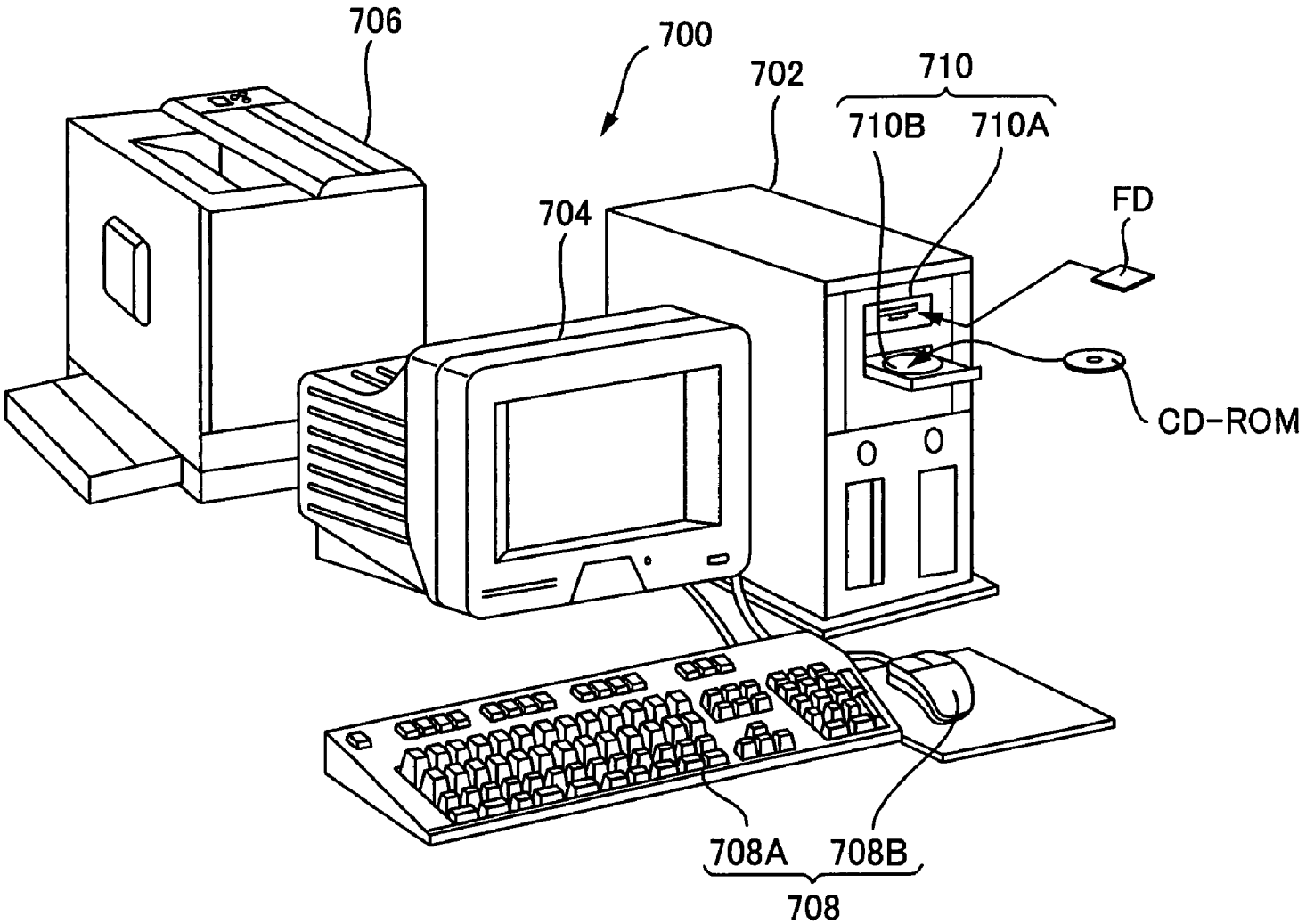
FIG. 40 is an explanatory drawing showing an external structure of an image forming system.

FIG. 40 is an explanatory drawing showing an external structure of an image forming system. The image forming system 700 comprises a computer 702, a display device 704, a printer 706, an input device 708, and a reading device 710. In this embodiment, the computer 702 is accommodated in a mini-tower type housing, but this is not a limitation. A CRT (cathode ray tube), a plasma display, or a liquid crystal display device, for example, is generally used as the display device 704, but this is not a limitation. The printer described above is used as the printer 706. In this embodiment, a keyboard 708A and a mouse 708B are used as the input device 708, but this is not a limitation. In this embodiment, a flexible disk drive device 710A and a CD-ROM drive device 710B are used as the reading device 710, but the reading device is not limited to these, and other devices such as an MO (magneto optical) disk drive device or a DVD (digital versatile disk) may be used.

Figure 41:
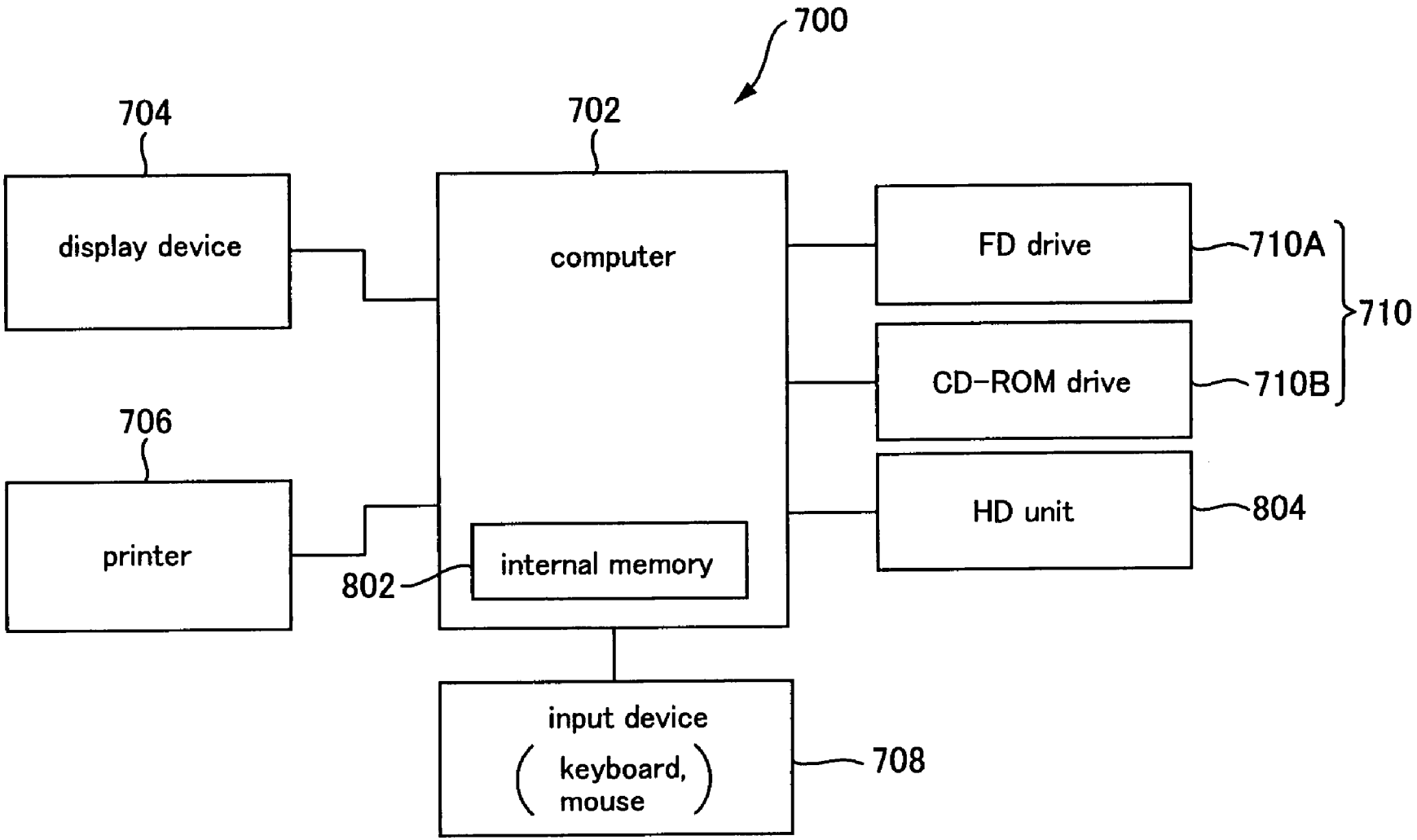
FIG. 41 is a block diagram showing a configuration of the image forming system shown in FIG. 40.

FIG. 41 is a block diagram showing a configuration of the image forming system shown in FIG. 40. Further provided are an internal memory 802, such as a RAM inside the housing accommodating the computer 702, and an external memory such as a hard disk drive unit 804.

It should be noted that in the above description, an example in which the image forming system is structured by connecting the printer 706 to the computer 702, the display device 704, the input device 708, and the reading device 710 was described, but this is not a limitation. For example, the image forming system can be made of the computer 702 and the printer 706, and the image forming system does not have to comprise any one of the display device 704, the input device 708, and the reading device 710.

Further, for example, the printer 706 can have some of the functions or mechanisms of the computer 702, the display device 704, the input device 708, and the reading device 710. As an example, the printer 706 may be configured so as to have an image processing section for carrying out image processing, a displaying section for carrying out various types of displays, and a recording media attach/detach section to and from which recording media storing image data captured by a digital camera or the like are inserted and taken out.

As, an overall system, the image forming system that is achieved in this way becomes superior to conventional systems.

What is claimed is:

1. A liquid development device comprising:

a developer retaining roller having recesses provided in a surface of said developer retaining roller, said recesses being provided for retaining liquid developer; and a supplying roller for supplying said liquid developer to said developer retaining roller, wherein an upper edge of said supplying roller is located above a lower edge of said developer retaining roller in a vertical direction, and wherein said supplying roller supplies said liquid developer to said developer retaining roller downwards from above, wherein said developer retaining roller and said supplying roller do not abut against each other.

2. A liquid development device according to claim 1, wherein:

said recesses are helical grooves; and a plurality of said helical grooves are provided in the surface of said developer retaining roller at predetermined intervals.

3. A liquid development device according to claim 1, wherein said liquid developer is non-volatile liquid developer that is non-volatile at room temperature.

4. A liquid development device comprising:

a developer retaining roller having recesses provided in a surface of said developer retaining roller, said recesses being provided for retaining liquid developer; and a supplying roller for supplying said liquid developer to said developer retaining roller, wherein an upper edge of said supplying roller is located above a lower edge of said developer retaining roller in a vertical direction, and wherein said supplying roller supplies said liquid developer to said developer retaining roller downwards from above, wherein among four quadrants formed by a first coordinate axis that passes a center of said developer retaining roller and that extends in a vertically upward direction and a second coordinate axis that passes the center of said developer retaining roller and that extends from left to right of said first coordinate axis, a rotating direction of said developer retaining roller is in a direction in which said developer retaining roller moves from a third quadrant toward a second quadrant;

a rotating direction of said supplying roller is in a same direction as said rotating direction of said developer retaining roller; and said supplying roller is located on a left side of said first coordinate axis.

5. A liquid development device according to claim 4, wherein:

said liquid development device further comprises an amount-restricting member that is for restricting an amount of said liquid developer retained in said recesses and that abuts against said developer retaining roller; and said supplying roller is located in said third quadrant and said amount-restricting member is located in said second quadrant.

6. A liquid development device according to claim 5, wherein in said vertical direction, an abutting position where said amount-restricting member abuts against said developer retaining roller is located above a position of a liquid surface of said liquid developer.

7. A liquid development device comprising:

a developer retaining roller having recesses provided in a surface of said developer retaining roller, said recesses being provided for retaining liquid developer; and a supplying roller for supplying said liquid developer to said developer retaining roller, wherein an upper edge of said supplying roller is located above a lower edge of said developer retaining roller in a vertical direction, and wherein said supplying roller supplies said liquid developer to said developer retaining roller downwards from above, wherein said liquid development device is not provided with a cleaning member for cleaning the liquid developer retained in said recesses.

8. A liquid development device comprising:

a developer retaining roller having recesses provided in a surface of said developer retaining roller, said recesses being provided for retaining liquid developer; and a supplying roller for supplying said liquid developer to said developer retaining roller, wherein:

an upper edge of said supplying roller is located above a lower edge of said developer retaining roller in a vertical direction;

said supplying roller supplies said liquid developer to said developer retaining roller downwards from above;

among four quadrants formed by a first coordinate axis that passes a center of said developer retaining roller and that extends in a vertically upward direction and a second coordinate axis that passes the center of said developer retaining roller and that extends from left to right of said first coordinate axis, a rotating direction of said developer retaining roller is in a direction in which said developer retaining roller moves from a third quadrant toward a second quadrant;

a rotating direction of said supplying roller is in a same direction as said rotating direction of said developer retaining roller;

said supplying roller is located on a left side of said first coordinate axis;

said liquid development device further comprises an amount-restricting member that is for restricting an amount of said liquid developer retained in said recesses and that abuts against said developer retaining roller;

said supplying roller is located in said third quadrant and said amount-restricting member is located in said second quadrant;

in said vertical direction, an abutting position where said amount-restricting member abuts against said developer retaining roller is located above a position of a liquid surface of said liquid developer;

said developer retaining roller and said supplying roller do not abut against each other;

said liquid development device is not provided with a cleaning member for cleaning the liquid developer retained in said recesses;

said recesses are helical grooves;

a plurality of said helical grooves are provided in the surface of said developer retaining roller at predetermined intervals; and said liquid developer is non-volatile liquid developer that is non-volatile at room temperature.

9. An image forming apparatus comprising a liquid development device that includes:

a developer retaining roller having recesses provided in a surface of said developer retaining roller, said recesses being provided for retaining liquid developer; and a supplying roller for supplying said liquid developer to said developer retaining roller, wherein an upper edge of said supplying roller is located above a lower edge of said developer retaining roller in a vertical direction, and wherein said supplying roller supplies said liquid developer to said developer retaining roller downwards from above, wherein said developer retaining roller and said supplying roller do not abut against each other.

10. An image forming system comprising:

a computer; and an image forming apparatus that is connectable to said computer and that has a liquid development device including:

a developer retaining roller having recesses provided in a surface of said developer retaining roller, said recesses being provided for retaining liquid developer; and a supplying roller for supplying said liquid developer to said developer retaining roller, wherein an upper edge of said supplying roller is located above a lower edge of said developer retaining roller in a vertical direction, and wherein said supplying roller supplies said liquid developer to said developer retaining roller downwards from above, wherein said developer retaining roller and said supplying roller do not abut against each other.

11. A liquid development device comprising:

a retaining roller having recesses provided in a surface of said retaining roller, said recesses being provided for retaining liquid developer;

a supplying roller for supplying said liquid developer to said retaining roller, an upper edge of said supplying roller being located above a lower edge of said retaining roller in a vertical direction; and an amount-restricting member for restricting an amount of said liquid developer retained in said recesses, wherein, among four quadrants formed by a first coordinate axis that passes a center of said retaining roller and that extends in a vertically upward direction and a second coordinate axis that passes the center of said retaining roller and that extends horizontally from left to right of said first coordinate axis, said supplying roller is located in either one of a third quadrant and a fourth quadrant, and said amount-restricting member is located in a quadrant vertically above the quadrant where said supplying roller is located, wherein a rotating direction of said retaining roller is in a direction in which said retaining roller moves from said quadrant where said supplying roller is located toward a quadrant where said amount-restricting member is located, and wherein a rotating direction of said supplying roller is in a same direction as said rotating direction of said retaining roller.

12. A liquid development device according to claim 11, wherein a vertical line that extends vertically downwards from an abutting position where said amount-restricting member abuts against said retaining roller passes through said supplying roller.

13. A liquid development device according to claim 12, wherein:

said supplying roller does not abut against said retaining roller; and an angle formed between a direction from the center of said retaining roller to said abutting position and a direction from said center of said retaining roller to a center of said supplying roller is equal to or less than 90°.

14. A liquid development device according to claim 12, wherein in said vertical line, said abutting position is located above a position of a liquid surface of said liquid developer.

15. A liquid development device according to claim 11, wherein said liquid developer is non-volatile liquid developer that is non-volatile at room temperature.

16. A liquid development device according to claim 11, wherein:

said liquid development device further comprises a developer bearing roller to which the liquid developer, whose amount has been restricted by said amount-restricting member, is applied by said retaining roller and that is for bearing said liquid developer that has been applied thereto; and said developer bearing roller is located vertically above said second coordinate axis.

17. A liquid development device according to claim 11, wherein:

said recesses of said retaining roller are helical grooves; and a plurality of said helical grooves are provided in the surface of said retaining roller at predetermined intervals.

18. A liquid development device comprising:

a retaining roller having recesses provided in a surface of said retaining roller, said recesses being provided for retaining liquid developer;

a supplying roller for supplying said liquid developer to said retaining roller, an upper edge of said supplying roller being located above a lower edge of said retaining roller in a vertical direction; and an amount-restricting member for restricting an amount of said liquid developer retained in said recesses, wherein:

among four quadrants formed by a first coordinate axis that passes a center of said retaining roller and that extends in a vertically upward direction and a second coordinate axis that passes the center of said retaining roller and that extends horizontally from left to right of said first coordinate axis, said supplying roller is located in either one of a third quadrant and a fourth quadrant, and said amount-restricting member is located in a quadrant vertically above the quadrant where said supplying roller is located;

a rotating direction of said retaining roller is in a direction in which said retaining roller moves from said quadrant where said supplying roller is located toward a quadrant where said amount-restricting member is located;

a rotating direction of said supplying roller is in a same direction as said rotating direction of said retaining roller;

a vertical line that extends vertically downwards from an abutting position where said amount-restricting member abuts against said retaining roller passes through said supplying roller;

said supplying roller does not abut against said retaining roller;

an angle formed between a direction from the center of said retaining roller to said abutting position and a direction from said center of said retaining roller to a center of said supplying roller is equal to or less than 90°;

in said vertical line, said abutting position is located above a position of a, liquid surface of said liquid developer;

said liquid developer is non-volatile liquid developer that is non-volatile at room temperature;

said liquid development device further comprises a developer bearing roller to which the liquid developer, whose amount has been restricted by said amount-restricting member, is applied by said retaining roller and that is for bearing said liquid developer that has been applied thereto;

said developer bearing roller is located vertically above said second coordinate axis;

said recesses of said retaining roller are helical grooves; and a plurality of said helical grooves are provided in the surface of said retaining roller at predetermined intervals.

19. An image forming apparatus comprising a liquid development device that includes:

a retaining roller having recesses provided in a surface of said retaining roller, said recesses being provided for retaining liquid developer;

a supplying roller for supplying said liquid developer to said retaining roller, an upper edge of said supplying roller being located above a lower edge of said retaining roller in a vertical direction; and an amount-restricting member for restricting an amount of said liquid developer retained in said recesses, wherein, among four quadrants formed by a first coordinate axis that passes a center of said retaining roller and that extends in a vertically upward direction and a second coordinate axis that passes the center of said retaining roller and that extends horizontally from left to right of said first coordinate axis, said supplying roller is located in either one of a third quadrant and a fourth quadrant, and said amount-restricting member is located in a quadrant vertically above the quadrant where said supplying roller is located, wherein a rotating direction of said retaining roller is in a direction in which said retaining roller moves from said quadrant where said supplying roller is located toward a quadrant where said amount-restricting member is located, and wherein a rotating direction of said supplying roller is in a same direction as said rotating direction of said retaining roller.

20. An image forming system comprising:

a computer; and an image forming apparatus that is connectable to said computer and that has a liquid development device including:

a retaining roller having recesses provided in a surface of said retaining roller, said recesses being provided for retaining liquid developer;

a supplying roller for supplying said liquid developer to said retaining roller, an upper edge of said supplying roller being located above a lower edge of said retaining roller in a vertical direction; and an amount-restricting member for restricting an amount of said liquid developer retained in said recesses, wherein, among four quadrants formed by a first coordinate axis that passes a center of said retaining roller and that extends in a vertically upward direction and a second coordinate axis that passes the center of said retaining roller and that extends horizontally from left to right of said first coordinate axis, said supplying roller is located in either one of a third quadrant and a fourth quadrant, and said amount-restricting member is located in a quadrant vertically above the quadrant where said supplying roller is located, wherein a rotating direction of said retaining roller is in a direction in which said retaining roller moves from said quadrant where said supplying roller is located toward a quadrant where said amount-restricting member is located, and wherein a rotating direction of said supplying roller is in a same direction as said rotating direction of said retaining roller.

21. A liquid development device comprising:

a retaining roller for retaining liquid developer to be supplied to a developer bearing body;

a carrying roller for carrying said liquid developer to said retaining roller;

an amount-restricting member for restricting an amount of said liquid developer on said retaining roller; and a containing section for containing said liquid developer, wherein, among four quadrants formed by a first coordinate axis that passes a center of said retaining roller and that extends in a vertically upward direction and a second coordinate axis that passes the center of said retaining roller and that extends horizontally from left to right of said first coordinate axis, said amount-restricting member is located in a first quadrant when said carrying roller is located in a third quadrant, and said amount-restricting member is located in a second quadrant when said carrying roller is located in a fourth quadrant, wherein an upper edge of said carrying roller is located above a lower edge of said retaining roller in a vertical direction.

22. A liquid development device according to claim 21, wherein said amount-restricting member has an abutting section that abuts against a surface of said retaining roller and a supporting section that supports said abutting section.

23. A liquid development device according to claim 22, wherein:

said abutting section abuts against said surface of said retaining roller at one end; and in said vertical direction, said one end of said abutting section is located above an other end of said abutting section.

24. A liquid development device according to claim 21, wherein said liquid developer is non-volatile liquid developer that is non-volatile at room temperature.

25. A liquid development device comprising:

a retaining roller for retaining liquid developer to be supplied to a developer bearing body;

a carrying roller for carrying said liquid developer to said retaining roller;

an amount-restricting member for restricting an amount of said liquid developer on said retaining roller; and a containing section for containing said liquid developer, wherein, among four quadrants formed by a first coordinate axis that passes a center of said retaining roller and that extends in a vertically upward direction and a second coordinate axis that passes the center of said retaining roller and that extends horizontally from left to right of said first coordinate axis, said amount-restricting member is located in a first quadrant when said carrying roller is located in a third quadrant, and said amount-restricting member is located in a second quadrant when said carrying roller is located in a fourth quadrant, wherein said developer bearing body is provided in said liquid development device;

said developer bearing body is a developing roller;

a rotating direction of said developing roller is opposite from a rotating direction of said retaining roller;

said carrying roller is located in the fourth quadrant and said amount-restricting member is located in the second quadrant; and a rotating direction of said carrying roller is in a same direction as said rotating direction of said retaining roller.

26. A liquid development device comprising:

a retaining roller for retaining liquid developer to be supplied to a developer bearing body;

a carrying roller for carrying said liquid developer to said retaining roller;

an amount-restricting member for restricting an amount of said liquid developer on said retaining roller; and a containing section for containing said liquid developer, wherein:

among four quadrants formed by a first coordinate axis that passes a center of said retaining roller and that extends in a vertically upward direction and a second coordinate axis that passes the center of said retaining roller and that extends horizontally from left to right of said first coordinate axis, said amount-restricting member is located in a first quadrant when said carrying roller is located in a third quadrant, and said amount-restricting member is located in a second quadrant when said carrying roller is located in a fourth quadrant;

an upper edge of said carrying roller is located above a lower edge of said retaining roller in a vertical direction;

said amount-restricting member has an abutting section that abuts against a surface of said retaining roller and a supporting section that supports said abutting section;

said abutting section abuts against said surface of said retaining roller at one end;

in said vertical direction, said one end of said abutting section is located above an other end of said abutting section;

said developer bearing body is provided in said liquid development device;

said developer bearing body is a developing roller;

a rotating direction of said developing roller is opposite from a rotating direction of said retaining roller;

said carrying roller is located in the fourth quadrant and said amount-restricting member is located in the second quadrant;

a rotating direction of said carrying roller is in a same direction as said rotating direction of said retaining roller; and said liquid developer is non-volatile liquid developer that is non-volatile at room temperature.

27. An image forming apparatus comprising:

an image bearing body for bearing a latent image; and a liquid development device that includes:

a retaining roller for retaining liquid developer to be supplied to a developer bearing body;

a carrying roller for carrying said liquid developer to said retaining roller;

an amount-restricting member for restricting an amount of said liquid developer on said retaining roller; and a containing section for containing said liquid developer, said liquid development device developing the latent image bore by said image bearing body with the liquid developer bore by said developer bearing body, wherein, among four quadrants formed by a first coordinate axis that passes a center of said retaining roller and that extends in a vertically upward direction and a second coordinate axis that passes the center of said retaining roller and that extends horizontally from left to right of said first coordinate axis, said amount-restricting member is located in a first quadrant when said carrying roller is located in a third quadrant, and said amount-restricting member is located in a second quadrant when said carrying roller is located in a fourth quadrant, wherein an upper edge of said carrying roller is located above a lower edge of said retaining roller in a vertical direction.

28. An image forming system comprising:

a computer; and an image forming apparatus that is connectable to said computer and that has:

an image bearing body for bearing a latent image; and a liquid development device that includes:

a retaining roller for retaining liquid developer to be supplied to a developer bearing body;

a carrying roller for carrying said liquid developer to said retaining roller;

an amount-restricting member for restricting an amount of said liquid developer on said retaining roller; and a containing section for containing said liquid developer, said liquid development device developing the latent image bore by said image bearing body with the liquid developer bore by said developer bearing body, wherein, among four quadrants formed by a first coordinate axis that passes a center of said retaining roller and that extends in a vertically upward direction and a second coordinate axis that passes the center of said retaining roller and that extends horizontally from left to right of said first coordinate axis, said amount-restricting member is located in a first quadrant when said carrying roller is located in a third quadrant, and said amount-restricting member is located in a second quadrant when said carrying roller is located in a fourth quadrant, wherein an upper edge of said carrying roller is located above a lower edge of said retaining roller in a vertical direction.

29. A liquid development device comprising:

a developer bearing roller that is capable of bearing liquid developer from a side on one end of said developer bearing roller up to a side on an other end along an axial direction thereof, said liquid developer bore by said developer bearing roller being used by said liquid development device to develop a latent image bore by an image bearing body;

a containing section for containing said liquid developer; and a carrying roller for carrying said liquid developer that is to be bore by said developer bearing roller, wherein said carrying roller rotates to carry said liquid developer towards a central section, in the axial direction, of said carrying roller.

30. A liquid development device according to claim 29, wherein said carrying roller rotates to carry said liquid developer from the sides on both ends in said axial direction towards said central section.

31. A liquid development device according to claim 30, wherein a number of said carrying roller provided in said liquid development device is one.

32. A liquid development device according to claim 29, wherein said carrying roller is a carrying screw.

33. A liquid development device according to claim 32, wherein:

said carrying screw is provided with a first helical blade provided from said side on one end in said axial direction up to said central section, and a second helical blade provided from said side on the other end in said axial direction up to said central section; and a twisting direction of said first blade differs from a twisting direction of said second blade.

34. A liquid development device according to claim 29, wherein:

said liquid development device further comprises a cleaning member for scraping off the liquid developer bore by said developer bearing roller after said latent image has been developed; and the liquid developer that has been scraped off by said cleaning member is collected into said containing section.

35. A liquid development device according to claim 29, wherein said liquid development device further comprises a supplying roller that has depressions in its surface, that retains said liquid developer carried by said carrying roller in said depressions, and that supplies said liquid developer retained in said depressions to said developer bearing roller.

36. A liquid development device according to claim 29, wherein said liquid developer is non-volatile liquid developer that is non-volatile at room temperature.

37. A liquid development device comprising:

a developer bearing roller that is capable of bearing liquid developer from a side on one end of said developer bearing roller up to a side on an other end along an axial direction thereof, said liquid developer bore by said developer bearing roller being used by said liquid development device to develop a latent image bore by an image bearing body;

a containing section for containing said liquid developer; and a carrying roller for carrying said liquid developer that is to be bore by said developer bearing roller, wherein said carrying roller rotates to carry said liquid developer from the sides on both ends in said axial direction towards the central section of said carrying roller, wherein:

a number of said carrying roller provided in said liquid development device is one;

said carrying roller is a carrying screw;

said carrying screw is provided with a first helical blade provided from said side on one end in said axial direction up to said central section, and a second helical blade provided from said side on the other end in said axial direction up to said central section;

a twisting direction of said first blade differs from a twisting direction of said second blade;

said liquid development device further comprises a cleaning member for scraping off the liquid developer bore by said developer bearing roller after said latent image has been developed;

the liquid developer that has been scraped off by said cleaning member is collected into said containing section;

said liquid development device further comprises a supplying roller that has depressions in its surface, that retains said liquid developer carried by said carrying roller in said depressions, and that supplies said liquid developer retained in said depressions to said developer bearing roller; and said liquid developer is non-volatile liquid developer that is non-volatile at room temperature.

38. An image forming apparatus comprising:

an image bearing body for bearing a latent image; and a liquid development device that includes:

a developer bearing roller that is capable of bearing liquid developer from a side on one end of said developer bearing roller up to a side on an other end along an axial direction thereof, said liquid developer bore by said developer bearing roller being used by said liquid development device to develop the latent image bore by said image bearing body;

a containing section for containing said liquid developer; and a carrying roller for carrying said liquid developer that is to be bore by said developer bearing roller, wherein said carrying roller rotates to carry said liquid developer towards a central section, in the axial direction, of said carrying roller.

39. An image forming system comprising:

a computer; and an image forming apparatus that is connectable to said computer and that has:

an image bearing body for bearing a latent image; and a liquid development device that includes:

a developer bearing roller that is capable of bearing liquid developer from a side on one end of said developer bearing roller up to the a side on the an other end along an axial direction thereof, said liquid developer bore by said developer bearing roller being used by said liquid development device to develop the latent image bore by said image bearing body;

a containing section for containing said liquid developer; and a carrying roller for carrying said liquid developer that is to be bore by said developer bearing roller, wherein said carrying roller rotates to carry said liquid developer towards a central section, in the axial direction, of said carrying roller.

* * * * *